US011104128B2

(12) United States Patent
Fukuzawa

(10) Patent No.: US 11,104,128 B2
(45) Date of Patent: Aug. 31, 2021

(54) LIQUID EJECTING HEAD AND LIQUID EJECTING SYSTEM

(71) Applicant: SEIKO EPSON CORPORATION, Tokyo (JP)

(72) Inventor: Yuma Fukuzawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/721,146

(22) Filed: Dec. 19, 2019

(65) Prior Publication Data

US 2020/0198343 A1 Jun. 25, 2020

(30) Foreign Application Priority Data

Dec. 21, 2018 (JP) ..... JP2018-239217
Dec. 21, 2018 (JP) ..... JP2018-239220
Mar. 25, 2019 (JP) ..... JP2019-056087

(51) Int. Cl.
*B41J 2/14* (2006.01)
*B41J 2/18* (2006.01)

(52) U.S. Cl.
CPC ..... *B41J 2/1404* (2013.01); *B41J 2/14145* (2013.01); *B41J 2/18* (2013.01); *B41J 2002/14338* (2013.01); *B41J 2202/12* (2013.01)

(58) Field of Classification Search
CPC ..... B41J 2202/12
See application file for complete search history.

(56) References Cited

U.S. PATENT DOCUMENTS

2010/0238238 A1 9/2010 Yamamoto
2013/0233939 A1 9/2013 Uezawa et al.
2017/0157945 A1* 6/2017 Govyadinov ..... B41J 2/15
2017/0190179 A1* 7/2017 Menzel ..... B41J 2/161
2017/0239946 A1 8/2017 Nakagawa et al.
2020/0198341 A1* 6/2020 Fukuzawa ..... B41J 2/14233
2020/0198344 A1* 6/2020 Fukuzawa ..... B41J 2/1404

FOREIGN PATENT DOCUMENTS

JP H02500584 3/1990
JP 2013184372 9/2013
JP 2017144699 8/2017
WO 1989002577 3/1989
WO WO-2019130532 A1 * 7/2019 ..... B41J 2/155

* cited by examiner

*Primary Examiner* — Shelby L Fidler
(74) *Attorney, Agent, or Firm* — Workman Nydegger

(57) ABSTRACT

First and second individual flow paths coupling a first common liquid chamber to a second common liquid chamber are arranged side by side, and each individual flow path is provided with first and second pressure chambers. At least a part of the first individual flow path is provided in a space overlapping a region between the adjacent second pressure chambers when viewed in a Z axis direction, the space not overlapping the second pressure chamber when viewed in a Y axis direction.

18 Claims, 35 Drawing Sheets

LIQUID EJECTING HEAD AND LIQUID EJECTING SYSTEM

The present application is based on, and claims priority from JP Application Serial Number 2018-239217, filed Dec. 21, 2018, JP Application Serial Number 2018-239220, filed Dec. 21, 2018, and JP Application Serial Number 2019-056087, filed Mar. 25, 2019, the disclosures of which are hereby incorporated by reference herein in their entirety.

BACKGROUND

1. Technical Field

The present disclosure relates to a liquid ejecting head and a liquid ejecting system ejecting a liquid from a nozzle, and particularly to an ink jet recording head and an ink jet recording system discharging ink as a liquid.

2. Related Art

As a liquid ejecting head ejecting a liquid, there is an ink jet recording head that performs processing by discharging ink as a liquid onto a medium to be printed.

The ink jet recording head includes an individual flow path having a pressure chamber communicating with a nozzle, a common liquid chamber communicating in common with a plurality of individual flow paths, and an energy generation element such as a piezoelectric actuator causing a pressure change of ink in the pressure chamber, and discharges ink droplets from the nozzle as a result of the energy generation element causing a pressure change of the ink in the pressure chamber.

In the ink jet recording head, in a case where an air bubble stays in the pressure chamber, the air bubble absorbs a pressure change caused by the energy generation element, and thus an ink droplet cannot be normally discharged from the nozzle.

Thus, there has been proposed an ink jet recording head having a configuration in which a first common liquid chamber and a second common liquid chamber as common liquid chambers common to individual flow paths are provided, and ink is caused to flow from the first common liquid chamber to the second common liquid chamber through the individual flow paths, that is, the ink is circulated (for example, refer to JP-A-2013-184372).

In such an ink jet recording head, there is the desire to suppress increase in size thereof by efficiently disposing pressure chambers or individual communication flow paths making the pressure chambers communicate with a common flow path.

The desire is present not only in the ink jet recording head but also in liquid ejecting heads ejecting liquids other than ink.

SUMMARY

An advantage of some aspects of the disclosure is to provide a liquid ejecting head and a liquid ejecting system of which increase in size is suppressed by efficiently disposing pressure chambers or individual communication flow paths.

According to an aspect of the present disclosure, there is provided a liquid ejecting head including a plurality of nozzles that discharge a liquid in a first axis direction; first and second common liquid chambers that communicate in common with the plurality of nozzles; and an individual flow path that is provided for each of the nozzles, couples the first common liquid chamber to the second common liquid chamber, and communicates with the nozzle between the first common liquid chamber and the second common liquid chamber, in which each individual flow path includes a pressure chamber provided with an energy generation element, and an individual communication flow path coupling the pressure chamber to the first and second common liquid chambers, a plurality of the pressure chambers are arranged side by side in a second axis direction orthogonal to the first axis direction to form first and second pressure chamber rows, and the first pressure chamber row and the second pressure chamber row are disposed to be shifted relative to each other in a third axis direction orthogonal to the first axis direction and the second axis direction when viewed in the second axis direction, and the individual communication flow path corresponding to the first pressure chamber row has a portion overlapping a region between the adjacent pressure chambers of the second pressure chamber row when viewed in the first axis direction, the portion not overlapping the second pressure chamber row when viewed in the second axis direction.

DESCRIPTION OF EXEMPLARY EMBODIMENTS

Figure 1:
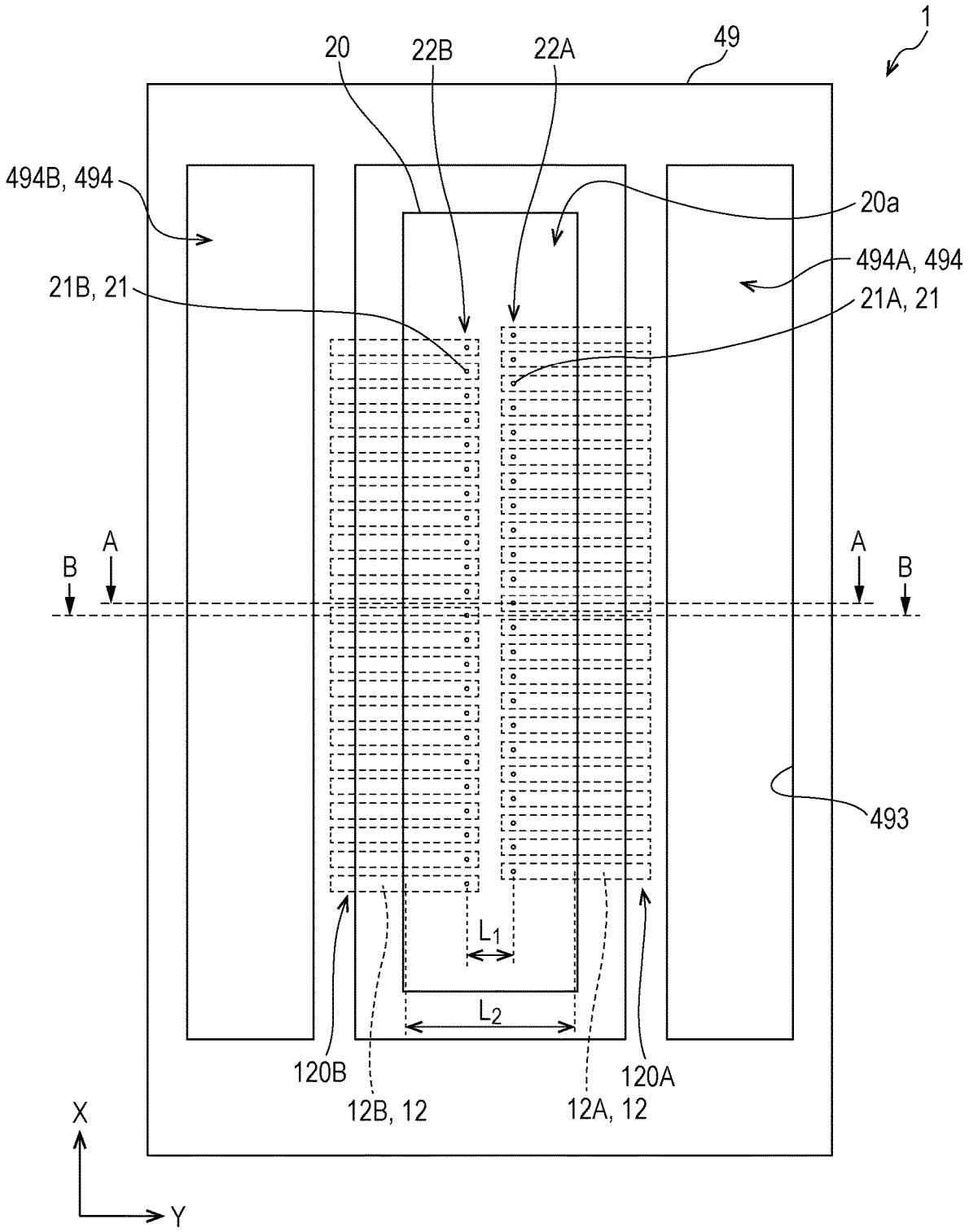
FIG. 1 is a plan view illustrating a recording head according to Embodiment 1.

Hereinafter, the present disclosure will be described in detail based on embodiments. However, the following description represents an aspect of the present disclosure, and may be changed arbitrarily within the scope of the present disclosure. Throughout the drawings, a like reference numeral indicates a like member, and a description thereof is omitted as appropriate. In each drawing, X, Y, and Z represent three spatial axes orthogonal to each other. In the present specification, directions along the axes are referred to as an X direction, a Y direction, and a Z direction. A direction in which an arrow is directed in each drawing is set to a positive (+) direction, and an opposite direction of the arrow is set to a negative (−) direction. The Z direction corresponds to a first axis direction, the X direction corresponds to a second axis direction, and the Y direction corresponds to a third axis direction. Viewing in the X direction, the Y direction, or the Z direction indicates a plan view from the X direction, the Y direction, or the Z direction.

Embodiment 1

Figure 2:
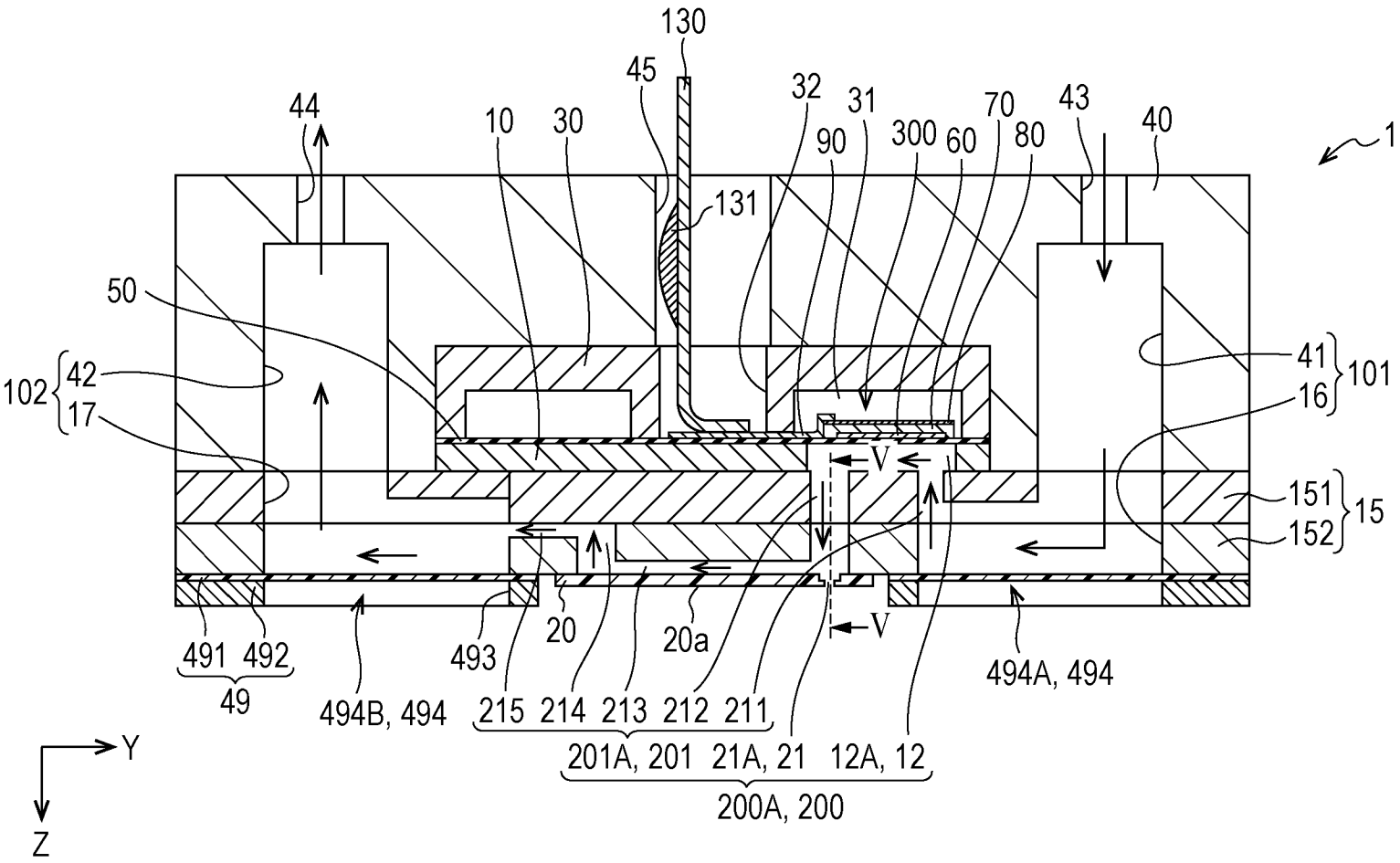
FIG. 2 is a sectional view illustrating the recording head according to Embodiment 1.
Figure 3:
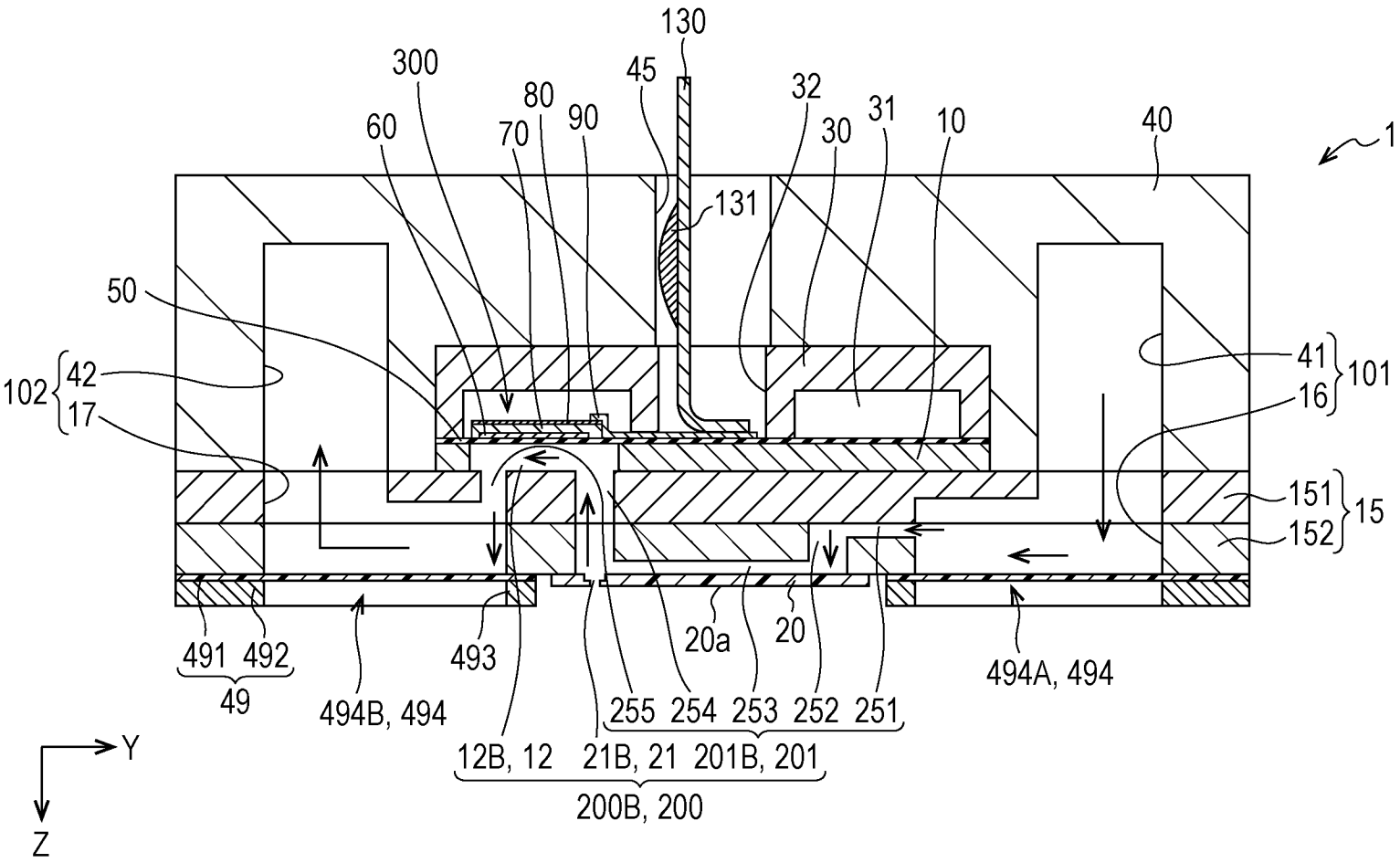
FIG. 3 is a sectional view illustrating the recording head according to Embodiment 1.
Figure 4:
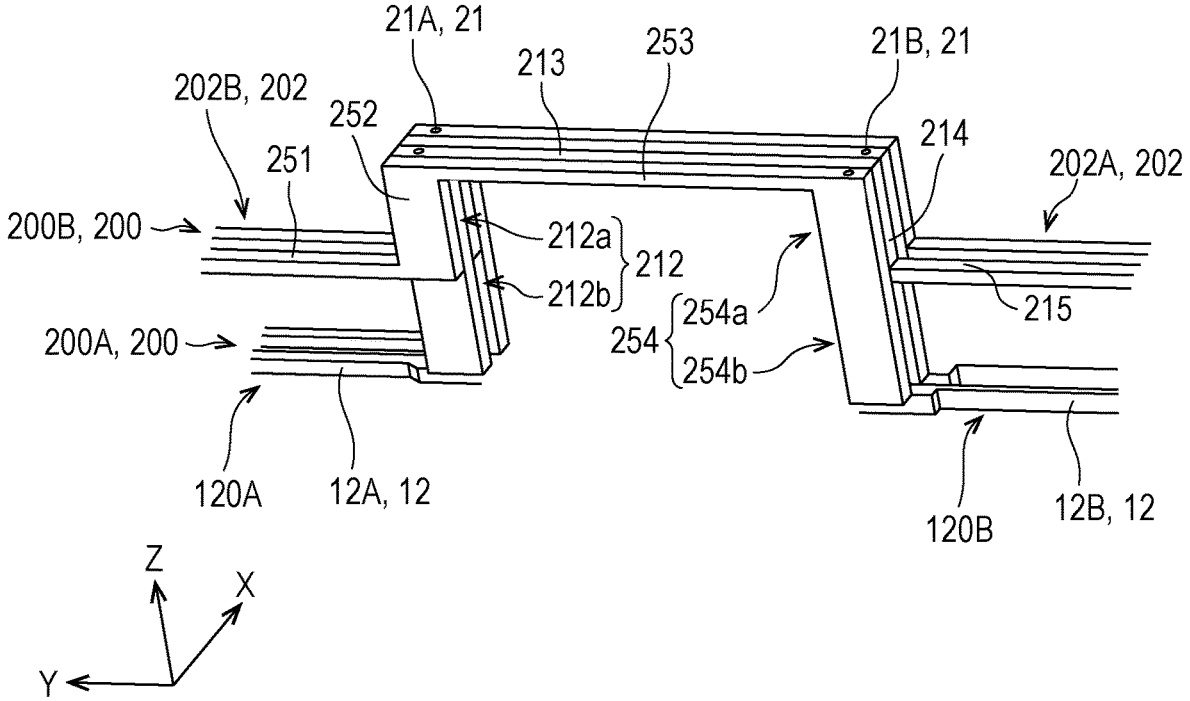
FIG. 4 is a perspective view illustrating main portions of a flow path according to Embodiment 1.
Figure 5:
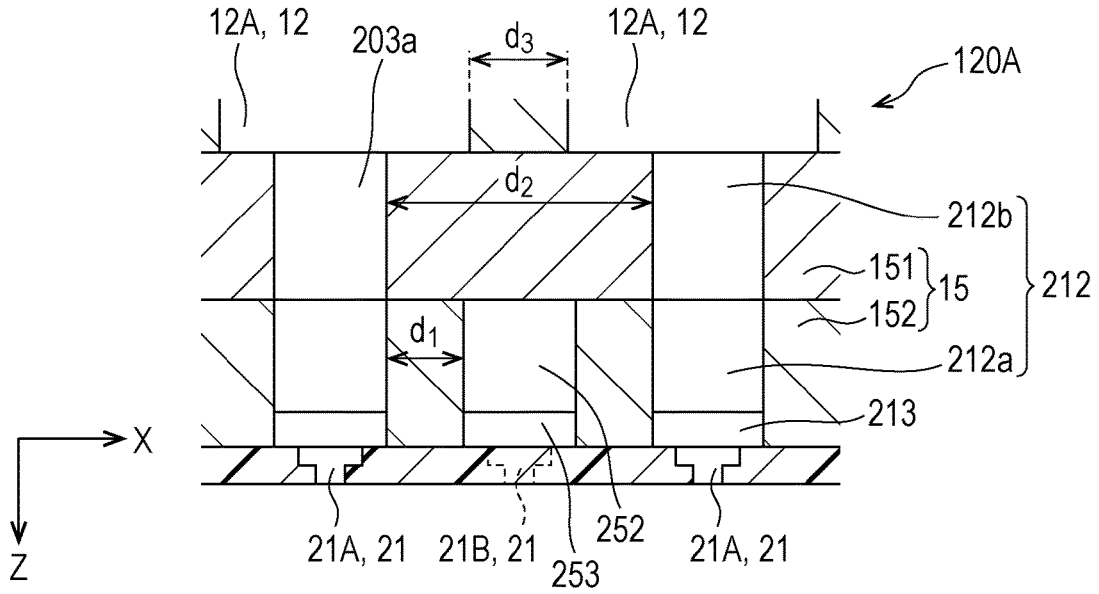
FIG. 5 is a main portion sectional view of the recording head according to Embodiment 1.

With reference to FIGS. 1 to 5, a description will be made of an ink jet recording head that is an example of a liquid ejecting head of the present embodiment. FIG. 1 is a plan view viewed from a nozzle surface side of an ink jet recording head that is an example of a liquid ejecting head according to Embodiment 1 of the present disclosure. FIG. 2 is a sectional view taken along the line A-A in FIG. 1. FIG. 3 is a sectional view taken along the line B-B in FIG. 1. FIG. 4 is a perspective view illustrating a part of a flow path. FIG. 5 is a sectional view taken along the line V-V in FIG. 2.

As illustrated, an ink jet recording head 1 (hereinafter, simply referred to as a recording head 1) that is an example of a liquid ejecting head of the present embodiment includes, as a flow path substrate, a plurality of members such as a flow path formation substrate 10 a communication plate 15, a nozzle plate 20, a protection substrate 30, a case member 40, and a compliance substrate 49.

The flow path formation substrate 10 is formed of a silicon single crystal substrate, and a vibration plate 50 is formed on one surface thereof. The vibration plate 50 may be formed of a single layer or a laminated layer selected from a silicon dioxide layer or a zirconium oxide layer.

A plurality of pressure chambers 12 each forming an individual flow path 200 are partitioned by a plurality of partition walls and formed in the flow path formation substrate 10. Here, the pressure chamber 12 is partitioned as a region in which an energy generation element is provided as will be described later in detail. The plurality of pressure chambers 12 are arranged side by side with a predetermined pitch along the X direction that is the second axis direction. A plurality of rows of the pressure chambers 12 arranged side by side in the X direction are arranged side by side in the Y direction that is the third axis direction, and two rows thereof are provided on the flow path formation substrate 10 in the present embodiment. In the present embodiment, in the two rows of pressure chambers 12, one row of pressure chambers 12 will be referred to as a first pressure chamber row 120A, and the other row of pressure chambers 12 will be referred to as a second pressure chamber row 120B. In other words, the first pressure chamber row 120A is formed of a plurality of pressure chambers 12 arranged side by side in the X direction to be located at an identical position in the Y direction. In the present embodiment, the pressure chambers 12 forming the first pressure chamber row 120A will be referred to as first pressure chambers 12A. In other words, the second pressure chamber row 120B is formed of a plurality of pressure chambers 12 arranged side by side in the X direction to be located at an identical position in the Y direction. In the present embodiment, the pressure chambers 12 forming the second pressure chamber row 120B will be referred to as second pressure chambers 12B. The first pressure chamber row 120A and the second pressure chamber row 120B are disposed to be shifted from each other in the Y direction when viewed in the X direction. In other words, the first pressure chamber row 120A and the second pressure chamber row 120B are disposed at different positions in the Y direction when viewed in the X direction. In the present embodiment, the first pressure chamber row 120A and the second pressure chamber row 120B are disposed at an identical position in the Z direction when viewed in the X direction.

The first pressure chambers 12A of the first pressure chamber row 120A and the second pressure chambers 12B of the second pressure chamber row 120B are disposed at positions deviated in the X direction, that is, disposed in a zigzag form. In the present embodiment, the first pressure chamber row 120A and the second pressure chamber row 120B are disposed at positions deviated from each other in the X direction by a half of a pitch, a so-called half pitch of the pressure chamber 12. Some of the first pressure chambers 12A and some of the second pressure chambers 12B may be disposed at positions overlapping each other when viewed in the X direction. In other words, the first pressure chamber row 120A and the second pressure chamber row 120B being disposed to be shifted relative to each other in the Y direction when viewed in the X direction also indicates that at least some of first pressure chamber row 120A and the second pressure chamber row 120B are disposed at positions not overlapping each other when viewed in the X direction, and also includes that all of the first pressure chambers 12A of the first pressure chamber row 120A and the second pressure chambers 12B of the second pressure chamber row 120B are disposed at positions not overlapping each other, and some of first pressure chambers 12A and the second pressure chambers 12B are disposed at positions not overlapping each other.

In the present embodiment, flow path formation substrate 10 may be provided with only the pressure chambers 12, but may be provided with a flow path resistance applying portion of which a sectional area crossing a flow path is smaller than that of the pressure chamber 12 such that flow path resistance is applied to ink supplied to the pressure chamber 12.

The vibration plate 50 is formed on the surface of the flow path formation substrate 10 in the −Z direction, and a first electrode 60, a piezoelectric layer 70, and a second electrode 80 are formed and laminated in this order according to a lithography method on the −Z direction side of the vibration plate 50, so as to configure a piezoelectric actuator 300. In the present embodiment, the piezoelectric actuator 300 is an energy generation element causing a pressure change in ink in the pressure chamber 12. Here, the piezoelectric actuator 300 is also referred to as a piezoelectric element, and indicates a portion including the first electrode 60, the piezoelectric layer 70, and the second electrode 80. Generally, the piezoelectric actuator 300 is configured by using one electrode as a common electrode, and by patterning the other electrode and the piezoelectric layer 70 for each pressure chamber 12. In the present embodiment, the first electrode 60 is used as a common electrode of the piezoelectric actuator 300, and the second electrode 80 is used as an individual electrode of the piezoelectric actuator 300, but there is no problem even though the electrodes are reversely used. In the above example, the vibration plate 50 and the first electrode 60 act as a vibration plate, but there is no limitation thereto, and, for example, only the first electrode 60 may be caused to act without providing the vibration plate 50. The piezoelectric actuator 300 may also be substantially used as a vibration plate. In the present embodiment, two rows of the piezoelectric actuators 300 arranged side by side in the X direction are provided in the Y direction to correspond to the first pressure chamber row 120A and the second pressure chamber row 120B.

A lead electrode 90 is coupled to the second electrode 80 of each piezoelectric actuator 300, and a voltage is selectively applied to each piezoelectric actuator 300 via the lead electrode 90.

The protection substrate 30 is joined to the surface of the flow path formation substrate 10 in the −Z direction. A piezoelectric actuator holding portion 31 having a space to the extent of not hindering movement of the piezoelectric actuator 300 is provided in a region of the protection substrate 30 facing the piezoelectric actuator 300. The piezoelectric actuator holding portion 31 may have a space to the extent of not hindering movement of the piezoelectric actuator 300, and thus the space may or not be sealed. The piezoelectric actuator holding portion 31 is separately provided for each row of the piezoelectric actuators 300 arranged side by side in the X direction. In other words, each piezoelectric actuator holding portion 31 is formed in a size to integrally cover the row of the plurality of piezoelectric actuators 300 arranged side by side in the X direction. Of course, the piezoelectric actuator holding portion 31 is not particularly limited thereto, and may separately cover the piezoelectric actuator 300, and may cover each group formed of two or more piezoelectric actuators 300 arranged side by side in the X direction. In other words, the piezoelectric actuator holding portion 31 may be provided to be divided in the X direction.

The protection substrate 30 is preferably made of a material having the substantially same thermal expansion coefficient as that of the flow path formation substrate 10, for example, glass or a ceramic material, and is formed by using a silicon single crystal substrate that is the same material as that of the flow path formation substrate 10 in the present embodiment.

A through-hole 32 penetrating through the protection substrate 30 in the Z direction is provided in the protection substrate 30. An end part of the lead electrode 90 extracted from each piezoelectric actuator 300 extends to be exposed to the inside of the through-hole 32, and is electrically coupled to a flexible cable 130 inside the through-hole 32. The flexible cable 130 is a flexible wiring board, and is mounted with a drive circuit 131 that is a semiconductor element in the present embodiment. The lead electrode 90 and the drive circuit 131 may be directly electrically coupled to each other without using the flexible cable 130. A flow path may be provided in the protection substrate 30.

A case member 40 is fixed to the surface of the protection substrate 30 in the −Z direction. The case member 40 is joined to a surface side of the protection substrate 30 opposite to the flow path formation substrate 10, and is also provided to be joined to the communication plate 15 which will be described later.

The case member 40 is provided with a first liquid chamber portion 41 forming a part of a first common liquid chamber 101 and a second liquid chamber portion 42 forming a part of a second common liquid chamber 102. The first liquid chamber portion 41 and the second liquid chamber portion 42 are respectively provided on both sides with two rows of the pressure chambers 12 interposed therebetween in the Y direction.

Each of the first liquid chamber portion 41 and the second liquid chamber portion 42 has a recess shape open to a surface of the case member 40 in the Z direction, and is continuously provided over the plurality of pressure chambers 12 arranged side by side in the X direction.

An inlet 43 communicating with the first liquid chamber portion 41 and an outlet 44 communicating with the second liquid chamber portion 42 are provided to be open on the surface of the case member 40 in the Z direction.

A coupling hole 45 that communicates with the through-hole 32 of the protection substrate 30 and into which the flexible cable 130 is inserted is provided in the case member 40.

On the other hand, the communication plate 15 is provided on the surface of the flow path formation substrate 10 in the Z direction, and the nozzle plate 20 and the compliance substrate 49 are provided on a surface of the communication plate 15 in the Z direction.

The communication plate 15 is formed by laminating a first communication plate 151 and a second communication plate 152 in the Z direction in the present embodiment. The first communication plate 151 and the second communication plate 152 are laminated in this order in the Z direction from the flow path formation substrate 10 toward the nozzle plate 20.

The first communication plate 151 and the second communication plate 152 may be made of metal such as stainless steel, glass, or a ceramic material. The communication plate 15 is formed by using a material having the substantially same thermal expansion coefficient as that of the flow path formation substrate 10, and is formed by using a silicon single crystal substrate that is the same material as that of the flow path formation substrate 10 in the present embodiment.

As will be described later in detail, the communication plate 15 is provided with a first communication portion 16 forming a part of the first common liquid chamber 101 and a second communication portion 17 forming a part of the second common liquid chamber 102.

The first communication portion 16 is provided at a position overlapping the first liquid chamber portion 41 of the case member 40 when viewed in the Z direction, and is provided to be open to both surfaces of the surface in the +Z direction and the surface in the −Z direction of the communication plate 15. The first communication portion 16 communicates with the first liquid chamber portion 41, and thus forms the first common liquid chamber 101. In other words, the first common liquid chamber 101 is formed of the first liquid chamber portion 41 of the case member 40 and the first communication portion 16 of the communication plate 15. The first communication portion 16 extends, in the −Y direction, to a position overlapping the pressure chamber 12 in the Z direction. The first communication portion 16 may not be provided in the communication plate 15, and the first common liquid chamber 101 may be provided along only the first liquid chamber portion 41 of the case member 40.

The second communication portion 17 is provided at a position overlapping the second liquid chamber portion 42 of the case member 40 when viewed in the Z direction, and is provided to be open to both surfaces of the communication plate 15 in the Z direction and the −Z direction. The second communication portion 17 communicates with the second liquid chamber portion 42, and thus forms the second common liquid chamber 102. In other words, the second common liquid chamber 102 is formed of the second liquid chamber portion 42 of the case member 40 and the second communication portion 17 of the communication plate 15. The second communication portion 17 extends, in the +Y direction, to a position overlapping the pressure chamber 12 in the +Z direction. The second communication portion 17 may not be provided in the communication plate 15, and the second common liquid chamber 102 may be provided along only the second liquid chamber portion 42 of the case member 40.

The compliance substrate 49 having a compliance portion 494 is provided on the surface of the communication plate 15 in the Z direction to which the first communication portion 16 and the second communication portion 17 are open. The compliance substrate 49 seals openings of the first common liquid chamber 101 and the second common liquid chamber 102 in the +Z direction, that is, openings on a nozzle surface 20*a* side.

The compliance substrate 49 includes, in the present embodiment, a sealing film 491 formed of a flexible thin film, and a fixed substrate 492 made of a hard material such as metal. Regions of the fixed substrate 492 facing the first common liquid chamber 101 and the second common liquid chamber 102 are opening portions 493 that is completely removed in a thickness direction, and thus parts of wall surfaces of the first common liquid chamber 101 and the second common liquid chamber 102 are the compliance portions 494 that are flexible portions sealed with only the flexible sealing films 491. In the present embodiment, the compliance portion 494 provided at the first common liquid chamber 101 will be referred to as a first compliance portion 494A, and the compliance portion 494 provided at the second common liquid chamber 102 will be referred to as a second compliance portion 494B. As mentioned above, the compliance portions 494 are provided on a part of the wall surface of each of the first common liquid chamber 101 and the second common liquid chamber 102, and thus a pressure change of ink in the first common liquid chamber 101 and the second common liquid chamber 102 can be absorbed due to deformation of the compliance portions 494.

In a case where only the first compliance portion 494A is provided without providing the second compliance portion 494B, there is concern that a pressure change when an ink droplet is discharged in an individual flow path provided with the pressure chamber 12 and a nozzle 21 may be transferred to another individual flow path via the second common liquid chamber 102, and thus a discharge characteristic of an ink droplet discharged from another individual flow path may not be stable, and variations may occur in discharge characteristics of ink droplets discharged from a plurality of nozzles 21. Similarly, when only the second compliance portion 494B is provided without providing the first compliance portion 494A, there is concern that a pressure change in an individual flow path may be transmitted via the first common liquid chamber 101, and thus variations may occur in discharge characteristics of ink droplets. In the present embodiment, since the compliance portions 494 are provided at both of the first common liquid chamber 101 and the second common liquid chamber 102, a pressure change in the individual flow path 200 is hardly transferred to another individual flow path 200 via the first common liquid chamber 101 and the second common liquid chamber 102, and it is possible to suppress the occurrence of variations in discharge characteristics of ink droplets.

In a case where only the first compliance portion 494A is provided without providing the second compliance portion 494B, when ink droplets are discharged from a small number of nozzles 21, the supply of ink to the pressure chambers 12 is sufficiently performed due to deformation of the first compliance portion 494A, but, when ink droplets are simultaneously discharged from a large number of nozzles 21, there is concern that the supply of ink to the pressure chambers 12 may not be sufficiently performed due to only deformation of the first compliance portion 494A, and variations may occur in discharge characteristics of ink droplets, for example, weights of the ink droplets depending on the number of nozzles 21 that simultaneously discharge the ink droplets. In the present embodiment, since both of the first compliance portion 494A and the second compliance portion 494B are provided, it is possible to prevent the occurrence of supply shortage of ink to the pressure chambers 12 depending on the number of nozzles 21 simultaneously discharging ink droplets and thus to suppress the occurrence of variations in discharge characteristics of the ink droplets.

As mentioned above, when the compliance portions 494 are provided at both of the first common liquid chamber 101 and the second common liquid chamber 102, in the present embodiment, the first common liquid chamber 101 and the second common liquid chamber 102 are provided to be open on the surfaces in the +Z direction to which the nozzles 21 are open, and thus the nozzle plate 20 and the compliance portions 494 can be disposed in the same +Z direction with respect to the individual flow path 200. As mentioned above, the compliance portion 494 is disposed in the same direction as that of the nozzle 21 with respect to the individual flow path 200, and thus the compliance portion 494 can be provided in regions where the nozzle 21 is not provided such that the compliance portion 494 can be provided in a relatively large area. Since the compliance portion 494 and the nozzle 21 are disposed in the same direction with respect to the individual flow path 200, the compliance portion 494 can be disposed at a position close to the individual flow path 200, and thus a pressure change of ink in the individual flow path 200 can be effectively absorbed by the compliance portion 494.

A position of the compliance portion 494 is not particularly limited thereto, and the compliance portion 494 may be disposed in an opposite direction to the nozzle 21 in the Z direction with respect to the individual flow path 200. In other words, the compliance portion 494 may be provided on the case member 40 in the −Z direction or may be provided on side surfaces of the case member 40 and the communication plate 15 orthogonal to the Z direction. However, as described above, when the compliance portion 494 is disposed in the same Z direction as the nozzle 21, the compliance portion 494 can be disposed at a position close to the individual flow path 200, and thus a pressure change of ink in the individual flow path 200 can be effectively absorbed by the compliance portion 494, and the compliance portion 494 can also be formed in a relatively large area.

as illustrated in FIG. 1, the two compliance portions 494 of the present embodiment is provided on the single compliance substrate 49. Of course, the compliance substrate 49 is not limited thereto, and each compliance portion 494 may be provided on a separate compliance substrate 49.

The nozzle plate 20 is provided with a plurality of nozzles 21 discharging ink droplets in the +Z direction. In the present embodiment, as illustrated in FIG. 1, two rows of the nozzles 21 arranged side by side in the X direction are arranged side by side in the Y direction. In the present embodiment, one row of the nozzles 21 will be referred to as a first nozzle row 22A, and the other row of the nozzles 21 will be referred to as a second nozzle row 22B. The nozzles 21 forming the first nozzle row 22A will be referred to as first nozzles 21A, and the nozzles 21 forming the second nozzle row 22B will be referred to as second nozzles 21B.

The first nozzles 21A of the first nozzle row 22A and the second nozzles 21B of the second nozzle row 22B are disposed at positions deviated in the X direction, that is, disposed in a zigzag form. In the present embodiment, the first nozzle row 22A and the second nozzle row 22B are disposed at positions deviated from each other in the X direction by a half of a pitch, a so-called half pitch of the nozzle 21. The same type of ink is discharged from the first nozzles 21A and the second nozzles 21B. The first nozzles 21A of the first nozzle row 22A and the second nozzles 21B of the second nozzle row 22B may be disposed at the same positions in the Y direction, and may be disposed linearly along the X direction.

As illustrated in FIGS. 2 to 4, the individual flow path 200 provided for each nozzle 21 is provided in the flow path formation substrate 10, the communication plate 15, the nozzle plate 20, and the compliance substrate 49 forming a flow path substrate. The individual flow path 200 is provided to couple the first common liquid chamber 101 to the second common liquid chamber 102 and to communicate with the nozzle 21 between the first common liquid chamber 101 and the second common liquid chamber 102. Here, the plurality of individual flow paths 200 are provided to communicate with only the first common liquid chamber 101 and the second common liquid chamber 102. The plurality of individual flow paths 200 do not communicate with each other except for the first common liquid chamber 101 and the second common liquid chamber 102. In other words, in the present embodiment, a flow path having a single pressure chamber 12 provided for a single nozzle 21 is referred to as the individual flow path 200. In the present embodiment, the individual flow paths 200 communicating with the first nozzles 21A and having the first pressure chambers 12A will be referred to as first individual flow paths 200A, and the individual flow paths 200 communicating with the second nozzles 21B and having the second pressure chambers 12B will be referred to as second individual flow paths 200B. The first individual flow paths 200A and the second individual flow paths 200B are alternately disposed in the X direction.

The individual flow path 200 includes the pressure chamber 12, the nozzle 21, and an individual communication flow path 201. The individual communication flow path 201 couples the pressure chamber 12 to the first common liquid chamber 101 and the second common liquid chamber 102. In the present embodiment, the individual communication flow path 201 provided in the first individual flow path 200A will be referred to as a first individual communication flow path 201A, and the individual communication flow path 201 provided in the second individual flow path 200B will be referred to as a second individual communication flow path 201B. In other words, the first individual flow path 200A includes the first nozzle 21A, the first pressure chamber 12A, and the first individual communication flow path 201A. The second individual flow path 200B includes the second nozzle 21B, the second pressure chamber 12B, and the second individual communication flow path 201B.

Here, as illustrated in FIGS. 2 and 4, the first individual communication flow path 201A includes a first-1 flow path 211, a first-2 flow path 212, a first-3 flow path 213, a first-4 flow path 214, and a first-5 flow path 215.

The first-1 flow path 211 of the first individual communication flow path 201A is provided upstream of the first pressure chambers 12A, that is, between the first pressure chamber 12A and the first common liquid chamber 101, and couples the first pressure chamber 12A to the first common liquid chamber 101.

The first-2 flow path 212, the first-3 flow path 213, the first-4 flow path 214, and the first-5 flow path 215 of the first individual communication flow path 201A are provided downstream side of the first pressure chamber 12A, that is, between the first pressure chamber 12A and the second common liquid chamber 102, and couples the first pressure chamber 12A to the second common liquid chamber 102.

The terms "upstream and downstream" mentioned here indicate upstream and downstream with the first pressure chamber 12A as a reference when a circulation flow that is a flow of ink in the first individual flow paths 200A is caused from the first common liquid chamber 101 to the second common liquid chamber 102.

Specifically, the first-1 flow path 211 is provided to penetrate through the first communication plate 151 in the Z direction, so as to communicate with the end part of the first pressure chamber 12A in the +Y direction and also to communicate with the end part of the first communication portion 16 in the −Y direction.

The first-1 flow paths 211 serve as second portions arranged side by side in the X direction without the second individual communication flow path 201B, interposed therebetween, corresponding to the second pressure chamber row 120B which will be described later in detail. The second portions arranged side by side in the X direction without the second individual communication flow path 201B interposed therebetween are portions not overlapping the second individual communication flow paths 201B when viewed in the X direction.

Since the first-1 flow path 211 is used as the second portion, a partition wall partitioning the first individual communication flow paths 201A from each other in the X direction can be prevented from being thinned, and thus the rigidity of the partition wall can be suppressed from deteriorating. Since the first-1 flow path 211 is used as the second portion, the first-1 flow path 211 can be widely provided in the X direction, and thus it is possible to reduce flow path resistance and inertance.

As described above, the first pressure chamber 12A is provided in the flow path formation substrate 10, the opening of the first pressure chamber 12A in the −Z direction is sealed with the vibration plate 50, and a part of the opening of the first pressure chamber 12A in the +Z direction is covered with the communication plate 15. The first pressure chambers 12A are formed at a first pitch in the direction in which the flow paths are arranged side by side, that is, in the X direction. The first pressure chamber 12A and the second pressure chambers 12B are disposed to be shifted to different positions in the Y direction, and thus the first pitch is a pitch of each of the first pressure chamber 12A and the second pressure chambers 12B.

The first-2 flow path 212 makes the first pressure chamber 12A communicate with the first nozzle 21A, and is provided to penetrate through the communication plate 15 in the Z direction such that one end thereof communicates with the end part of the first pressure chamber 12A in the −Y direction and the other end thereof communicates with the end part of the first nozzle 21A in the −Z direction.

Flow path portions 212*a* on the end part sides of the first-2 flow paths 212 in the +Z direction serve as first portions arranged side by side in the X direction with the second individual communication flow path 201B, interposed therebetween, corresponding to the second pressure chamber row 120B which will be described later in detail. Flow path portions 212*b* on the end part sides of the first-2 flow paths 212 in the −Z direction serve as second portions arranged side by side in the X direction without the second individual communication flow path 201B, interposed therebetween, corresponding to the second pressure chamber row 120B.

The first portions arranged side by side in the X direction with the second individual communication flow path 201B interposed therebetween are portions overlapping the second individual communication flow paths 201B when viewed in the X direction.

The first-2 flow path 212 that is a local flow path extending in the Z direction is a portion that hardly intersects the second individual flow paths 200B when viewed in the Z direction. In other words, the local flow path is a flow path that hardly avoids the interference with the second individual flow paths 200B by deviating a position thereof in the thickness direction of the flow path substrate, that is, in the Z direction, and thus generally tends to be routed near the second individual flow paths 200B. However, even for the first-2 flow path 212, the second portion is provided, and thus a partition wall partitioning the first-2 flow paths 212 from each other in the X direction can be prevented from being thinned such that the rigidity of the partition wall can be suppressed from deteriorating.

Since the first-2 flow path 212 that is a local flow path coupling the first pressure chamber 12A to the first nozzle 21A has the second portion, it is possible to improve discharge characteristics of an ink droplet discharged from the first nozzles 21A by increasing a width of the first-2 flow path 212 in the X direction and improving the rigidity of the partition wall. In other words, the first-2 flow path 212 that is a local flow path coupling the first pressure chamber 12A to the first nozzle 21A is a flow path that greatly influences discharge characteristics of ink droplets. Since the second portion is provided in the first-2 flow path 212, a width of the first-2 flow path 212 in the X direction is increased such that discharge characteristics of ink are improved, and thus it is possible to reduce flow path resistance or inertance, also to suppress the wall from being deformed by improving the rigidity of the wall, and further to suppress the weight of an ink droplet from being reduced by preventing a pressure loss due to deformation of the wall.

The first nozzle 21A is provided to communicate with the end part of the first-2 flow path 212 in the Z direction, and also to communicate with the outside as a result of being open to the nozzle surface 20*a* that is the surface of the nozzle plate 20 in the +Z direction.

The first-3 flow path 213 is provided along the Y direction such that one end thereof communicates with the other end of the first-2 flow path 212 coupled to the first nozzle 21A, that is, the end part of the first-2 flow path 212 in the Z direction between the second communication plate 152 and the nozzle plate 20. The first-3 flow path 213 of the present embodiment is formed by providing a recess in the second communication plate 152 and covering an opening of the recess with the nozzle plate 20 like a lid. The first-3 flow path 213 is not particularly limited thereto, and may be formed by providing a recess in the nozzle plate 20 and covering the recess with the second communication plate 152 like a lid, and may be formed by providing recesses in both of the second communication plate 152 and the nozzle plate 20.

The first-3 flow paths 213 serve as first portions arranged side by side in the X direction with the second individual communication flow path 201B, interposed therebetween, corresponding to the second pressure chamber row 120B. As mentioned above, since, in the first individual communication flow path 201A, the first-3 flow path 213 that is a local flow path extending in the Y direction from the coupling portion with the first nozzle 21A is used as the first portion, the first-3 flow path 213 that is a local flow path disposed along the nozzle plate 20 may not be disposed to be separated in the Y direction from a second-3 flow path 253 that is a local flow path of second individual communication flow path 201B corresponding to the second pressure chamber row 120B which will be described later in detail. Therefore, the first nozzle 21A and the second nozzle 21B disposed around the local flow paths can be provided to be close to each other, and thus the nozzles 21 can be disposed at high density in the Y direction.

The first-4 flow path 214 is provided to penetrate through the second communication plate 152 in the Z direction such that one end thereof in the +Z direction communicates with the first-3 flow path 213.

The first-4 flow paths 214 are first portions arranged side by side in the X direction with the second individual communication flow path 201B, interposed therebetween, corresponding to the second pressure chamber row 120B.

The first-5 flow path 215 is provided along the Y direction such that one end thereof communicates with the end part of the first-4 flow path 214 in the −Z direction and the other end thereof communicates with the end part of the second common liquid chamber 102 in the +Y direction between the first communication plate 151 and the second communication plate 152. The first-5 flow path 215 of the present embodiment is formed by providing a recess in the second communication plate 152 and covering an opening of the recess with the first communication plate 151 like a lid. Of course, the first-5 flow path 215 may be formed by providing a recess in the first communication plate 151 and covering the recess with the second communication plate 152 like a lid, and may be formed by providing recesses in both of the first communication plate 151 and the second communication plate 152.

The first-4 flow path 214 and the first-5 flow path 215 are portions overlapping a region between the second pressure chambers 12B adjacent to each other in the X direction in the second pressure chamber row 120B when viewed in the Z direction, the portions not overlapping the second pressure chamber row 120B when viewed in the X direction. In other words, the first-4 flow path 214 and the first-5 flow path 215, and the second pressure chamber 12B are disposed at different positions in the Z direction, not to overlap each other when viewed in the X direction.

The first-4 flow path 214 and the first-5 flow path 215 overlapping the region between the second pressure chambers 12B when viewed in the X direction also includes that, when the first-4 flow path 214 and the first-5 flow path 215 are disposed at positions overlapping a partition wall that is the region between the second pressure chambers 12B adjacent to each other in the X direction, parts thereof overlap the second pressure chamber 12B when viewed in the Z direction. In the present embodiment, the first-4 flow path 214 and the first-5 flow path 215 are disposed at only positions overlapping the region between the second pressure chambers 12B when viewed in the Z direction.

As mentioned above, the first-4 flow path 214 and the first-5 flow path 215, and the second pressure chamber 12B are disposed at different positions in the Z direction, not to overlap each other when viewed in the X direction, and thus it is possible to suppress the partition wall partitioning the second pressure chambers 12B from each other from being thinned even though the first-4 flow path 214 and the first-5 flow path 215, and the second pressure chamber 12B are disposed to be close to each other in the X direction when viewed in the Z direction. Therefore, it is possible to increase an excluded volume by widely forming the second pressure chamber 12B in the X direction. It is possible to prevent a pressure of ink in the second pressure chamber 12B from being absorbed due to deformation of the partition wall by suppressing the rigidity of the partition wall of the second pressure chamber 12B from deteriorating, and thus to prevent the occurrence of variations in discharge characteristics. Even though parts of the first-4 flow path 214 and the first-5 flow path 215 are disposed to overlap the second pressure chamber 12B when viewed in the Z direction, the first-4 flow path 214 and the first-5 flow path 215 are disposed at the positions not overlapping the second pressure chamber 12B when viewed in the X direction, and thus the second pressure chamber 12B does not communicate with the first-4 flow path 214 and the first-5 flow path 215.

The first-5 flow paths 215 serve as second portions arranged side by side in the X direction without the second individual communication flow path 201B, interposed therebetween, corresponding to the second pressure chamber row 120B. Thus, partition walls of the first-5 flow paths 215 arranged side by side in the X direction are not thinned by the second pressure chambers 12B and the second individual communication flow paths 201B, and partition walls of the second individual communication flow paths 201B arranged side by side in the X direction are not thinned by the first-5 flow paths 215. Therefore, the first-5 flow path 215 can be widely formed in the X direction such that flow path resistance and inertance can be reduced. Thus, it is possible to improve discharge characteristics of ink droplets, that is, to increase the weight of an ink droplet, and also to improve the rigidity of the partition wall. In addition, it is possible to prevent the occurrence of variations in discharge characteristics of ink droplets.

Since the first-5 flow path 215 serves as the second portion, even though the first-5 flow path 215 has a larger width in the X direction than that of the first portion, a thickness of the wall between the first-5 flow path 215 and the second individual communication flow path 201B is hardly small. Therefore, the first-5 flow path 215 that is the second portion can be provided to have a larger width in the X direction than that of each of the first-2 flow path 212, the first-3 flow path 213, and the first-4 flow path 214 that are the first portions. Consequently, a sectional area of the first-5 flow path 215 can be increased, and thus it is possible to reduce flow path resistance and inertance of the first-5 flow path 215.

The first individual flow path 200A includes the first-1 flow path 211, the first pressure chamber 12A, the first-2 flow path 212, the first-3 flow path 213, the first-4 flow path 214, and the first-5 flow path 215 in this order from the first common liquid chamber 101 toward the second common liquid chamber 102. The first individual flow path 200A communicates with the first nozzle 21A at the end part of the first-2 flow path 212 in the Z direction. In other words, in the present embodiment, as illustrated in FIG. 2, in the first individual flow path 200A, the pressure chamber 12 and the first nozzle 21A are disposed in this order from the upstream to the downstream with respect to a flow of ink from the first common liquid chamber 101 toward the second common liquid chamber 102. In other words, in the first individual flow path 200A, the first pressure chamber 12A is provided between the first nozzle 21A and the first common liquid chamber 101.

In the first individual flow path 200A, ink flows from the first common liquid chamber 101 to the second common liquid chamber 102 via the first individual flow path 200A. The piezoelectric actuator 300 is driven to cause a pressure change of the ink in the first pressure chamber 12A and to increase a pressure of the ink in the first nozzle 21A, and thus ink droplets are discharged to the outside from the first nozzle 21A. The piezoelectric actuator 300 may be driven when ink flows from the first common liquid chamber 101 to the second common liquid chamber 102 via the first individual flow path 200A, and the piezoelectric actuator 300 may be driven when ink does not flow from the first common liquid chamber 101 to the second common liquid chamber 102 via the first individual flow path 200A. Ink may temporarily flow from the second common liquid chamber 102 to the first common liquid chamber 101 due to a pressure change caused by driving the piezoelectric actuator 300.

In the present embodiment, in the first individual flow path 200A, the upstream side of the first nozzle 21A in the circulation flow directed from the first common liquid chamber 101 toward the second common liquid chamber 102, that is, the first-1 flow path 211, the first pressure chamber 12A, and the first-2 flow path 212 that are flow paths between the first nozzle 21A and the first common liquid chamber 101 will be referred to as a first upstream flow path. In the first individual flow path 200A, the downstream side of the first nozzle 21A in the circulation flow from the first common liquid chamber 101 toward the second common liquid chamber 102, that is, the first-3 flow path 213, the first-4 flow path 214, and the first-5 flow path 215 that are flow paths between the first nozzle 21A and the second common liquid chamber 102 will be referred to as a first downstream flow path.

The second individual communication flow path 201B of the present embodiment forming the second individual flow path 200B includes, as illustrated in FIGS. 3 and 4, a second-1 flow path 251, a second-2 flow path 252, a second-3 flow path 253, a second-4 flow path 254, and a second-5 flow path 255. As will be described below, the second individual flow paths 200B has a shape to invert the first individual flow path 200A with respect to an axis in the Z direction.

The second-1 flow path 251, the second-2 flow path 252, the second-3 flow path 253, and the second-4 flow path 254 are provided on the upstream side of the second pressure chamber 12B, that is, between the second pressure chamber 12B and the first common liquid chamber 101, and couple the second pressure chamber 12B to the first common liquid chamber 101.

The second-5 flow path 255 is provided on the downstream side of the second pressure chamber 12B, that is, between the second pressure chamber 12B and the second common liquid chamber 102, and couple the second pressure chamber 12B to the second common liquid chamber 102.

The terms "upstream and downstream" mentioned here indicate upstream and downstream with the second pressure chamber 12B as a reference when a circulation flow that is a flow of ink in the second individual flow path 200B is caused from the first common liquid chamber 101 to the second common liquid chamber 102.

The second-1 flow path 251 is provided along the Y direction in an in-surface direction of the nozzle surface 20*a* between the first communication plate 151 and the second communication plate 152 such that one end thereof communicates with the end part of the first common liquid chamber 101 in the −Y direction. The second-1 flow path 251 of the present embodiment is formed by providing a recess in the second communication plate 152 and covering an opening of the recess with the first communication plate 151 like a lid. Of course, the second-1 flow path 251 may be formed by providing a recess in the first communication plate 151 and covering the recess with the second communication plate 152 like a lid, and may be formed by providing recesses in both of the first communication plate 151 and the second communication plate 152.

The second-2 flow path 252 is provided to penetrate through the second communication plate 152 in the Z direction such that the end part thereof in the −Z direction communicates with the second-1 flow path 251.

The second-1 flow path 251 and the second-2 flow path 252 are portions overlapping a region between the adjacent first pressure chambers 12A of the first pressure chamber row 120A when viewed in the Z direction, the portions not overlapping the first pressure chamber row 120A when viewed in the X direction. In other words, the second-1 flow path 251 and the second-2 flow path 252, and the first pressure chamber 12A are disposed at different positions in the Z direction, not to overlap each other when viewed in the X direction. The second-1 flow path 251 and the second-2 flow path 252 overlapping the region between the first pressure chambers 12A when viewed in the X direction also includes that, when the second-1 flow path 251 and the second-2 flow path 252 are disposed at positions overlapping a partition wall that is the region between the first pressure chambers 12A adjacent to each other in the X direction, parts thereof overlap the first pressure chamber 12A when viewed in the Z direction. In the present embodiment, the second-1 flow path 251 and the second-2 flow path 252 are disposed at only positions overlapping the partition wall between the first pressure chambers 12A when viewed in the Z direction.

The second-2 flow paths 252 serve as first portions arranged side by side in the X direction with the first individual communication flow path 201A, interposed therebetween, corresponding to the first pressure chamber row 120A. In the present embodiment, the second-2 flow paths 252 are arranged side by side in the X direction with the first-2 flow path 212 of the first individual communication flow path 201A interposed therebetween. The first portions arranged side by side in the X direction with the first individual communication flow path 201A interposed therebetween are portions overlapping the first individual communication flow paths 201A when viewed in the X direction.

The second-3 flow path 253 is provided along the Y direction such that one end thereof communicates with the end part of the second-2 flow path 252 in the +Z direction between the second communication plate 152 and the nozzle plate 20. The second-3 flow path 253 of the present embodiment is formed by providing a recess in the second communication plate 152 and covering an opening of the recess with the nozzle plate 20 like a lid. The second-3 flow path 253 is not particularly limited thereto, and may be formed by providing a recess in the nozzle plate 20 and covering the recess with the second communication plate 152 like a lid, and may be formed by providing recesses in both of the second communication plate 152 and the nozzle plate 20.

The second-3 flow paths 253 serve as first portions arranged side by side in the X direction with the first individual communication flow path 201A, interposed therebetween, corresponding to the first pressure chamber row 120A. In other words, the second-3 flow path 253 is a portion overlapping the first-3 flow path 213 of the first individual communication flow path 201A when viewed in the X direction. That is, the second-3 flow path 253 and the first-3 flow path 213 are alternately disposed in the X direction.

A pitch with which the second-3 flow path 253 and the first-3 flow path 213 are alternately disposed in the X direction will be referred to as a second pitch. The second pitch is smaller than the first pitch of each of the first pressure chamber 12A and the second pressure chamber 12B. For example, when the first pressure chamber 12A is formed at the first pitch of 300 dpi, and the second pressure chamber 12B is formed at the first pitch of 300 dpi, the second-3 flow path 253 and the first-3 flow path 213 are formed at the second pitch corresponding to a half of the first pitch, that is, the second pitch of 600 dpi. Therefore, the first pitch of each of the first pressure chamber 12A and the second pressure chamber 12B is made larger than the second pitch of the second-3 flow path 253 and the first-3 flow path 213 such that opening widths of the first pressure chamber 12A and the second pressure chamber 12B in the X direction can be increased, and thus it is possible to increase an excluded volume of the pressure chamber 12. Consequently, it is possible to increase the rigidities of the partition wall between the first pressure chambers 12A and the partition wall between the second pressure chambers 12B, and thus to prevent variations in discharge characteristics of ink droplets from occurring as a result of the partition wall being deformed to absorb pressure due to a pressure change of ink in the pressure chamber 12.

The second-4 flow path 254 makes the second pressure chamber 12B communicate with the second nozzle 21B, and is provided to penetrate through the communication plate 15 in the Z direction such that one end thereof communicates with the end part of the second pressure chamber 12B in the +Y direction and the other end thereof communicates with the end part of the second nozzle 21B in the −Z direction.

Flow path portions 254*a* on the end part sides of the second-4 flow paths 254 in the +Z direction serve as first portions arranged side by side in the X direction with the first individual communication flow path 201A, interposed therebetween, corresponding to the first pressure chamber row 120A. Flow path portions 254*b* on the end part sides of the second-4 flow paths 254 in the −Z direction serve as second portions arranged side by side in the X direction without the first individual communication flow path 201A interposed therebetween.

The second nozzle 21B is provided to communicate with the end part of the second-4 flow path 254 in the Z direction, and also to communicate with the outside as a result of being open to the nozzle surface 20*a* that is the surface of the nozzle plate 20 in the Z direction.

In other words, the first nozzle 21A and the second nozzle 21B are disposed to be shifted to different positions in the Y direction when viewed in the X direction.

In the present embodiment, since the first-3 flow path 213 that is a local flow path extending in the Y direction from the coupling portion with the first nozzle 21A and the second-3 flow path 253 that is a local flow path extending in the Y direction from the coupling portion with the second nozzle 21B are disposed at positions overlapping each other when viewed in the X direction, the first nozzle 21A and the second nozzle 21B may not be disposed to be separated from each other in the Y direction. Consequently, both of the nozzles can be disposed to be close to each other in the Y direction, and thus the nozzles 21 can be disposed at high density in the Y direction.

As described above, the second pressure chamber 12B is provided in the flow path formation substrate 10, the opening of the second pressure chamber 12B in the −Z direction is sealed with the vibration plate 50, and a part of the opening of the second pressure chamber 12B in the Z direction is covered with the communication plate 15. The second pressure chamber 12B is disposed to be shifted in the Y direction to a position that is different from that of the first pressure chamber 12A of the first individual flow path 200A, and thus the first pressure chamber 12A and the second pressure chamber 12B are provided at positions not overlapping each other when viewed in the X direction. The second pressure chambers 12B are formed at the first pitch in the X direction in the same manner as the first pressure chambers 12A.

As described above, the first-4 flow path 214 and the first-5 flow path 215 of the first individual communication flow path 201A are portions overlapping the region between the second pressure chambers 12B adjacent to each other in the X direction in the second pressure chamber row 120B when viewed in the Z direction, the portions not overlapping the second pressure chamber row 120B when viewed in the X direction. Therefore, it is possible to increase an excluded volume by widely forming the second pressure chamber 12B in the X direction, and also to efficiently dispose the first individual communication flow path 201A between the second pressure chambers 12B without interfering with the second pressure chamber 12B. Therefore, it is possible to efficiently dispose the individual flow path 200 by suppressing an increase in size of a flow path substrate such as the flow path formation substrate 10 and the communication plate 15.

The second-5 flow path 255 makes the second pressure chamber 12B communicate with the second common liquid chamber 102, and is provided to penetrate through the first communication plate 151 in the Z direction such that one end thereof communicates with the end part of the second pressure chamber 12B in the −Y direction and the other end communicates with the end part of the second common liquid chamber 102 in the Y direction.

The second-5 flow paths 255 serve as second portions arranged side by side in the X direction without the first individual communication flow path 201A, interposed therebetween, corresponding to the first pressure chamber row 120A.

As mentioned above, the second individual flow path 200B includes the second-1 flow path 251, the second-2 flow path 252, the second-3 flow path 253, the second-4 flow path 254, and the second pressure chamber 12B, and the second-5 flow path 255 in this order from the first common liquid chamber 101 toward the second common liquid chamber 102. The second individual flow path 200B communicates with the second nozzle 21B at the end part of the second-4 flow path 254 in the Z direction. In other words, in the present embodiment, as illustrated in FIG. 3, in the second individual flow path 200B, the second nozzle 21B and the second pressure chamber 12B are disposed in this order from the upstream to the downstream with respect to a flow of ink from the first common liquid chamber 101 toward the second common liquid chamber 102. In other words, in the second individual flow path 200B, the second pressure chamber 12B is provided between the second nozzle 21B and the second common liquid chamber 102.

The first individual flow path 200A and the second individual flow path 200B are disposed such that an order of the pressure chamber 12 and the nozzle 21 is changed with respect to a flow of ink from the first common liquid chamber 101 to the second common liquid chamber 102. In the present embodiment, since the single pressure chamber 12 and the single nozzle 21 are provided in each individual flow path 200, the first individual flow path 200A and the second individual flow path 200B are disposed such that an order of the pressure chamber 12 and the nozzle 21 is reverse.

In the second individual flow path 200B, ink flows from the first common liquid chamber 101 to the second common liquid chamber 102 via the second individual flow path 200B. The piezoelectric actuator 300 is driven to cause a pressure change of the ink in the second pressure chamber 12B and to increase a pressure of the ink in the second nozzle 21B, and thus ink droplets are discharged to the outside from the second nozzle 21B. The piezoelectric actuator 300 may be driven when ink flows from the first common liquid chamber 101 to the second common liquid chamber 102 via the second individual flow path 200B, and the piezoelectric actuator 300 may be driven when ink does not flow from the first common liquid chamber 101 to the second common liquid chamber 102 via the second individual flow path 200B. Ink may temporarily flow from the second common liquid chamber 102 to the first common liquid chamber 101 due to a pressure change caused by driving the piezoelectric actuator 300. Discharge of an ink droplet from the second nozzle 21B is determined by a pressure of ink in the second nozzle 21B. The pressure of the ink in the second nozzle 21B is determined by a pressure of ink flowing from the first common liquid chamber 101 to the second common liquid chamber 102, that is, a so-called circulation pressure and a pressure from the second pressure chamber 12B toward the second nozzle 21B due to driving of the piezoelectric actuator 300.

For example, with respect to a flow of ink directed from the first common liquid chamber 101 toward the second common liquid chamber 102, the ink may reversely flow from the second pressure chamber 12B toward the second nozzle 21B due to a pressure change of the ink in the second pressure chamber 12B, and thus an ink droplet may be discharged from the second nozzle 21B. As mentioned above, when the ink may reversely flow from the second pressure chamber 12B toward the second nozzle 21B, a circulation pressure directed from the first common liquid chamber 101 toward the second common liquid chamber 102 is reduced. Thus, it is possible to reduce a pressure loss in the individual flow path 200 by relatively reducing the circulation pressure. Since the pressure loss in the individual flow path 200 is reduced, and thus a difference in a pressure loss between the individual flow paths 200 can be reduced, it is possible to reduce variations in discharge characteristics of ink droplets discharged from the respective nozzles 21.

For example, with respect to a flow of ink directed from the first common liquid chamber 101 toward the second common liquid chamber 102, an ink droplet may be discharged from the second nozzle 21B without the ink reversely flowing from the second pressure chamber 12B toward the second nozzle 21B due to a pressure change of the ink in the second pressure chamber 12B. In this case, since a flow of ink directed from the second pressure chamber 12B toward the second nozzle 21B does not occur, an air bubble hardly reversely flows from the second pressure chamber 12B toward the second nozzle 21B, and defective discharge of an ink droplet from the second nozzle 21B due to the air bubble hardly occurs.

In the present embodiment, in the second individual flow path 200B, the upstream side of the second nozzle 21B in the circulation flow directed from the first common liquid chamber 101 toward the second common liquid chamber 102, that is, the second-1 flow path 251, the second-2 flow path 252, and the second-3 flow path 253 that are flow paths between the second nozzle 21B and the first common liquid chamber 101 will be referred to as a second upstream flow path. In the second individual flow path 200B, the downstream side of the second nozzle 21B in the circulation flow from the first common liquid chamber 101 toward the second common liquid chamber 102, that is, second-4 flow path 254, the second pressure chamber 12B, and the second-5 flow path 255 that are flow paths between the second nozzle 21B and the second common liquid chamber 102 will be referred to as a second downstream flow path.

The first individual flow path 200A and the second individual flow path 200B are alternately disposed in the X direction as illustrated in FIG. 4. In other words, in the recording head 1 of the present embodiment, an ink droplet can be discharged from the nozzle 21 due to a pressure change in the pressure chamber 12 regardless of positions of the pressure chamber 12 and the nozzle 21 with respect to a flow of ink from the first common liquid chamber 101 toward the second common liquid chamber 102. In other words, even though the first pressure chamber 12A is disposed upstream and the first nozzle 21A is disposed downstream as in the first individual flow path 200A illustrated in FIG. 2, and the second nozzle 21B is disposed upstream and the second pressure chamber 12B is disposed downstream as in the second individual flow path 200B illustrated in FIG. 3, an ink droplet can be selectively discharged from both of the first nozzle 21A and the second nozzle 21B due to a pressure change of ink in the pressure chamber 12. Thus, as described above, the first individual flow path 200A and the second individual flow path 200B in which an order of the pressure chamber 12 and the nozzle 21 is changed are alternately disposed in the X direction with respect to a flow of ink directed from the first common liquid chamber 101 toward the second common liquid chamber 102, and thus a position of the pressure chamber 12 can be changed in the first individual flow path 200A and the second individual flow path 200B, that is, the first pressure chamber 12A and the second pressure chamber 12B can be disposed to be shifted to different positions in the Y direction when viewed in the X direction. Therefore, since the pressure chamber 12 of each individual flow path 200 is widely formed in the X direction such that an excluded volume is increased, or the rigidity of the partition wall between the pressure chambers 12 hardly deteriorates, the pressure chambers 12 can be disposed at high density in the X direction. In other words, since the first pressure chamber 12A and the second pressure chamber 12B are disposed to be shifted to different positions in the Y direction, a partition wall partitioning the first pressure chambers 12A from each other in the X direction can be thickened, and a partition wall partitioning the second pressure chambers 12B from each other in the X direction can be thickened, without interference between the first pressure chamber 12A and the second pressure chamber 12B.

For example, when the first pressure chamber 12A and the second pressure chamber 12B are disposed at positions overlapping each other when viewed in the X direction, the pressure chamber 12 cannot be widely provided in the X direction, and thus an excluded volume is reduced, so that the weight of an ink droplet that is one of discharge characteristics of ink droplets. The rigidity of the partition wall partitioning the pressure chambers 12 from each other in the X direction deteriorates, and thus crosstalk occurs due to deformation of the partition wall.

In the present embodiment, the first individual communication flow path 201A that is the individual communication flow path 201 corresponding to the first pressure chamber row 120A has a portion overlapping the region between the second pressure chambers 12B adjacent to each other in the second pressure chamber row 120B when viewed in the Z direction that is the first axis direction, the portion not overlapping the second pressure chamber row 120B when viewed in the X direction.

In the present embodiment, as described above, the first-4 flow path 214 and the first-5 flow path 215 of the first individual communication flow path 201A are disposed to overlap the partition wall between the second pressure chambers 12B adjacent to each other in the X direction when viewed in the Z direction, and are provided at positions not overlapping the second pressure chamber row 120B when viewed in the X direction. The first individual communication flow path 201A having the portion overlapping the region between the second pressure chambers 12B when viewed in the Z direction indicates that at least a part of the first individual communication flow path 201A may overlap the region between the second pressure chambers 12B, and also includes another part of the first individual communication flow path 201A overlaps the second pressure chamber 12B when viewed in the Z direction.

Even though the first pressure chamber 12A and the second pressure chamber 12B are disposed to be shifted relative to each other in the Y direction when viewed in the X direction, for example, when the first individual communication flow path 201A is disposed between the second pressure chambers 12B adjacent to each other in the X direction, a thickness of the partition wall partitioning the second pressure chambers 12B from each other in the X direction is reduced. Consequently, the second pressure chamber 12B cannot be widely provided in the X direction, and thus an excluded volume is reduced, and crosstalk occurs due to deterioration in the rigidity of the partition wall. A flow path substrate becomes large-sized in the X direction in order to improve the rigidity of the partition wall. In other words, in order to obtain a high characteristic head by securing a space of the second pressure chamber row 120B or the partition wall thereof, it can be said that the first individual communication flow path 201A is preferably routed by using a space advantageous in avoiding interference with the second pressure chamber row 120B or the partition wall thereof, that is, a low interference space. Such a relationship is applied between the first pressure chamber row 120A and the second individual communication flow path 201B.

In the present embodiment, a region that overlaps a region between the adjacent second pressure chambers 12B in the second pressure chamber row 120B when viewed in the Z direction and does not overlap the second pressure chamber row 120B when viewed in the X direction is used as the low interference region, and the first-4 flow path 214 and the first-5 flow path 215 are disposed therein. The low interference space is a space advantageous in avoiding interference with the second pressure chamber row 120B in both of the X direction and the Z direction. Consequently, even though the second pressure chamber 12B is widely formed in the X direction, it is possible to suppress the rigidity of the partition wall from deteriorating, to increase an excluded volume, and to increase discharge characteristics of ink droplets, that is, the weight of an ink droplet. Since the rigidity of the partition wall partitioning the second pressure chambers 12B from each other in the X direction can be improved, it is possible to suppress the partition wall from being deformed due to a pressure change of ink in the second pressure chamber 12B, and thus to prevent the occurrence of variations in discharge characteristics of ink droplets due to deterioration in the rigidity of the partition wall, that is, the occurrence of so-called crosstalk.

Consequently, it is not necessary to perform complex handling such that the first individual flow path 200A intersects the second individual flow path 200B when viewed in the Z direction, a structure of the individual flow path 200 can be simplified, and the individual flow path 200 can be suppressed from being uselessly lengthened such that flow path resistance can be prevented from being increased. Thus, it is possible to suppress deterioration in discharge characteristics of ink droplets or air bubble discharging property.

In the present embodiment, the second individual communication flow path 201B that is the individual communication flow path corresponding to the second pressure chamber row 120B has a portion overlapping the region between the first pressure chambers 12A adjacent to each other in the first pressure chamber row 120A when viewed in the Z direction, the portion not overlapping the first pressure chamber row 120A when viewed in the X direction.

In the present embodiment, as described above, the second-1 flow path 251 and the second-2 flow path 252 forming the second individual communication flow path 201B has a portion overlapping the region between the first pressure chambers 12A adjacent to each other in the X direction when viewed in the Z direction, the portion not overlapping the first pressure chamber row 120A when viewed in the X direction. The second individual communication flow path 201B having the portion overlapping a partition wall in the region between the first pressure chambers 12A when viewed in the Z direction indicates that at least a part of the second individual communication flow path 201B may overlap the region between the first pressure chambers 12A, and also includes another part of the second individual communication flow path 201B overlaps the first pressure chamber 12A when viewed in the Z direction. In the present embodiment, the second individual communication flow path 201B is disposed at a position not overlapping the first pressure chamber 12A when viewed in the Z direction.

In the present embodiment, the first individual communication flow paths 201A that are the individual communication flow paths corresponding to the first pressure chamber row 120A has the first portions arranged side by side in the X direction that is the second axis direction with the second individual communication flow path 201B, interposed therebetween, corresponding to the second pressure chamber row 120B and the second portions arranged side by side in the X direction without the second individual communication flow path 201B, interposed therebetween, corresponding to the second pressure chamber row 120B.

As described above, the flow path portions 212*a* of the first individual communication flow path 201A on the end part sides of the first-2 flow paths 212 in the +Z direction are arranged side by side in the X direction with the second-2 flow path 252 of the second individual communication flow path 201B interposed therebetween. The first-3 flow paths 213 of the first individual communication flow path 201A arranged side by side in the X direction with the second-3 flow path 253 of the second individual communication flow path 201B interposed therebetween. The first-4 flow paths 214 of the first individual communication flow path 201A are arranged side by side in the X direction with the second-4 flow path 254 of the second individual communication flow path 201B interposed therebetween. In other words, in the present embodiment, the flow path portion 212*a* on the end part side of the first-2 flow path 212 in the Z direction, the first-3 flow path 213, and the first-4 flow path 214 of the first individual communication flow path 201A correspond to the first portions.

The first-1 flow paths 211 of the first individual communication flow path 201A are arranged side by side in the X direction without the second individual communication flow path 201B interposed therebetween. The flow path portions 212*b* of the first individual communication flow path 201A on the end part side of the first-2 flow path 212 in the −Z direction are arranged side by side in the X direction without the second individual communication flow path 201B interposed therebetween. The first-5 flow paths 215 of the first individual communication flow path 201A arranged side by side in the X direction without the second individual communication flow path 201B interposed therebetween. In other words, in the present embodiment, the first-1 flow path 211, the flow path portion 212*b* on the end part side of the first-2 flow path 212 in the −Z direction, and the first-5 flow path 215 of the first individual communication flow path 201A correspond to the second portions.

As mentioned above, since the flow path portions 212*a* on the end part sides of the first-2 flow paths 212 in the Z direction, the first-3 flow paths 213, and the first-4 flow paths 214 that are the first portions arranged side by side in the X direction with the second individual communication flow path 201B are provided in the first individual communication flow path 201A, the first individual communication flow path 201A and the second individual flow path 200B having the second pressure chamber row 120B can be disposed to intersect each other when viewed in the X direction. Therefore, the first individual communication flow path 201A can be efficiently disposed in a space between the second individual flow paths 200B arranged side by side in the X direction.

Since the first-1 flow paths 211, the flow path portions 212*b* on the end part sides of the first-2 flow paths 212 in the −Z direction, and the first-5 flow paths 215 that are the second portions arranged side by side in the X direction without the second individual communication flow path 201B interposed therebetween are provided in the first individual communication flow path 201A, the second portions can be widely provided in the X direction or walls of the second portions arranged side by side in the X direction can be thickened. Therefore, it is possible to perform flow path design contributing to characteristic improvement such as an increase of an ink weight that is a discharge characteristic of an ink droplet or suppression of variations in discharge characteristics of ink droplets.

Similarly, the second individual communication flow path 201B has first portions arranged side by side in the X direction with the first individual communication flow path 201A interposed therebetween and second portions arranged side by side in the X direction without the first individual communication flow path 201A interposed therebetween.

In the present embodiment, in the first individual communication flow path 201A, a local flow path extending in the Z direction has the first portion and the second portion. In other words, as described above, in the first individual communication flow path 201A, the first-2 flow path 212 extending in the Z direction has both of the first portion and the second portion, and, thus, in the present embodiment, the first-2 flow path 212 corresponds to such a local flow path.

As mentioned above, the first-2 flow path 212 that is a local flow path extending in the Z direction is a structural portion hardly intersecting the second individual flow path 200B when viewed in the Z direction. However, the flow path portion 212*b* on the end part side in the −Z direction, which is the second portion, is provided such that the first-2 flow path 212 does not completely overlap the second individual communication flow path 201B when viewed in the X direction, and thus it is possible to suppress the rigidity of the partition wall partitioning the first-2 flow paths 212 that are local flow paths from each other in the X direction from deteriorating as a whole.

In the present embodiment, in same manner for the second individual communication flow path 201B, a local flow path extending in the Z direction has the first portion and the second portion. In other words, in the second individual communication flow path 201B, the second-4 flow path 254 extending in the Z direction has the flow path portion 254*a* on the end part side in the +Z direction that is the first portion and the flow path portion 254*b* on the end part side in the −Z direction that is the second portion.

In the present embodiment, in the first individual communication flow path 201A, a local flow path coupling the first pressure chamber 12A to the first nozzle 21A has at least the second portion. In other words, in the present embodiment, the first-2 flow path 212 couples the first pressure chamber 12A to the first nozzle 21A, and has the flow path portion 212*b* on the end part side in the −Z direction as the second portion that is not provided between the second individual communication flow paths 201B, and thus the first-2 flow path 212 corresponds to a local flow path.

As mentioned above, since the flow path portion 212*b* on the end part side in the −Z direction as the second portion is provided in the first-2 flow path 212 that is a local flow path coupling the first pressure chamber 12A to the first nozzle 21A, it is possible to improve a discharge characteristic of an ink droplet discharged from the first nozzle 21A by increasing, in the X direction, a width of the flow path portion 212*b* on the flow path portion 212*b* on the end part side of the first-2 flow path 212 in the Z direction or improving the rigidity of a partition wall partitioning the first-2 flow paths 212 from each other in the X direction. In other words, the first-2 flow path 212 that is a local path coupling the first pressure chamber 12A to the first nozzle 21A is a flow path that greatly influences a discharge characteristic of an ink droplet, and the flow path portion 212*b* on the end part side in the −Z direction as the second portion is provided in the first-2 flow path 212. Therefore, flow path resistance or inertance can be reduced by increasing, in the X direction, a width of the flow path portion 212*b* on the end part side of the first-2 flow path 212 in the −Z direction, or the occurrence of crosstalk can be suppressed without increasing a size of a flow path substrate by improving the rigidity of a partition wall partitioning the first-2 flow paths 212 from each other in the X direction.

The first-2 flow path 212 that is a local flow path coupling the first pressure chamber 12A to the first nozzle 21A may have at least the second portion, and may have only the second portion.

In the present embodiment, in the same manner for the second individual communication flow path 201B, a local flow path coupling the second pressure chamber 12B to the second nozzle 21B has at least the second portion. In other words, in the second individual communication flow path 201B, the second-4 flow path 254 has the flow path portion 254*b* on the end part side in the −Z direction as the second portion.

In the present embodiment, in the first individual communication flow path 201A, a local flow path extending in the Y direction from the coupling portion with the first nozzle 21A has at least the first portion. In other words, in the present embodiment, the first-3 flow path 213 extending in the Y direction from the first-2 flow path 212 that is a coupling portion with the first nozzle 21A is the first portion interposed between the second individual communication flow paths 201B.

As mentioned above, the first-3 flow path 213 extending in the Y direction from the coupling portion with the first nozzle 21A has the first portion, and thus the first-3 flow path 213 and the second-3 flow path 253 that is a local flow path of the second individual communication flow path 201B corresponding to the second pressure chamber row 120B may not be disposed to be separated from each other in the Y direction. Therefore, the first nozzle 21A and the second nozzle 21B disposed around the first-3 flow path 213 and the second-3 flow path 253 that are local flow paths can be provided to be close to each other, and thus the nozzles 21 can be disposed at high density in the Y direction.

The first-2 flow path 212 may have at least the first portion, may have only the first portion as in the present embodiment, and may have both of the first portion and the second portion.

Similarly, in the present embodiment, in the second individual communication flow path 201B, a local flow path extending in the Y direction from the coupling portion with the second nozzle 21B has at least the first portion. In other words, in the present embodiment, the second-3 flow path 253 extending in the Y direction from the second-4 flow path 254 that is a coupling portion with the second nozzle 21B is the first portion interposed between the first individual communication flow paths 201A.

In the present embodiment, a volume of the second portion of the first individual communication flow path 201A is larger than a volume of the first portion. Similarly, in the present embodiment, a volume of the second portion of the second individual communication flow path 201B is larger than a volume of the first portion.

In the present embodiment, the maximum thickness of a partition wall partitioning the adjacent first individual communication flow paths 201A of the second portions from each other is larger than the maximum thickness of a partition wall partitioning the first individual communication flow path 201A of the first portion from the second individual communication flow path 201B that is an individual communication flow path corresponding to the second pressure chamber row 120B. For example, as illustrated in FIG. 5, a thickness $d_2$ of a partition wall partitioning the adjacent first individual communication flow paths 201A of the second portions from each other, that is, a partition wall partitioning the flow path portions 212*b* of the first-2 flow paths 212 from each other is larger than a thickness $d_1$ of a partition wall between the flow path portion 212*a* that is the first portion provided on the end part side of the first-2 flow path 212 in the +Z direction of the first individual communication flow path 201A and the second-2 flow path 252 of the second individual communication flow path 201B.

The maximum thickness of a partition wall is a thickness of the thickest partition wall when a width of the individual communication flow path 201 changes on the way, and is not limited to the above-described position.

In the present embodiment, although not particularly illustrated, the maximum thickness of a partition wall partitioning the adjacent first individual communication flow paths 201A of the second portions from each other is larger than the maximum thickness of a partition wall partitioning the second individual communication flow path 201B of the first portion from the first individual communication flow path 201A that is an individual communication flow path corresponding to the first pressure chamber row 120A.

In the present embodiment, a partition wall partitioning the adjacent first individual communication flow paths 201A of the second portions from each other is thicker than a partition wall partitioning the adjacent first pressure chambers 12A of the first pressure chamber row 120A from each other. In other words, as illustrated in FIG. 5, the thickness $d_2$ of the partition wall partitioning the adjacent first individual communication flow paths 201A of the second portions from each other in the X direction, that is, the partition wall partitioning the flow path portions 212*b* of the first-2 flow paths 212 from each other is larger than a thickness $d_3$ of a partition wall partitioning the first pressure chambers 12A from each other in the X direction.

As mentioned above, the thickness $d_3$ of the partition wall partitioning the first pressure chambers 12A from each other is reduced, and the first pressure chamber 12A is widely provided in the X direction, so that an excluded volume of the first pressure chamber 12A can be increased. A height in the Z direction of the partition wall partitioning the first pressure chambers 12A from each other is smaller than a height in the Z direction of the partition wall partitioning the second portions from each other, and thus the sensitivity of deformation of the first pressure chamber 12A for the thickness of the partition wall is relatively low. In contrast, the partition wall partitioning the second portions from each other is high in the Z direction, and thus the sensitivity of the second portion for the thickness of the partition wall is relatively high. Therefore, the thickness $d_2$ of the partition wall partitioning the second portions from each other is made relatively large, and thus it is possible to improve the rigidity of the partition wall partitioning the second portions from each other and also to suppress the occurrence of crosstalk.

In the present embodiment, although not particularly illustrated, a partition wall partitioning the adjacent first individual communication flow paths 201A of the second portions from each other is thicker than a partition wall partitioning the adjacent second pressure chambers 12B of the second pressure chamber row 120B.

In the present embodiment, the first nozzle 21A is disposed at a position communicating with the end part in the +Z direction of the first-2 flow path 212 provided along the Z direction. Therefore, flow path resistance of the first-2 flow path 212 is reduced by relatively increasing a cross-sectional area of the first-2 flow path 212 from the first pressure chamber 12A to the first nozzle 21A, and thus it is possible to increase the weight of an ink droplet discharged from the first nozzle 21A.

Similarly, in the present embodiment, the second nozzle 21B is disposed at a position communicating with the end part in the +Z direction of the second-4 flow path 254 provided along the Z direction. Therefore, flow path resistance of the second-4 flow path 254 is reduced by relatively increasing a cross-sectional area of the second-4 flow path 254 from the second pressure chamber 12B to the second nozzle 21B, and thus it is possible to increase the weight of an ink droplet discharged from the second nozzle 21B.

In other words, the first nozzles 21A and the second nozzles 21B are arranged side by side along the X direction, to form the first nozzle row 22A and the second nozzle row 22B that are a nozzle row, and the first nozzle row 22A and the second nozzle row 22B are disposed to be shifted in the Y direction when viewed in the X direction.

As illustrated in FIG. 1, a shift distance $L_1$ in the Y direction between the first nozzle row 22A and the second nozzle row 22B is smaller than a shift distance $L_2$ in the Y direction between the first pressure chamber row 120A and the second pressure chamber row 120B. Here, the shift distance $L_1$ between the first nozzle row 22A and the second nozzle row 22B is a distance between the centers of the first nozzle 21A and the second nozzle 21B in the Y direction. Similarly, the shift distance $L_2$ in the Y direction between the first pressure chamber row 120A and the second pressure chamber row 120B is a distance between the centers in the Y direction between the first pressure chamber 12A and the second pressure chamber 12B.

As mentioned above, since the shift distance $L_1$ in the Y direction between the first nozzle 21A and the second nozzle 21B is smaller than the shift distance $L_2$ in the Y direction between the first pressure chamber 12A and the second pressure chamber 12B, a plurality of nozzles 21 can be disposed to be close to each other in the Y direction, the first pressure chamber 12A and the second pressure chamber 12B can be disposed at positions separated from each other in the Y direction, and each of the first pressure chamber row 120A and the second pressure chamber row 120B can be disposed at lower density than the nozzles 21. Therefore, it is possible to increase an excluded volume of each pressure chamber 12 or to dispose the pressure chambers at high density, and thus to miniaturize a flow path substrate.

Of course, the first nozzle 21A may be disposed to communicate with the middle of the first-3 flow path 213, and the second nozzle 21B may be disposed to communicate with the middle of the second-3 flow path 253, but the communication plate 15 is required to be thickened in the Z direction in order to increase a cross-sectional area crossing the first-3 flow path 213 and the second-3 flow path 253, and thus the communication plate 15 becomes large-sized in the Z direction. When the communication plate 15 becomes large-sized in the Z direction, a flow path length of the first-2 flow path 212 or the second-4 flow path 254 provided along the Z direction is also increased, and thus flow path resistance is increased. Consequently, flow path resistances of the first-3 flow path 213 and the second-3 flow path 253 tend to increase compared with a case where the first nozzle 21A and the second nozzle 21B are directly coupled to the first-2 flow path 212 and the second-4 flow path 254. Therefore, there is concern that the weight of an ink droplet discharged from each of the first nozzle 21A and the second nozzle 21B may be relatively reduced. However, when the first nozzle 21A and the second nozzle 21B are respectively provided to communicate with the middle of the first-3 flow path 213 and the middle of the second-3 flow path 253, the first nozzle 21A and the second nozzle 21B can be linearly disposed along the X direction.

As mentioned above, even when the first nozzle 21A and the second nozzle 21B are linearly disposed along the X direction, a shift distance in the Y direction between the first nozzle row 22A and the second nozzle row 22B may be shorter than the shift distance $L_2$ in the Y direction between the first pressure chamber row 120A and the second pressure chamber row 120B.

In the present embodiment, the individual flow path 200 is provided such that flow path resistance from the first common liquid chamber 101 to the nozzle 21 is substantially the same as flow path resistance from the nozzle 21 to the second common liquid chamber 102.

In other words, flow path resistance of the first upstream flow path of the first individual flow path 200A is substantially the same as flow path resistance of the first downstream flow path thereof. In other words, combined flow path resistance of the first-1 flow path 211, the first pressure chamber 12A, and the first-2 flow path 212 corresponding to the first upstream flow path is substantially the same as combined flow path resistance of the first-3 flow path 213, the first-4 flow path 214, and the first-5 flow path 215 corresponding to the first downstream flow path. Here, the flow path resistances of the first upstream flow path and the first downstream flow path are determined depending on sectional areas crossing the flow paths, flow path lengths, and shapes thereof.

Similarly, flow path resistance of the second upstream flow path of the second individual flow path 200B is substantially the same as flow path resistance of the second downstream flow path thereof. In other words, combined flow path resistance of the second-1 flow path 251, the second-2 flow path 252, and the second-3 flow path 253 corresponding to the second upstream flow path is substantially the same as combined flow path resistance of the second-4 flow path 254, the second pressure chamber 12B, and the second-5 flow path 255 corresponding to the second downstream flow path.

In the present embodiment, the first individual flow path 200A and the second individual flow path 200B have shapes reverse to each other with respect to the direction in which ink flows from the first common liquid chamber 101 toward the second common liquid chamber 102. In other words, the first upstream flow path of the first individual flow path 200A and the second downstream flow path of the second individual flow path 200B are provided to have the same shape and to have the substantially same flow path resistance. Similarly, the first downstream flow path of the first individual flow path 200A and the second upstream flow path of the second individual flow path 200B are provided to have the same shape and to have the substantially same flow path resistance.

As mentioned above, since the flow path resistance of the first upstream flow path of the first individual flow path 200A is substantially the same as the flow path resistance of the first downstream flow path thereof, and the flow path resistance of the second upstream flow path of the second individual flow path 200B is substantially the same as the flow path resistance of the second downstream flow path thereof, flow path resistances from the first common liquid chamber 101 to the nozzle 21 can be uniformized to be substantially the same as each other in the first individual flow path 200A and the second individual flow path 200B even though the first individual flow path 200A and the second individual flow path 200B have shapes reverse to each other with respect to the direction in which ink flows from the first common liquid chamber 101 toward the second common liquid chamber 102. Therefore, it is possible to suppress the occurrence of a variation in discharge characteristics of an ink droplet discharged from the first nozzle 21A and an ink droplet discharged from the second nozzle 21B, and also to simplify a flow path structure.

The flow path resistances of the first downstream flow path of the first individual flow path 200A and the second downstream flow path of the second individual flow path 200B are aligned with each other, and thus discharge characteristics of ink droplets discharged from the nozzles 21 can be uniformized. In other words, when ink droplets are simultaneously discharged from a plurality of nozzles 21, ink is supplied to the pressure chambers 12 from both of the first common liquid chamber 101 and the second common liquid chamber 102. Therefore, the flow path resistances of the first downstream flow path and the second downstream flow path are the same as each other, and thus it is possible to suppress the occurrence of variations in discharge characteristics of ink droplets by suppressing the occurrence of variations in amounts of ink to be supplied.

For example, in a case where the flow path resistances of the first upstream flow path and the first downstream flow path of the first individual flow path 200A are different from each other, when the second individual flow path 200B is obtained by reversing the first individual flow path 200A, the first downstream flow path of the first individual flow path 200A becomes the second upstream flow path of the second individual flow path 200B, and thus the flow path resistance of the first upstream flow path from the first common liquid chamber 101 to the nozzle 21 is different from the flow path resistance of the second upstream flow path. Thus, there is the occurrence of a variation in discharge characteristics of ink droplets discharged from the first nozzle 21A of the first individual flow path 200A and the second nozzle 21B of the second individual flow path 200B. In order to make the first upstream flow path and the second upstream flow path have the same flow path resistances, the second upstream flow path is required to be formed with a sectional area, a flow path length, and a shape that are different from those of the first downstream flow path, and this is complicated.

At least the first upstream flow path that is a flow path from the first common liquid chamber 101 of the first individual flow path 200A to the first nozzle 21A thereof is provided to have the same flow path resistance as that of the second upstream flow path that is a flow path from the first common liquid chamber 101 of the second individual flow path 200B to the second nozzle 21B thereof. In other words, when the flow path resistances of the first upstream flow path and the second upstream flow path are substantially the same as each other, the flow path resistances of the first downstream flow path and the second downstream flow path may be different from each other. In other words, since the flow path resistance of the first upstream flow path is substantially the same as the flow path resistance of the second upstream flow path, it is possible to reduce variations in discharge characteristics of ink droplets compared with a case where the flow path resistances of the first upstream flow path and the second upstream flow path are different from each other, and the flow path resistances of the first downstream flow path and the second downstream flow path are different from each other. Of course, as described above, when the flow path resistances of the first upstream flow path and the second upstream flow path are substantially the same as each other, and the flow path resistances of the first downstream flow path and the second downstream flow path are substantially the same as each other, it is possible to further reduce variations in discharge characteristics of ink droplets.

Figure 6:
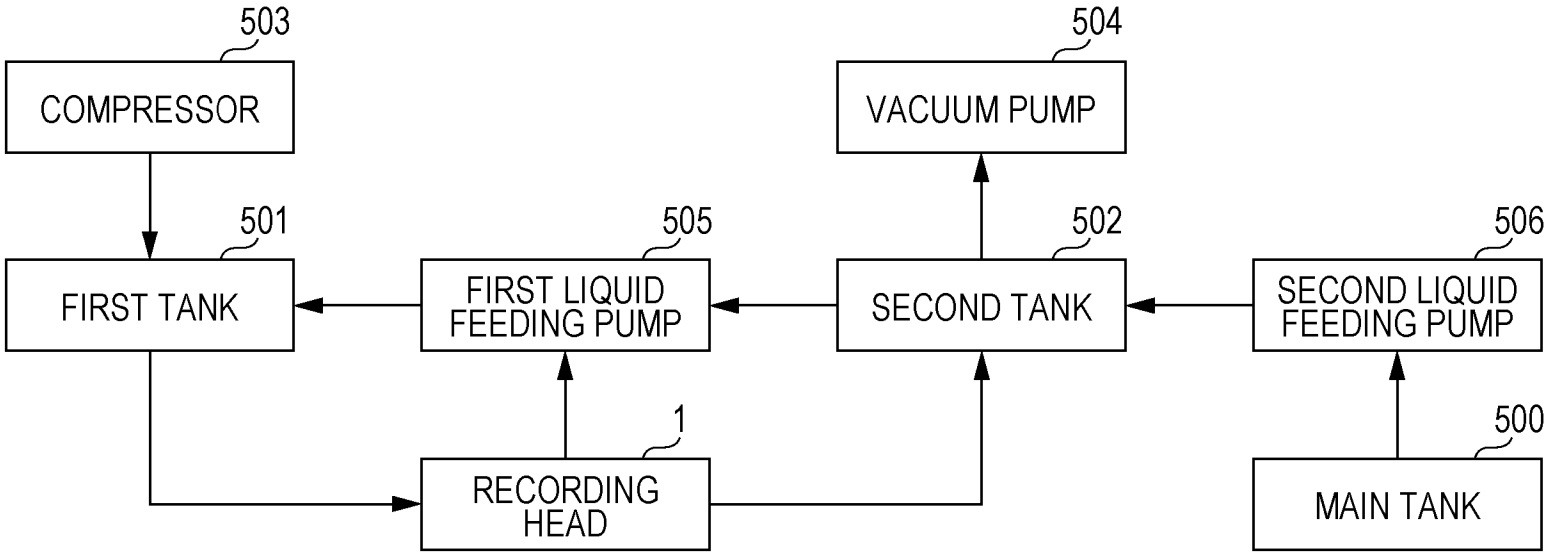
FIG. 6 is a block diagram for describing a recording system according to Embodiment 1.

Here, with reference to FIG. 6, a description will be made of an ink jet recording system that is an example of a liquid circulation system of the present embodiment. FIG. 6 is a block diagram for describing an ink jet recording system that is an example of a liquid ejecting system according to Embodiment 1.

As illustrated in FIG. 6, an ink jet recording system (hereinafter, simply referred to as a recording system) that is a liquid circulation system includes a circulation system that supplies a liquid to one of the first common liquid chamber 101 and the second common liquid chamber 102, and recovers a liquid from the other common liquid chamber so as to cause a circulation flow in the individual flow path 200, and the recording head 1 of each embodiment.

The circulation system of the present embodiment includes a main tank 500, a first tank 501, a second tank 502, a compressor 503, a vacuum pump 504, a first liquid feeding pump 505, and a second liquid feeding pump 506.

The first tank 501 is coupled to the recording head 1 and the compressor 503, and ink in the first tank 501 is supplied to the first common liquid chamber 101 of the recording head 1 under a predetermined positive pressure by the compressor 503.

The second tank 502 is coupled to the first tank 501 via the first liquid feeding pump 505, and ink in the second tank 502 is fed to the first tank 501 by the first liquid feeding pump 505.

The second tank 502 is coupled to the recording head 1 and the vacuum pump 504, and ink in the second common liquid chamber 102 of the recording head 1 is recovered to the second tank 502 under a predetermined positive pressure by the vacuum pump 504.

In other words, ink is supplied to the first common liquid chamber 101 of the recording head 1 from the first tank 501, and ink is recovered to the second tank 502 from the second common liquid chamber 102 of the recording head 1. Consequently, a circulation flow directed from the first common liquid chamber 101 toward the second common liquid chamber 102 is caused in the individual flow path 200 including the individual communication flow path 201 of the recording head 1. The ink is fed to the first tank 501 from the second tank 502 by the first liquid feeding pump 505, and thus the ink is circulated among the first tank 501, the second tank 502, and the recording head 1.

The second tank 502 is coupled to the main tank 500 via the second liquid feeding pump 506, and ink corresponding to an amount of ink consumed by the recording head 1 is replenished to the second tank 502 from the main tank 500. The replenishment of ink to the second tank 502 from the main tank 500 may be performed, for example, at a timing such as a case where a liquid level of ink in the second tank 502 is lower than a predetermined height.

In the present embodiment, ink is supplied to the first common liquid chamber 101, and ink is recovered from the second common liquid chamber 102, but there is no particular limitation thereto. Ink may be supplied to the second common liquid chamber 102, and ink may be recovered from the first common liquid chamber 101. In other words, even when a direction of a circulation flow in the individual flow path 200 changes, since, in the recording head 1, the first individual flow path 200A and the second individual flow path 200B have shapes reverse to each other with respect to the direction in which ink flows from the first common liquid chamber 101 to the second common liquid chamber 102, discharge characteristics of ink droplets discharged from the nozzles 21 do not vary.

In the recording system, since ink is supplied to the first common liquid chamber 101, and ink is recovered from the second common liquid chamber 102, an ink pressure difference is preferably within ±2%, that is, −2% or higher and +2% or lower with the atmospheric pressure in the nozzle 21 as a reference during non-discharge in which an ink droplet is not discharged from the nozzle 21 in a state in which a circulation flow of ink directed from the first common liquid chamber 101 toward the second common liquid chamber 102 is generated in the individual flow path 200. In other words, a pressure difference between a pressure of ink in the first nozzle 21A and a pressure of ink in the second nozzle 21B is preferably within ±2%. Preferably, a pressure difference of ink in a plurality of first nozzles 21A is preferably within ±2%. Preferably, a pressure difference of ink in a plurality of second nozzles 21B is preferably within ±2%. For example, when the atmospheric pressure is 1013 hPa, a pressure in the nozzle 21 is about 1000 hPa. Thus, a pressure difference of ink in the nozzles 21 is a maximum of about 20 hPa.

As mentioned above, when an ink droplet is not discharged from the nozzle 21 in a state in which a circulation flow is generated in the individual flow path 200, a pressure difference of ink in the nozzles 21, for example, a pressure difference of ink in the first nozzle 21A and the second nozzle 21B is relatively small as ±2% or lower, and thus it is possible to suppress the occurrence of a variation in discharge characteristics of an ink droplet discharged from the first nozzle 21A and an ink droplet discharged from the second nozzle 21B. As mentioned above, in order to relatively reduce a difference between a pressure of ink in the first nozzle 21A and a pressure of ink in the second nozzle 21B, the flow path resistance of the first upstream flow path from the first common liquid chamber 101 to the first nozzle 21A and the flow path resistance of the second upstream flow path from the first common liquid chamber 101 to the second nozzle 21B are required to be uniformized and to be substantially the same as each other such that a pressure difference of ink in the nozzles 21 is within ±2%. When the flow path resistance of the first upstream flow path from the first common liquid chamber 101 to the first nozzle 21A and the flow path resistance of the second upstream flow path from the first common liquid chamber 101 to the second nozzle 21B are set such that a pressure difference of ink in the nozzles 21 is within ±2%, this can be easily realized by forming the first individual flow path 200A and the second individual flow path 200B in the same shape and in shapes reverse to each other with respect to the direction in which ink flows.

The flow path resistances of the first upstream flow path and the first downstream flow path, the flow path resistances of the second upstream flow path and the second downstream flow path, and a pressure difference of ink in the nozzles 21 are not limited to the above-described contents. For example, the flow path resistances of the first upstream flow path and the first downstream flow path and/or the flow path resistances of the second upstream flow path and the second downstream flow path may be different from each other, and a pressure difference of ink in the nozzles 21 may be deviated from ±2%, that is, may be lower than −2% or higher than +2%. In this case, different drive pulses may be supplied to the piezoelectric actuators 300 respectively corresponding to the first pressure chamber row 120A and the second pressure chamber row 120B.

Figure 7:
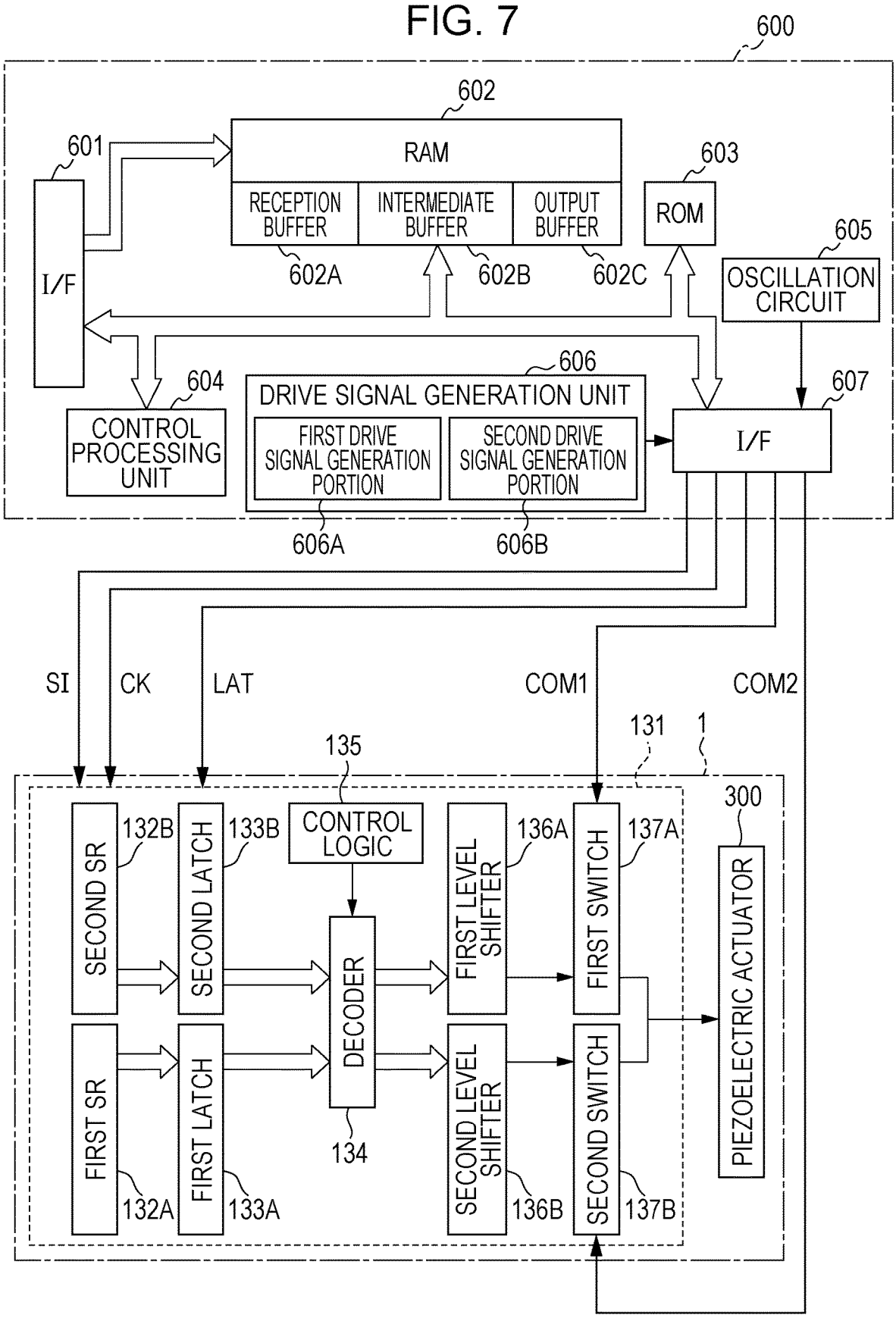
FIG. 7 is a block diagram illustrating an electrical configuration of the recording system according to Embodiment 1.

Here, the recording system of the present embodiment will be described. FIG. 7 is a diagram for describing an electrical configuration of the ink jet recording system that is an example of a liquid ejecting system according to Embodiment 1.

The recording system of the present embodiment includes a piezoelectric actuator 300 that is an energy generation element, and a controller 600 that supplies a drive pulse.

The controller 600 includes an external interface 601 (hereinafter, simply referred to as an external I/F 601), a RAM 602 that temporarily stores various pieces of data, a ROM 603 that stores a control program or the like, a control processing unit 604 that is configured to include a CPU and the like, an oscillation circuit 605 that generates a clock signal (CK), a drive signal generation unit 606 that generates a drive signal to be supplied to the recording head 1, and an internal interface 607 (hereinafter, referred to as an internal I/F 607) that transmits, to the recording head 1, dot pattern data (bitmap data) developed based on a drive signal or printing data.

The drive signal generation unit 606 includes a first drive signal generation portion 606A that is first drive signal generation means for generating a first drive signal COM1, and a second drive signal generation portion 606B that is second drive signal generating means for a second drive signal COM2.

Here, as will be described later in detail, the first drive signal COM1 generated by the first drive signal generation portion 606A is a signal having, within one recording cycle T, a first discharge pulse DP1 for driving the piezoelectric actuator 300 such that an ink droplet is discharged from the nozzle 21, and is repeatedly generated in each recording cycle T.

Here, as will be described later in detail, the second drive signal COM2 generated by the second drive signal generation portion 606B is a signal having, within one recording cycle T, a second discharge pulse DP2 for driving the piezoelectric actuator 300 such that an ink droplet is discharged from the nozzle, and is repeatedly generated in each recording cycle T. The second discharge pulse DP2 is generated at the same timing as the first discharge pulse DP1 within the recording cycle T. The recording cycle T, which is a repetition unit of the drive signal COM, is a type of discharge cycle in the present disclosure, and corresponds to one pixel of an image printed on an ejection medium. Details of the first drive signal COM1 and the second drive signal COM2 will be described later.

On the other hand, the recording head 1 includes a shift register circuit formed of a first shift register 132A and a second shift register 132B, a latch circuit formed of a first latch circuit 133A and a second latch circuit 133B, a decoder 134, a control logic 135, a level shifter circuit formed of a first level shifter 136A and a second level shifter 136B, a switch circuit formed of a first switch 137A and a second switch 137B, and the piezoelectric actuator 300. The shift registers 132A and 132B, the latch circuits 133A and 133B, the level shifters 136A and 136B, the switches 137A and 137B, and the piezoelectric actuator 300 are provided to correspond to each nozzle 21.

The recording head 1 discharges an ink droplet based on recording data (SI) from the controller 600. The recording data is formed of an upper bit group and a lower bit group. The first switch 137A is controlled by the upper bit group, and, thus, when the first drive signal COM1 is applied to the piezoelectric actuator 300, an ink droplet corresponding to a waveform of the first drive signal COM1 is discharged. The second switch 137B is controlled by the lower bit group, and, thus, when the second drive signal COM2 is applied to the piezoelectric actuator 300, an ink droplet corresponding to a waveform of the second drive signal COM2 is discharged.

Figure 8:
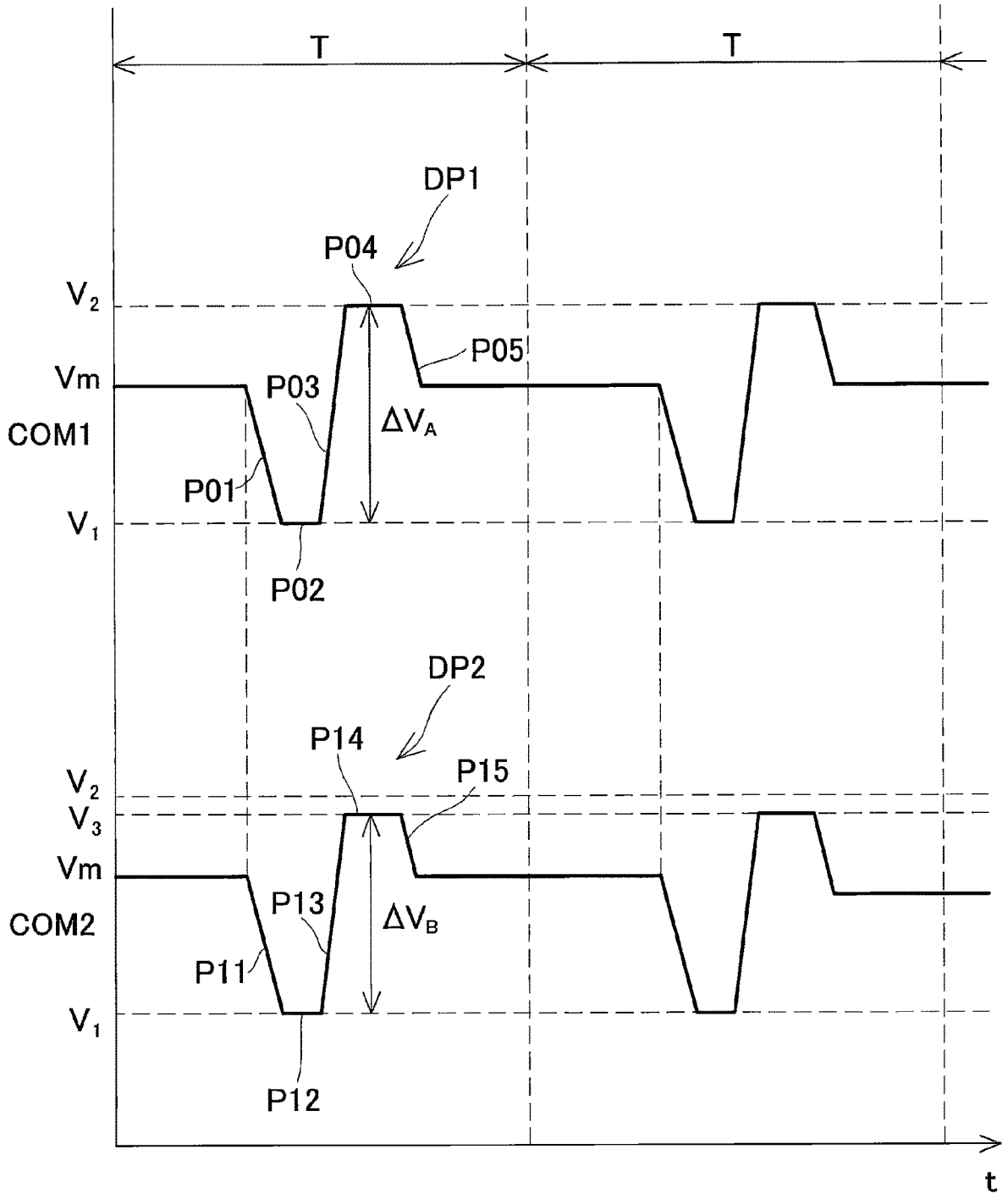
FIG. 8 illustrates a drive waveform indicating a drive signal according to Embodiment 1.

Next, a description will be made of the first drive signal COM1 and the second drive signal COM2 generated by the drive signal generation unit 606, and control of supply of the first drive signal COM1 and the second drive signal COM2 to the piezoelectric actuator 300. FIG. 8 illustrates drive waveforms indicating drive signals.

The drive waveforms indicating drive signals illustrated in FIG. 8 respectively indicate the first drive signal COM1 and the second drive signal COM2.

The first drive signal COM1 is repeatedly generated from the first drive signal generation portion 606A of the drive signal generation unit 606 in each unit cycle T (which is the discharge cycle T and is also referred to as the recording cycle T) defined by a clock signal transmitted from the oscillation circuit 605. The unit cycle T corresponds to one pixel of an image provided on a recording sheet S. In the present embodiment, the first discharge pulse DP1 that is a drive pulse is generated in the unit cycle T.

Similarly, the second drive signal COM2 is repeatedly generated from the second drive signal generation portion 606B of the drive signal generation unit 606 in each unit cycle T in the same manner as the first drive signal COM1. In the present embodiment, the second discharge pulse DP2 that is a drive pulse is generated in the unit cycle T.

Specifically, the first discharge pulse DP1 of the first drive signal COM1 has a first expansion element P01 causing a voltage to be applied up to a first potential $V_1$ in a state in which an intermediate potential Vm is applied, and thus to increase a volume of the pressure chamber 12 from a reference volume; a first expansion maintaining element P02 causing the volume of the pressure chamber 12 increased by the first expansion element P01 to be maintained for a predetermined time; a first contraction element P03 causing a voltage to be applied up to a second potential $V_2$ from the first potential $V_1$ and thus to reduce the volume of the pressure chamber 12; a first contraction maintaining element P04 causing the volume of the pressure chamber 12 reduced by the first contraction element P03 to be maintained for a predetermined time; and a first expansion return element P05 causing the pressure chamber 12 to return to the reference volume at the intermediate potential Vm from the contraction state at the second potential $V_2$. When the first discharge pulse DP1 is supplied to the piezoelectric actuator 300, ink in the pressure chamber 12 is pressurized, and thus an ink droplet is discharged from the nozzle 21.

In contrast, the second discharge pulse DP2 of the second drive signal COM2 has a second expansion element P11 causing a voltage to be applied up to the first potential $V_1$ in a state in which the intermediate potential Vm is applied, and thus to increase the volume of the pressure chamber 12 from the reference volume; a second expansion maintaining element P12 causing the volume of the pressure chamber 12 increased by the second expansion element P11 to be maintained for a predetermined time; a second contraction element P13 causing a voltage to be applied up to a third potential $V_3$ from the first potential $V_1$ and thus to reduce the volume of the pressure chamber 12; a second contraction maintaining element P14 causing the volume of the pressure chamber 12 reduced by the second contraction element P13 to be maintained for a predetermined time; and a second expansion return element P15 causing the pressure chamber 12 to return to the reference volume at the intermediate potential Vm from the contraction state at the third potential $V_3$.

A second applied voltage $\Delta V_B$ that is applied from the first potential $V_1$ to the third potential $V_3$ in the second contraction element P13 of the second drive signal COM2 is lower than a first applied voltage $\Delta V_A$ applied from the first potential $V_1$ to the second potential $V_2$ in the first contraction element P03 of the first drive signal COM1. In the present embodiment, the third potential $V_3$ that is an end potential of the second contraction element P13 is lower than the second potential $V_2$ that is an end potential of the first contraction element P03, and thus the second applied voltage $\Delta V_B$ is lower than the first applied voltage $\Delta V_A$. Of course, the first potential $V_1$ that is a start potential of the second contraction element P13 of the second discharge pulse DP2 may be higher than the first potential $V_1$ that is a start potential of the first contraction element P03 of the first discharge pulse DP1 such that the second applied voltage $\Delta V_B$ is lower than the first applied voltage $\Delta V_A$, and both of the start potential and the end potential may be changed.

As mentioned above, the second applied voltage $\Delta V_B$ of the second discharge pulse DP2 is lower than the first applied voltage $\Delta V_A$ the first discharge pulse DP1, and thus the weight of an ink droplet discharged by using the second discharge pulse DP2 is smaller than the weight of an ink droplet discharged by using the first discharge pulse DP1.

Here, for example, in a case where the flow path resistance of the first upstream flow path of the first individual flow path 200A is larger than the flow path resistance of the first downstream flow path, when the first individual flow path 200A and the second individual flow path 200B have structures reverse to each other, the flow path resistance of the second upstream flow path of the second individual flow path 200B is smaller than the flow path resistance of the second downstream flow path. Thus, the pressure of ink in the first nozzle 21A is lower than the pressure of ink in the second nozzle 21B, and thus the weight of an ink droplet discharged from the first nozzle 21A is smaller than the weight of an ink droplet discharged from the second nozzle 21B.

Thus, the controller 600 of the recording system of the present embodiment supplies different drive pulses to the piezoelectric actuators 300 respectively corresponding to the first pressure chamber row 120A and the second pressure chamber row 120B. Specifically, the first discharge pulse DP1 of the first drive signal COM1 is applied to the piezoelectric actuator 300 corresponding to the first individual flow path 200A in which the weight of an ink droplet is small, and the second discharge pulse DP2 of the second drive signal COM2 is applied to the piezoelectric actuator 300 corresponding to the second individual flow path 200B in which the weight of an ink droplet is large. Consequently, even though there is a relatively great difference between the pressure of ink in the first nozzle 21A and the pressure of ink in the second nozzle 21B, a difference between the weights of an ink droplet discharged from the first nozzle 21A and an ink droplet discharged from the second nozzle 21B can be reduced by adjusting voltages applied to the piezoelectric actuators 300, and thus it is possible to improve printing quality.

In the present embodiment, the weight of an ink droplet discharged from the nozzle 21 is changed by changing the first applied voltage $\Delta V_A$ of the first contraction element P03 of the first discharge pulse DP1 and the second applied voltage $\Delta V_B$ of the second contraction element P13 of the second discharge pulse DP2, but is not particularly limited thereto. For example, the weight of a discharged ink droplet may also be changed by changing at least one of applied potentials and slopes of the first expansion element P02 of the first discharge pulse DP1 and the second expansion element P12 of the second discharge pulse DP2. The weight of a discharged ink droplet may also be changed by changing time components of the first expansion element P01 of the first discharge pulse DP1 and the second expansion element P11 of the second discharge pulse DP2. The weight of a discharged ink droplet may also be changed by changing slopes of the first contraction element P03 of the first discharge pulse DP1 and the second contraction element P13 of the second discharge pulse DP2. The weight of a discharged ink droplet may be changed through a combination of two or more of the above contents.

In other words, the weight of an ink droplet can be changed by changing at least one of applied potentials, slopes, and times related to the first discharge pulse DP1 and the second discharge pulse DP2, and thus a difference between the weights of ink droplets respectively discharged from the first nozzle 21A and the second nozzle 21B can be reduced. Therefore, it is possible to improve printing quality.

In the above-described configuration, the nozzles 21 are disposed in a zigzag form in the X direction by disposing the first nozzle 21A of the first individual flow path 200A and the second nozzle 21B of the second individual flow path 200B at positions deviated in the Y direction, but is not particularly limited thereto.

Figure 9:
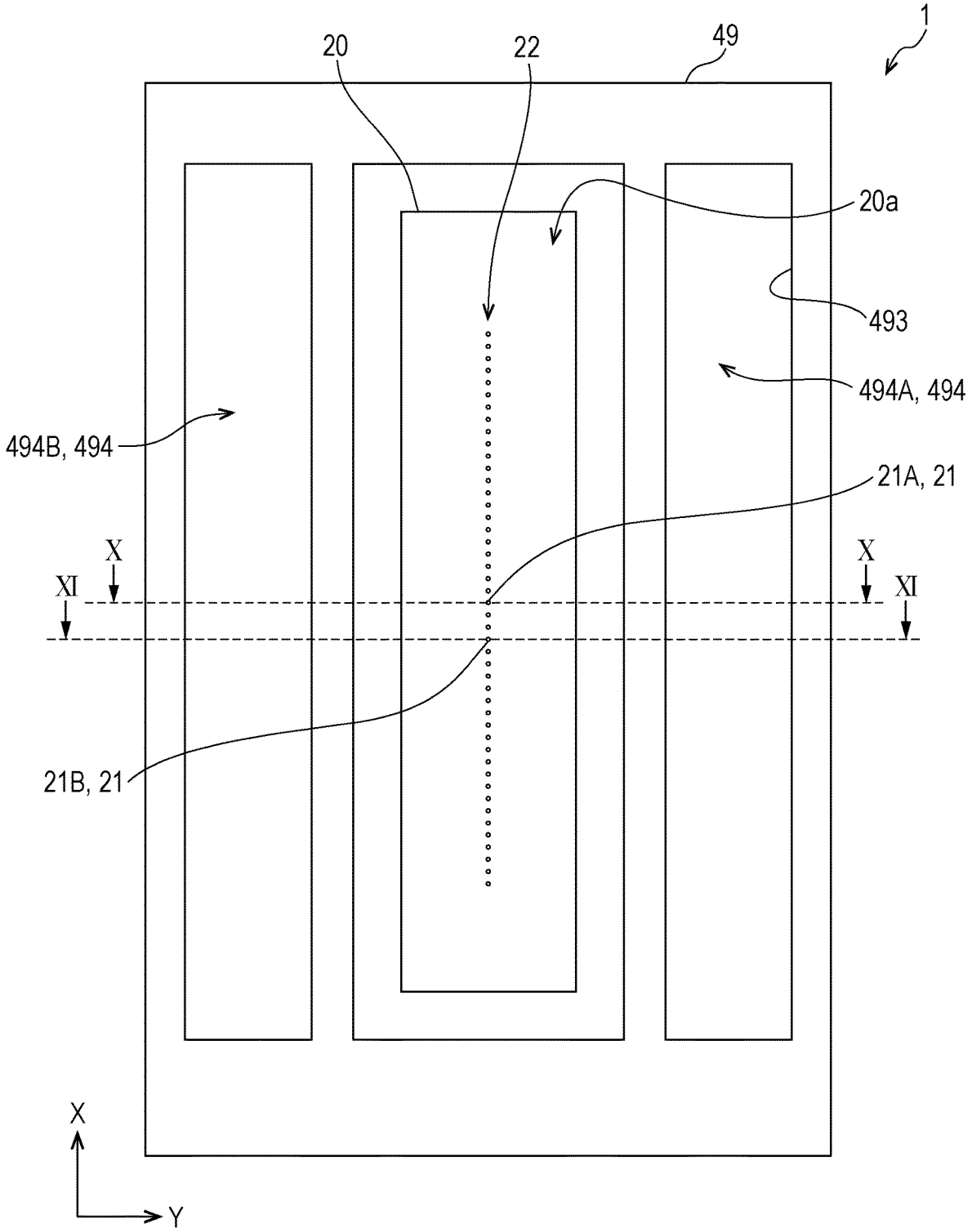
FIG. 9 is a plan view illustrating a modification example of the recording head according to Embodiment 1.
Figure 10:
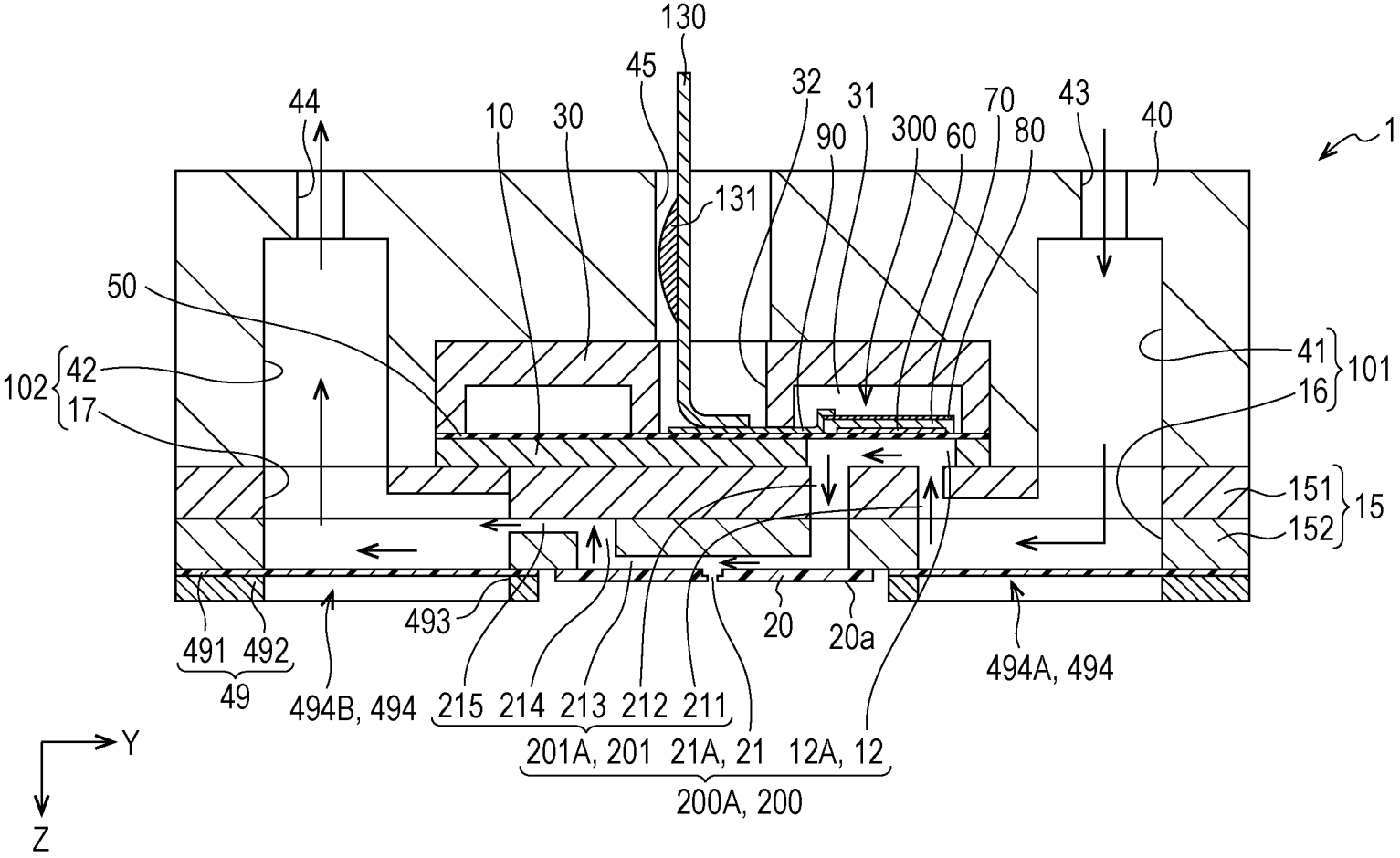
FIG. 10 is a sectional view illustrating the modification example of the recording head according to Embodiment 1.
Figure 11:
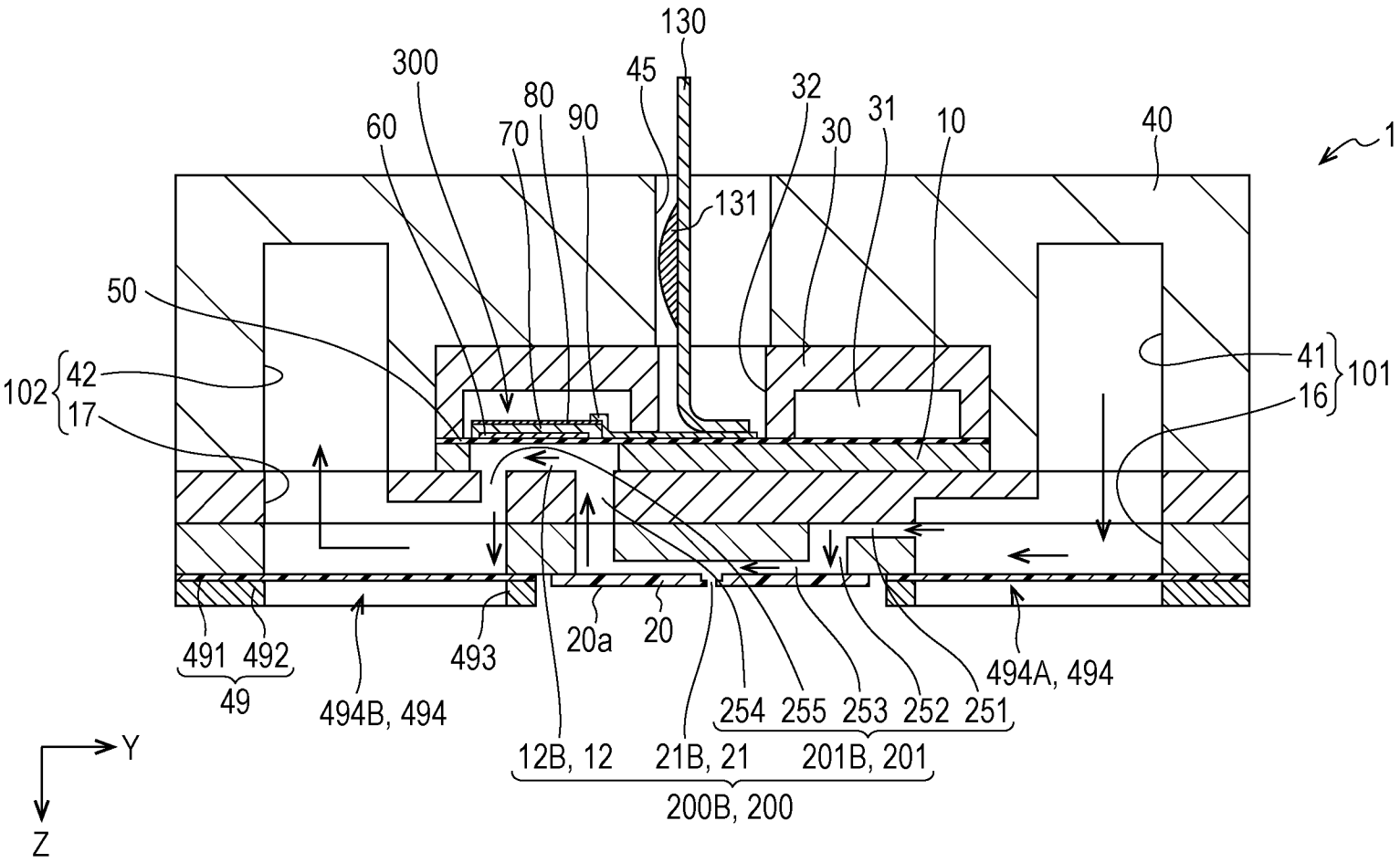
FIG. 11 is a sectional view illustrating the modification example of the recording head according to Embodiment 1.

Here, FIGS. 9 to 11 illustrates a modification example. FIG. 9 is a plan view of a nozzle surface side illustrating a modification example of the ink jet recording head according to Embodiment 1 of the present disclosure. FIG. 10 is a sectional view taken along the line X-X in FIG. 9, illustrating the modification example of the ink jet recording head. FIG. 11 is a sectional view taken along the line XI-XI in FIG. 9, illustrating the modification example of the ink jet recording head.

As illustrated in FIG. 10, the first nozzle 21A is provided at a position communicating with the middle of the first-3 flow path 213 forming the first individual communication flow path 201A of the first individual flow path 200A.

As illustrated in FIG. 11, the second nozzle 21B is provided at a position communicating with the middle of the second-3 flow path 253 forming the second individual communication flow path 201B of the second individual flow path 200B. In other words, the nozzles 21 are disposed to communicate with the middle of the first-3 flow path 213 and the middle of the second-3 flow path 253 extending in the Y direction.

Consequently, as illustrated in FIG. 9, the first nozzle 21A and the second nozzle 21B can be disposed at the same position in the Y direction. In other words, the first nozzle 21A and the second nozzle 21B can be disposed to overlap each other when viewed in the X direction. In other words, the first nozzle 21A and the second nozzle 21B can be disposed linearly along the X direction in one row.

As mentioned above, since the nozzles 21 are disposed to communicate with the middles of the first-3 flow path 213 and the second-3 flow path 253 extending in the Y direction, even though the first pressure chamber 12A and the second pressure chamber 12B are disposed at positions shifted relative to each other in the Y direction, the positions of the nozzles 21 can be easily adjusted in the Y direction. Therefore, the first nozzle 21A and the second nozzle 21B can be disposed at positions close to each other in the Y direction, or a plurality of nozzles 21 can be easily disposed at the same position in the Y direction, that is, linearly along the X direction in one row.

In this configuration, a shift distance in the Y direction between the first nozzle 21A and the second nozzle 21B is shorter than a shift distance in the Y direction between the first pressure chamber row 120A and the second pressure chamber row 120B when viewed in the X direction. In other words, since the first nozzle 21A and the second nozzle 21B are provided at the same position in the Y direction, the shift distance is 0 (zero). Therefore, the shift distance between the nozzles 21 is shorter than the shift distance $L_2$ in the Y direction between the first pressure chamber row 120A and the second pressure chamber row 120B illustrated in FIG. 1.

As mentioned above, since the shift distance in the Y direction between the first nozzle 21A and the second nozzle 21B is shorter than the shift distance $L_2$ in the Y direction between the first pressure chamber 12A and the second pressure chamber 12B, a plurality of nozzles 21 can be disposed to be close to each other in the Y direction at high density, and the first pressure chamber 12A and the second pressure chamber 12B can be disposed at positions separated from each other in the Y direction. Thus, each of the first pressure chamber row 120A and the second pressure chamber row 120B can be disposed at lower density than the nozzles 21. Therefore, it is possible to miniaturize a flow path substrate by increasing an excluded volume of each pressure chamber 12 or disposing the pressure chambers 12 at high density.

The first nozzle 21A and the second nozzle 21B are disposed at the same position in the Y direction and are arranged in one row linearly along the X direction, and thus it is not necessary to perform adjustment for delaying a timing of discharging an ink droplet from each nozzle 21 and also to simplify drive control for the piezoelectric actuator 300. For example, in a case where ink droplets are discharged from the nozzles 21 disposed at different positions in the Y direction when the recording head 1 is moved in the Y direction and ink droplets are discharged, landing positions of the ink droplets onto an ejection medium are deviated in the Y direction. Therefore, it is necessary to adjust drive timings for the piezoelectric actuators 300 such that the ink droplets are landed at the same position in the Y direction.

In the example illustrated in FIG. 9, the first nozzle 21A and the second nozzle 21B are disposed linearly along the X direction, but are not particularly limited thereto. For example, the first nozzle 21A and the second nozzle 21B may be disposed to be shifted relative to each other in the Y direction when viewed in the X direction, and a shift distance in the Y direction between the first nozzle 21A and the second nozzle 21B may be shorter than the shift distance $L_2$ in the Y direction between the first pressure chamber 12A and the second pressure chamber 12B. In other words, the first nozzle 21A and the second nozzle 21B may be disposed in a zigzag form along the X direction, the first nozzle 21A may communicate with the first-3 flow path 213, and the second nozzle 21B may communicate with the second-3 flow path 253.

Since the first nozzle 21A and the second nozzle 21B respectively communicate with the first-3 flow path 213 and the second-3 flow path 253 that are flow paths provided to extend in the Y direction, ink thickened as a result of being dried by the nozzle 21 or an air bubble permeated from the nozzle 21 can be suppressed from staying in a corner part of a boundary between the communication plate 15 and the nozzle plate 20, that is, a corner part defined by the nozzle plate 20 at the end parts of the first-2 flow path 212 and the second-4 flow path 254 in the +Z direction, and thus it is possible to discharge the ink thickened by the nozzle 21 or the air bubble to the second common liquid chamber 102 via the first downstream flow path and the second downstream flow path in the circulation flow. Since the first nozzle 21A and the second nozzle 21B respectively communicate with the first-3 flow path 213 and the second-3 flow path 253 that are flow paths provided to extend in the Y direction, an air bubble permeated from the nozzle 21 can be suppressed from moving toward the pressure chamber 12 in the −Z direction by buoyant force, and can thus be discharged to the second common liquid chamber 102 via the first downstream flow path and the second downstream flow path in the circulation flow. Therefore, it is possible to reduce the occurrence of defective discharge due to thickened ink or an air bubble.

In the above example, the first-4 flow path 214 and the first-5 flow path 215 of the first individual communication flow path 201A are disposed at a position overlapping a region between the adjacent second pressure chambers 12B in the second pressure chamber row 120B when viewed in the Z direction, but are not particularly limited thereto. For example, the first-4 flow path 214 and the first-5 flow path 215 may be disposed at positions partially overlapping the second pressure chambers 12B of the second pressure chamber row 120B when viewed in the Z direction. In other words, the first individual communication flow path 201A that is the individual communication flow path 201 corresponding to the first pressure chamber row 120A having the portion overlapping the region between the adjacent second pressure chambers 12B in the second pressure chamber row 120B when viewed in the Z direction indicates that at least a part of the first individual communication flow path 201A may overlap the region between the second pressure chambers 12B when viewed in the Z direction, and also includes that the first individual communication flow path 201A overlaps the second pressure chamber 12B when viewed in the Z direction.

Figure 12:
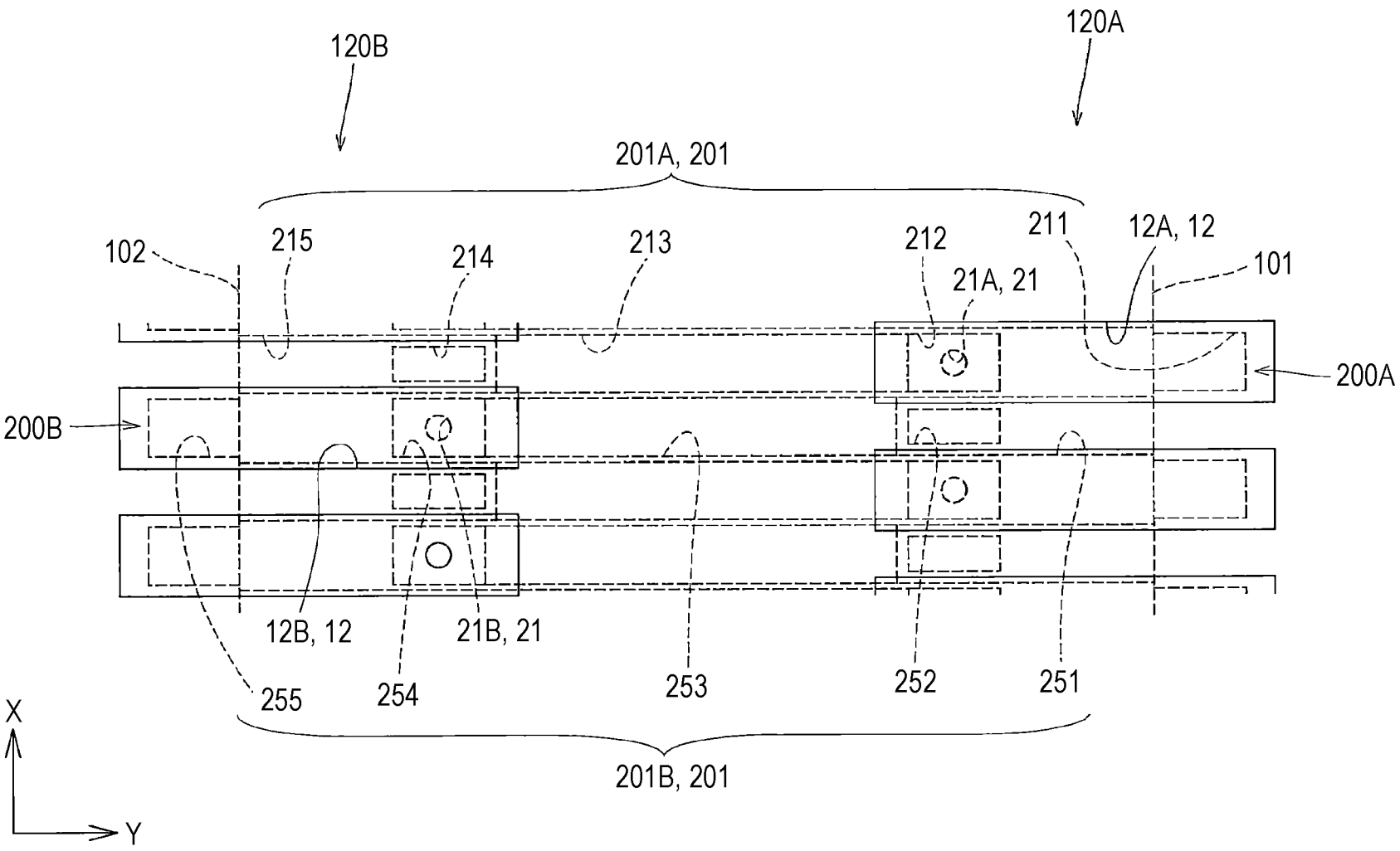
FIG. 12 is a plan view illustrating the modification example of the recording head according to Embodiment 1.

Here, FIG. 12 illustrates a modification example of the recording head 1. FIG. 12 is a plan view illustrating a flow path configuration of the recording head according to Embodiment 1 of the present disclosure.

As illustrated in FIG. 12, the first-5 flow path 215 of the first individual communication flow path 201A is disposed to overlap at a position overlapping both of a region between the adjacent second pressure chambers 12B of the second pressure chamber row 120B and a part of the second pressure chamber 12B when viewed in the Z direction. The first-4 flow path 214 is provided at only a position overlapping the region between the adjacent second pressure chambers 12B of the second pressure chamber row 120B when viewed in the Z direction. In other words, the first-5 flow path 215 and the second pressure chamber 12B are disposed at the positions partially overlapping each other when viewed in the Z direction. As mentioned above, the configuration in which the first-5 flow path 215 and the second pressure chamber 12B are disposed at the positions partially overlapping each other when viewed in the Z direction may be realized by a configuration in which the first-4 flow path 214 and the second pressure chamber row 120B are disposed not to overlap each other when viewed in the X direction.

As mentioned above, since the first-5 flow path 215 of the first individual communication flow path 201A is disposed to overlap at the position overlapping the region between the adjacent second pressure chambers 12B of the second pressure chamber row 120B and the second pressure chamber 12B when viewed in the Z direction, the second pressure chamber 12B can be formed to have a relatively large width in the X direction such that an excluded volume of the second pressure chamber 12B can be increased, and a discharge characteristic of an ink droplet discharged from the second nozzle 21B, for example, the weight of the ink droplet can be increased.

Since the first-5 flow path 215 can be formed widely in the X direction up to a position overlapping the second pressure chamber 12B, it is possible to reduce flow path resistance and inertance by increasing a cross-sectional area of the first-5 flow path 215.

In the same manner for the second individual communication flow path 201B, in the above example, the second-1 flow path 251 and the second-2 flow path 252 of the second individual communication flow path 201B are disposed at positions overlapping a partition wall that is a region between the adjacent first pressure chambers 12A of the first pressure chamber row 120A when viewed in the Z direction, but are not particularly limited thereto.

As illustrated in FIG. 12, the second-1 flow path 251 of the second individual communication flow path 201B is disposed at a position overlapping both of a region between the adjacent first pressure chambers 12A of the first pressure chamber row 120A and the first pressure chamber 12A when viewed in the Z direction. The second-2 flow path 252 is provided at only a position overlapping the region between the adjacent first pressure chambers 12A of the first pressure chamber row 120A when viewed in the Z direction. In other words, the second-1 flow path 251 and the first pressure chamber 12A are disposed at positions partially overlapping each other when viewed in the Z direction. As mentioned above, the configuration in which the second-1 flow path 251 and the first pressure chamber 12A are disposed at the positions partially overlapping each other when viewed in the Z direction may be realized by a configuration in which the second-1 flow path 251 and the first pressure chamber row 120A are disposed not to overlap each other when viewed in the X direction.

As mentioned above, since the second-1 flow path 251 of the second individual communication flow path 201B is disposed to overlap at the position overlapping the region between the adjacent first pressure chambers 12A of the first pressure chamber row 120A and the first pressure chamber 12A when viewed in the Z direction, the first pressure chamber 12A can be formed to have a relatively large width in the X direction such that an excluded volume of the first pressure chamber 12A can be increased, and a discharge characteristic of an ink droplet discharged from the first nozzle 21A, for example, the weight of the ink droplet can be increased.

Since the second-1 flow path 251 can be formed widely in the X direction up to a position overlapping the first pressure chamber 12A, it is possible to reduce flow path resistance and inertance by increasing a cross-sectional area of the second-1 flow path 251.

Embodiment 2

Figure 13:
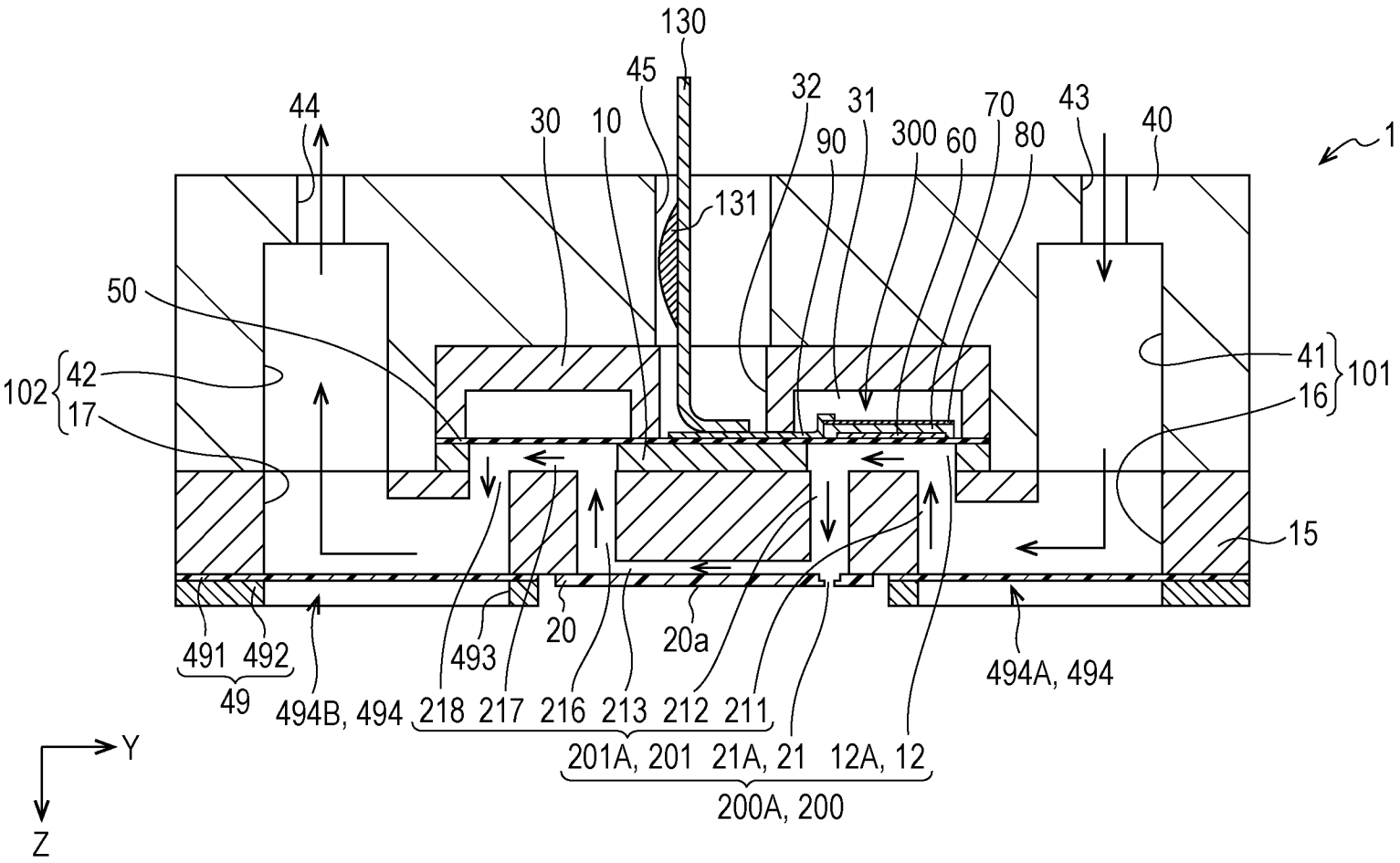
FIG. 13 is a sectional view illustrating a recording head according to Embodiment 2.
Figure 14:
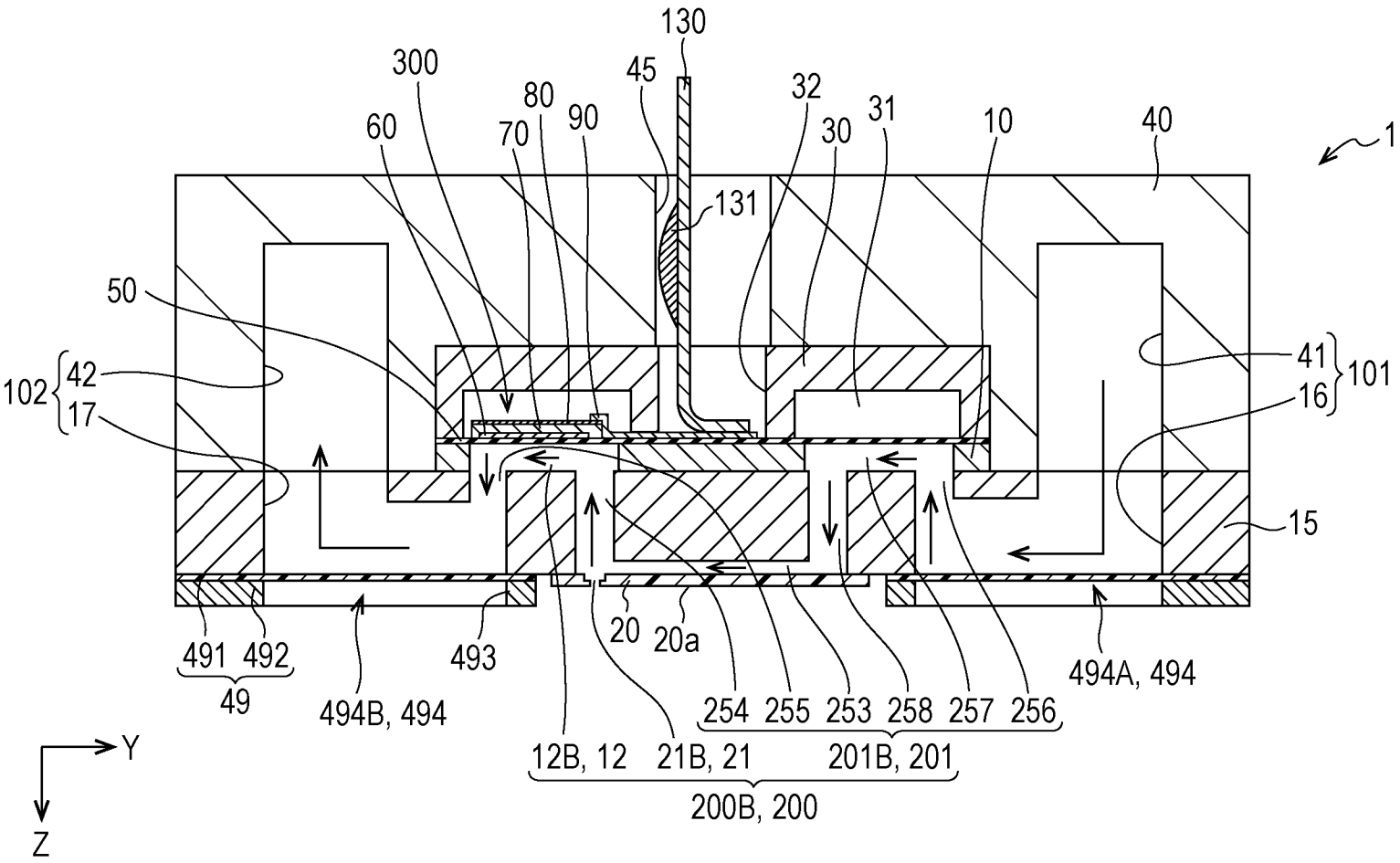
FIG. 14 is a sectional view illustrating the recording head according to Embodiment 2.

FIG. 13 is a sectional view illustrating a recording head according to Embodiment 2 of the present disclosure, and is a sectional view taken along the line A-A in FIG. 1. FIG. 14 is a sectional view illustrating the recording head according to Embodiment 2 of the present disclosure, and is a sectional view taken along the line B-B in FIG. 1. The same member as in the embodiment is given the same reference numeral, and repeated description will be omitted.

As illustrated in FIGS. 13 and 14, the communication plate 15 of the present embodiment is formed of a single substrate. The flow path formation substrate 10, the communication plate 15, the nozzle plate 20, and the compliance substrate 49 forming a flow path substrate are provided with a plurality of individual flow paths 200 each provided for the first common liquid chamber 101, the second common liquid chamber 102, and the nozzle 21.

The individual flow path 200 includes the first individual flow path 200A having the first nozzle 21A, the first pressure chamber 12A, and the first individual communication flow path 201A as illustrated in FIG. 13, and the second individual flow path 200B having the second nozzle 21B, the second pressure chamber 12B, and the second individual communication flow path 201B as illustrated in FIG. 14.

As illustrated in FIG. 13, the first individual communication flow path 201A has a first-1 flow path 211, a first-2 flow path 212, a first-3 flow path 213, a first-6 flow path 216, a first-7 flow path 217, and a first-8 flow path 218.

The first-1 flow path 211, the first-2 flow path 212, and the first-3 flow path 213 of the present embodiment are the same as those of Embodiment 1, and thus repeated description will be omitted.

The first-6 flow path 216 is provided to penetrate through the communication plate 15 in the Z direction such that one end thereof communicates with the first-3 flow path 213, and the other end is open to the surface of the communication plate 15 in the −Z direction.

The first-6 flow path 216 is a portion overlapping a region between the adjacent second pressure chambers 12B of the second pressure chamber row 120B when viewed in the Z direction, the portion not overlapping the second pressure chamber row 120B when viewed in the X direction. In the present embodiment, the first-6 flow path 216 is disposed in only a region overlapping a partition wall partitioning the second pressure chambers 12B from each other in the X direction.

The first-6 flow paths 216 serve as first portions arranged side by side in the X direction with the second individual communication flow path 201B, interposed therebetween, corresponding to the second pressure chamber row 120B. In other words, the first-6 flow paths 216 are arranged side by side in the X direction with the second-4 flow path 254 of the second individual communication flow path 201B interposed therebetween.

The first-7 flow path 217 is provided along the Y direction in the flow path formation substrate 10. In other words, the first-7 flow path 217 is formed by providing a recess that is open to the surface of the flow path formation substrate 10 in the +Z direction and covering the recess with the communication plate 15 like a lid.

The first-7 flow path 217 is a portion overlapping the region between the adjacent second pressure chambers 12B of the second pressure chamber row 120B when viewed in the Z direction, and is disposed to overlap the second pressure chamber row 120B when viewed in the X direction. Thus, the first-7 flow paths 217 serve as first portions arranged side by side in the X direction with the second individual communication flow path 201B, interposed therebetween, corresponding to the second pressure chamber row 120B.

The first-8 flow path 218 is provided along the Z direction such that one end thereof communicates with the end part of the first pressure chamber 12A in the −Y direction and the other end thereof communicates with the end part of the second common liquid chamber 102 in the −Z direction.

The first-8 flow path 218 is a portion overlapping the region between the adjacent second pressure chambers 12B of the second pressure chamber row 120B when viewed in the Z direction, the portion not overlapping the second pressure chamber row 120B when viewed in the X direction.

The first-8 flow paths 218 serve as first portions arranged side by side in the X direction with the second individual communication flow path 201B, interposed therebetween, corresponding to the second pressure chamber row 120B. In other words, the first-8 flow paths 218 are arranged side by side in the X direction with the second-5 flow path 255 of the second individual communication flow path 201B interposed therebetween.

As illustrated in FIG. 14, the second individual communication flow path 201B includes a second-6 flow path 256, a second-7 flow path 257, a second-8 flow path 258, a second-3 flow path 253, a second-4 flow path 254, and a second-5 flow path 255.

The second-3 flow path 253, the second-4 flow path 254, and the second-5 flow path 255 of the present embodiment are the same as those of Embodiment 1 described above, and thus repeated description will be omitted.

The second-6 flow path 256 is provided along the Z direction such that one end thereof communicates with the end part of the first common liquid chamber 101 in the −Z direction and the other end thereof communicates with the end part of the second pressure chamber 12B in the +Y direction.

The second-6 flow path 256 is a portion overlapping a region between the adjacent first pressure chamber 12A of the first pressure chamber row 120A when viewed in the Z direction, the portion not overlapping the first pressure chamber row 120A when viewed in the X direction.

The second-6 flow paths 256 serve as first portions arranged side by side in the X direction with the first individual communication flow path 201A, interposed therebetween, corresponding to the first pressure chamber row 120A. In other words, the second-6 flow path 256 are arranged side by side in the X direction with the first-1 flow path 211 of the first individual communication flow path 201A interposed therebetween.

The second-7 flow path 257 is provided along the Y direction in the flow path formation substrate 10. In other words, the second-7 flow path 257 is formed by providing a recess that is open to the surface of the flow path formation substrate 10 in the +Z direction and covering the recess with the communication plate 15 like a lid.

The second-7 flow path 257 is a portion overlapping the region between the adjacent first pressure chambers 12A of the first pressure chamber row 120A when viewed in the Z direction, and is disposed to overlap the first pressure chamber row 120A when viewed in the X direction. Thus, the second-7 flow paths 257 serve as first portions arranged side by side in the X direction with the first individual communication flow path 201A, interposed therebetween, corresponding to the first pressure chamber row 120A.

The second-8 flow path 258 is provided to penetrate through the communication plate 15 in the Z direction such that one end thereof communicates with the end part of the second-3 flow path 253 and the other end thereof communicates with the end part of the second-7 flow path 257 in the −Y direction.

The second-8 flow path 258 is a portion overlapping the region between the adjacent first pressure chambers 12A of the first pressure chamber row 120A when viewed in the Z direction, the portion not overlapping the first pressure chamber row 120A when viewed in the X direction.

The second-8 flow paths 258 serve as first portions arranged side by side in the X direction with the first individual communication flow path 201A, interposed therebetween, corresponding to the first pressure chamber row 120A. In other words, the second-8 flow paths 258 are arranged side by side in the X direction with the first-2 flow path 212 of the first individual communication flow path 201A interposed therebetween.

As mentioned above, in the present embodiment, since the first-7 flow path 217 and the second-7 flow path 257 are provided in the flow path formation substrate 10, it is not necessary to provide a flow path that is provided along the Y direction in the middle of the thickness of the communication plate 15 in the Z direction, and the communication plate 15 can be formed of a single substrate. Therefore, it is possible to reduce the number of components by simplifying a structure of the recording head 1 and thus to reduce cost.

Embodiment 3

Figure 15:
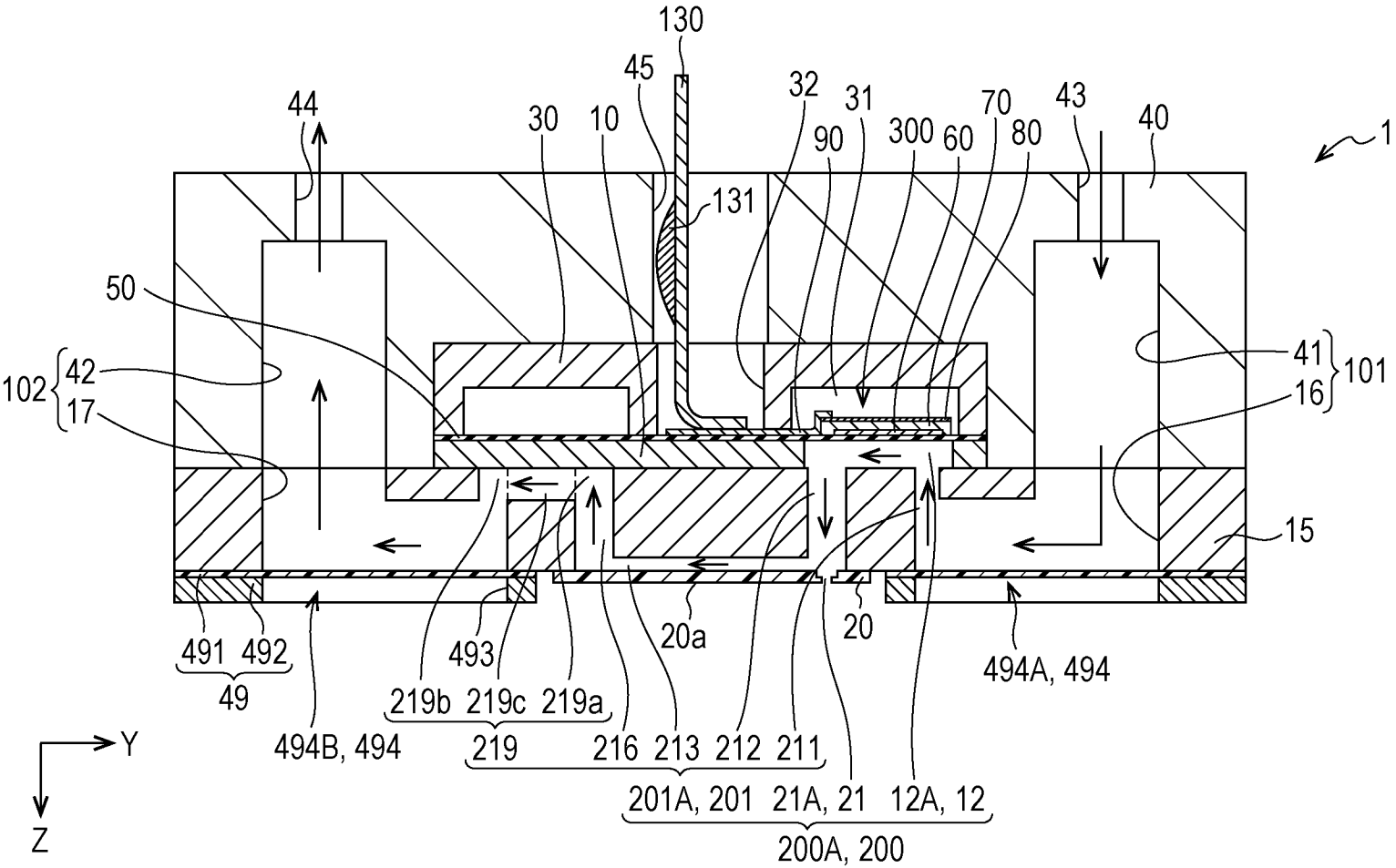
FIG. 15 is a sectional view illustrating a recording head according to Embodiment 3.
Figure 16:
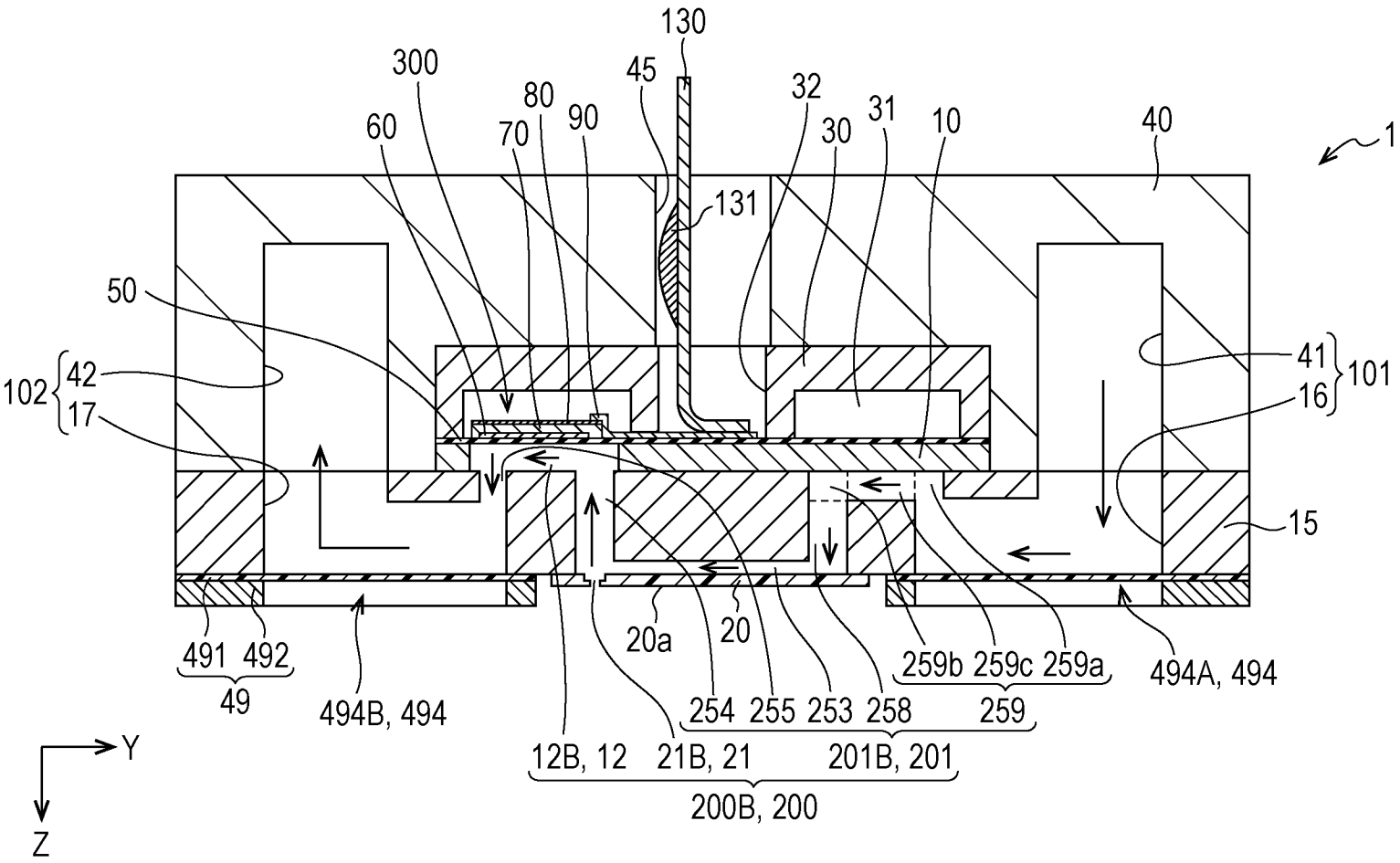
FIG. 16 is a sectional view illustrating the recording head according to Embodiment 3.

FIG. 15 is a sectional view illustrating a recording head according to Embodiment 3 of the present disclosure, and is a sectional view taken along the line A-A in FIG. 1. FIG. 16 is a sectional view illustrating the recording head according to Embodiment 3 of the present disclosure, and is a sectional view taken along the line B-B in FIG. 1. The same member as in the embodiments is given the same reference numeral, and repeated description will be omitted.

As illustrated in FIGS. 15 and 16, the communication plate 15 of the present embodiment is formed of a single substrate. The flow path formation substrate 10, the communication plate 15, the nozzle plate 20, and the compliance substrate 49 forming a flow path substrate are provided with a plurality of individual flow paths 200 each provided for the first common liquid chamber 101, the second common liquid chamber 102, and the nozzle 21.

The individual flow path 200 includes the first individual flow path 200A having the first nozzle 21A, the first pressure chamber 12A, and the first individual communication flow path 201A as illustrated in FIG. 15, and the second individual flow path 200B having the second nozzle 21B, the second pressure chamber 12B, and the second individual communication flow path 201B as illustrated in FIG. 16.

As illustrated in FIG. 15, the first individual communication flow path 201A has a first-1 flow path 211, a first-2 flow path 212, a first-3 flow path 213, a first-6 flow path 216, and a first-9 flow path 219.

The first-1 flow path 211, the first-2 flow path 212, the first-3 flow path 213, and the first-6 flow path 216 of the present embodiment are the same as those of the embodiments, and thus repeated description will be omitted.

The first-9 flow path 219 is formed along the Y direction by forming a recess open to the surface of the communication plate 15 in the −Z direction and covering an opening of the recess with the flow path formation substrate 10 like a lid.

The first-9 flow path 219 is provided to communicate with the end part of the second common liquid chamber 102 in the −Z direction at the end part thereof in the −Y direction.

The first-9 flow path 219 is a portion overlapping the region between the adjacent second pressure chambers 12B of the second pressure chamber row 120B when viewed in the Z direction, and is disposed to overlap the second pressure chamber row 120B when viewed in the X direction. In the present embodiment, the first-9 flow path 219 is provided at only a position overlapping a partition wall partitioning the second pressure chambers 12B from each other in the X direction when viewed in the Z direction.

Flow path portions 219*a* on the end part sides of the first-9 flow paths 219 in the +Y direction are arranged side by side in the X direction with the second-4 flow path 254 of the second individual communication flow path 201B, interposed therebetween, corresponding to the second pressure chamber row 120B which will be described later in detail. In other words, the flow path portions 219*a* on the end part sides of the first-9 flow paths 219 in the +Y direction serve as first portions.

Flow path portions 219*b* on the end part sides of the first-9 flow paths 219 in the −Y direction are arranged side by side in the X direction with the second-5 flow path 255 of the second individual communication flow path 201B interposed therebetween. In other words, the flow path portions 219*b* on the end part sides of the first-9 flow paths 219 in the −Y direction serve as first portions.

Flow path portions 219*c* interposed between the flow path portions 219*a* and 219*b* on the end part sides of the first-9 flow paths 219 serve as second portions arranged side by side in the X direction without the second individual communication flow path 201B interposed therebetween.

The first individual communication flow paths 201A have the first-1 flow path 211, the first-2 flow paths 212, the first-3 flow paths 213, the first-6 flow paths 216, and the flow path portions 219*a* and 219*b* of the first-9 flow paths 219 as the first portions arranged side by side in the X direction with the second individual communication flow path 201B interposed therebetween.

The first individual communication flow paths 201A have the flow path portions 219*c* of the first-9 flow paths 219 as the second portions arranged side by side in the X direction without the second individual communication flow path 201B interposed therebetween.

As illustrated in FIG. 16, the second individual communication flow path 201B has a second-9 flow path 259, a second-8 flow path 258, a second-3 flow path 253, a second-4 flow path 254, and a second-5 flow path 255.

The second-8 flow path 258, the second-3 flow path 253, the second-4 flow path 254, and the second-5 flow path 255 of the present embodiment are the same as those of the embodiments, and thus repeated description will be omitted.

The second-9 flow path 259 is formed along the Y direction by providing a recess that is open to the surface of the communication plate 15 in the −Z direction and covering the recess with the flow path formation substrate 10 like a lid.

The second-9 flow path 259 is provided to communicate with the end part of the first common liquid chamber 101 in the −Z direction at the end part thereof in the +Y direction.

The second-9 flow path 259 is a portion overlapping the region between the adjacent first pressure chamber 12A of the first pressure chamber row 120A when viewed in the Z direction, and is disposed to overlap the first pressure chamber row 120A when viewed in the X direction. In the present embodiment, the second-9 flow path 259 is provided at only a position overlapping a partition wall partitioning the first pressure chambers 12A from each other in the X direction when viewed in the Z direction.

Flow path portions 259*a* on the end part sides of the second-9 flow paths 259 in the +Y direction are arranged side by side in the X direction with the first-1 flow path 211 of the first individual communication flow path 201A, interposed therebetween, corresponding to the first pressure chamber row 120A. In other words, the flow path portions 259*a* on the end part sides of the second-9 flow paths 259 in the +Y direction serve as first portions.

Flow path portions 259*b* on the end part sides of the second-9 flow paths 259 in the −Y direction are arranged side by side in the X direction with the first-2 flow path 212 of the first individual communication flow path 201A interposed therebetween. In other words, the flow path portions 259*b* on the end part sides of the second-9 flow paths 259 in the −Y direction serve as first portions.

Flow path portions 259*c* interposed between the flow path portions 259*a* and 259*b* on the end part sides of the second-9 flow paths 259 serve as second portions arranged side by side in the X direction without the first individual communication flow path 201A interposed therebetween.

The second individual communication flow paths 201B have the flow path portions 259*a* and 259*b* of the second-9 flow paths 259, the second-8 flow paths 258, the second-3 flow paths 253, the second-4 flow paths 254, and the second-5 flow paths 255 as the first portions arranged side by side in the X direction with the first individual communication flow path 201A interposed therebetween.

The second individual communication flow paths 201B have the flow path portions 259*c* of the second-9 flow paths 259 as the second portions arranged side by side in the X direction without the first individual communication flow path 201A interposed therebetween.

As mentioned above, similarly, the second individual communication flow paths 201B also have the first portions arranged side by side in the X direction with the first individual communication flow path 201A interposed therebetween and the second portions arranged side by side in the X direction without the first individual communication flow path 201A interposed therebetween. In other words, the second individual communication flow paths 201B of the present embodiment have the flow path portions 259*a* and 259*b* of the second-9 flow path 259, the second-8 flow paths 258, the second-3 flow paths 253, the second-4 flow paths 254, and the second-5 flow paths 255 as the first portions, and have the flow path portion 259*c* of the second-9 flow paths 259 as the second portions.

In the present embodiment, since the first-9 flow path 219 and the second-9 flow path 259 are provided to be open to the surface of the communication plate 15 in the −Z direction, it is not necessary to provide a flow path that is provided along the Y direction in the middle of the thickness of the communication plate 15 in the Z direction, and the communication plate 15 can be formed of a single substrate. Therefore, it is possible to reduce the number of components by simplifying a structure of the recording head 1 and thus to reduce cost.

Embodiment 4

Figure 17:
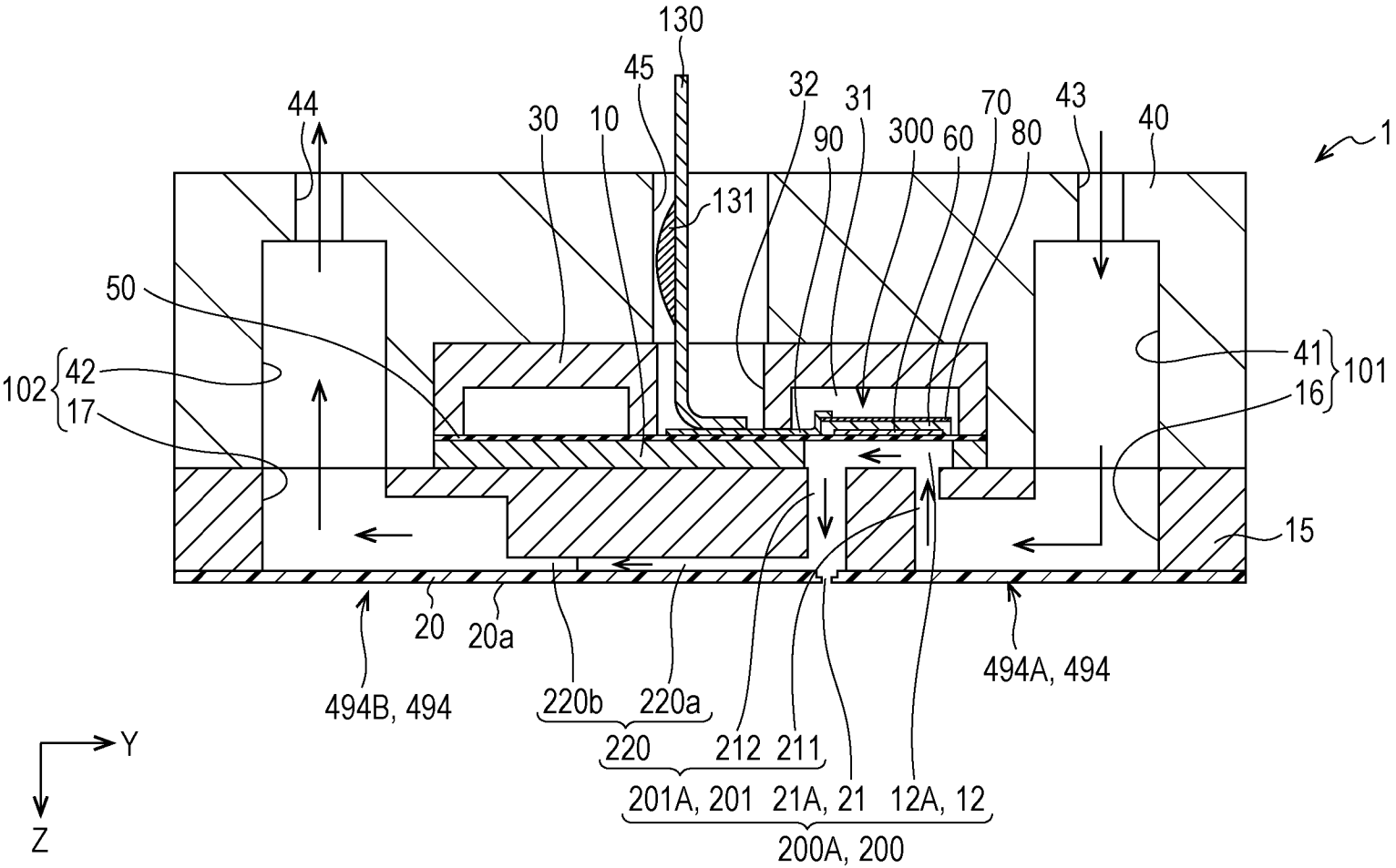
FIG. 17 is a sectional view illustrating a recording head according to Embodiment 4.
Figure 18:
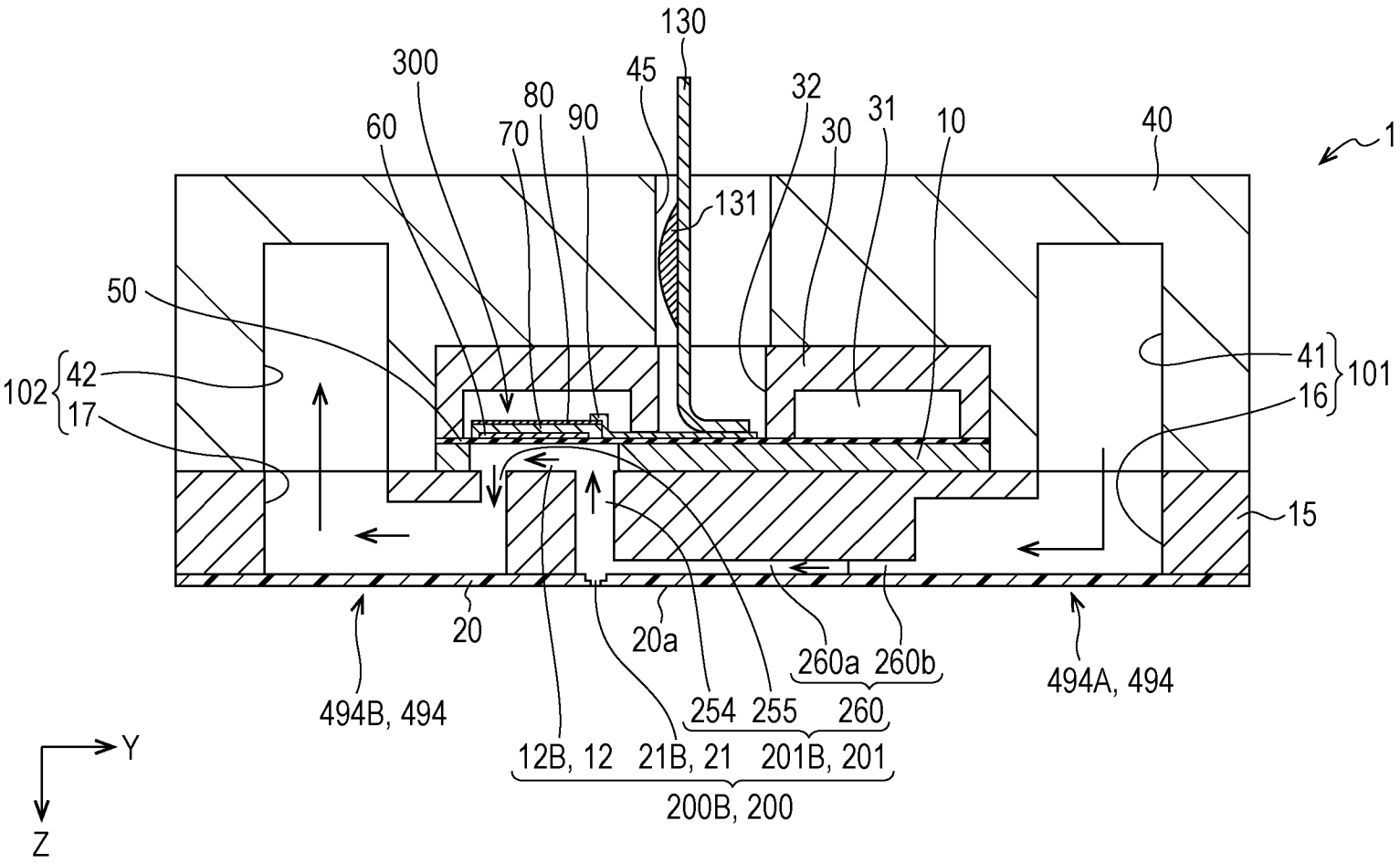
FIG. 18 is a sectional view illustrating the recording head according to Embodiment 4.

FIG. 17 is a sectional view illustrating a liquid ejecting head according to Embodiment 4 of the present disclosure, and is a sectional view taken along the line A-A in FIG. 1. FIG. 18 is a sectional view illustrating the recording head according to Embodiment 4 of the present disclosure, and is a sectional view taken along the line B-B in FIG. 1. The same member as in the embodiments is given the same reference numeral, and repeated description will be omitted.

In the recording head 1 of the present embodiment, the nozzle plate 20 is integrated with the compliance substrate 49.

Specifically, as illustrated in FIGS. 17 and 18, the nozzle plate 20 is provided to have a size covering the openings of the first common liquid chamber 101 and the second common liquid chamber 102. The compliance portions 494 are provided at portions forming parts of respective walls of the first common liquid chamber 101 and the second common liquid chamber 102 of the nozzle plate 20. In other words, the first compliance portion 494A is provided at the portion corresponding to the first common liquid chamber 101 of the nozzle plate 20, and the second compliance portion 494B is provided at the portion corresponding to the second common liquid chamber 102 thereof.

In the present embodiment, the nozzle plate 20 is formed by using a film made of a resin material such as polyimide, and thus the respective walls defining the first common liquid chamber 101 and the second common liquid chamber 102 of the nozzle plate 20 function as the compliance portions 494.

As mentioned above, since the compliance portions 494 that can absorb the pressure of ink are provided on parts of the respective walls of the first common liquid chamber 101 and the second common liquid chamber 102, a pressure change of ink in the first common liquid chamber 101 and the second common liquid chamber 102 can be absorbed through deformation of the compliance portions 494, and thus it is possible to suppress the occurrence of variations in discharge characteristics of ink droplets.

In the present embodiment, the compliance portions 494 are provided at a part of the nozzle plate 20, and thus the nozzle plate 20 and the compliance portions 494 are disposed on the same +Z direction side with respect to the individual flow path 200.

As mentioned above, since the compliance portions 494 are disposed on the same side as the nozzle 21, the compliance portions 494 can be provided in a region in which the nozzle 21 is not provided, and thus the compliance portions 494 can be provided to have a relatively large area. Since the compliance portion 494 and the nozzle 21 are disposed on the same side, the compliance portions 494 can be disposed at positions close to the individual flow path 200, and thus a pressure change of ink in the individual flow path 200 can be effectively absorbed by the compliance portions 494.

Since the nozzle plate 20 covers the openings of the first common liquid chamber 101 and the second common liquid chamber 102, in the surface of the communication plate 15 in the +Z direction, the surface between the first common liquid chamber 101 and the nozzle 21 and the surface between the second common liquid chamber 102 and the nozzle 21 are covered with the nozzle plate 20. Thus, the individual flow path 200 communicating with the first common liquid chamber 101 and the second common liquid chamber 102 can be formed in the joint interface between the nozzle plate 20 and the communication plate 15. Thus, the communication plate 15 of the present embodiment is formed of a single substrate without laminating a plurality of substrates.

Here, a plurality of individual flow paths 200 each provided in the first common liquid chamber 101, the second common liquid chamber 102, and the nozzle 21 are provided in the flow path formation substrate 10, the communication plate 15, the nozzle plate 20, and the case member 40 forming a flow path substrate of the present embodiment.

The individual flow path 200 includes the first individual flow path 200A having the first nozzle 21A, the first pressure chamber 12A, and the first individual communication flow path 201A as illustrated in FIG. 17, and the second individual flow path 200B having the second nozzle 21B, the second pressure chamber 12B, and the second individual communication flow path 201B as illustrated in FIG. 18.

As illustrated in FIG. 17, the first individual communication flow path 201A has a first-1 flow path 211, a first-2 flow path 212, and a first-10 flow path 220.

The first-1 flow path 211 and the first-2 flow path 212 of the present embodiment are the same as those of the embodiments, and thus repeated description will be omitted.

The first-10 flow path 220 extends along the Y direction such that one end thereof in the +Y direction communicates with the first-2 flow path 212, and the other end thereof in the −Y direction communicates with the end part of the second common liquid chamber 102 in the +Y direction. The first-10 flow path 220 of the present embodiment is formed by forming a recess open to the surface of the communication plate 15 in the Z direction and covering an opening of the recess with the nozzle plate 20 like a lid. The first-10 flow path 220 is not particularly limited thereto, and may be formed by providing a recess in the nozzle plate 20 and covering the recess with the communication plate 15 like a lid, and may be formed by providing recesses in both of the communication plate 15 and the nozzle plate 20.

The first-10 flow path 220 has, on the end part side in the −Y direction, a portion overlapping a region between the adjacent second pressure chambers 12B of the second pressure chamber row 120B when viewed in the Z direction, the portion not overlapping the second pressure chamber row 120B when viewed in the X direction. The end part of the first-10 flow path 220 in the Y direction extends to the outside of the region between the second pressure chambers 12B when viewed in the Z direction. In the present embodiment, the first-10 flow path 220 is provided at only a position overlapping a partition wall partitioning the second pressure chambers 12B from each other in the X direction when viewed in the Z direction.

Flow path portions 220*a* on the end part sides of the first-10 flow paths 220 in the +Y direction are arranged side by side in the X direction with a second-10 flow path 260 of the second individual communication flow path 201B, interposed therebetween, corresponding to the second pressure chamber row 120B which will be described later in detail. In other words, the flow path portions 220*a* on the end part sides of the first-10 flow paths 220 in the +Y direction serve as first portions.

Flow path portions 220*b* on the end part sides of the first-10 flow paths 220 in the −Y direction are arranged side by side in the X direction without the second individual communication flow path 201B which will be described later interposed therebetween. The flow path portions 220*b* on the end part sides of the first-10 flow paths 220 in the −Y direction serve as second portions.

As illustrated in FIG. 18, the second individual communication flow path 201B has the second-10 flow path 260, the second-4 flow path 254, and the second-5 flow path 255.

The second-4 flow path 254 and the second-5 flow path 255 of the present embodiment are the same as those of the embodiments, and thus repeated description will be omitted.

The second-10 flow path 260 extends along the Y direction such that one end thereof in the +Y direction communicates with the first common liquid chamber 101, and the other end thereof in the −Y direction communicates with the end part of the second-4 flow path 254. The second-10 flow path 260 of the present embodiment is formed by forming a recess open to the surface of the communication plate 15 in the Z direction and covering an opening of the recess with the nozzle plate 20 like a lid. The second-10 flow path 260 is not particularly limited thereto, and may be formed by providing a recess in the nozzle plate 20 and covering the recess with the communication plate 15 like a lid, and may be formed by providing recesses in both of the communication plate 15 and the nozzle plate 20.

The second-10 flow path 260 has, on the end part side in the +Y direction, a portion overlapping a region between the adjacent first pressure chambers 12A of the first pressure chamber row 120A when viewed in the Z direction, the portion not overlapping the first pressure chamber row 120A when viewed in the X direction. The end part of the second-10 flow path 260 in the −Y direction extends to the outside of the region between the first pressure chambers 12A when viewed in the Z direction. In the present embodiment, the second-10 flow path 260 is provided at only a position overlapping a partition wall partitioning the first pressure chambers 12A from each other in the X direction when viewed in the Z direction.

Flow path portions 260*a* on the end part sides of the second-10 flow path 260 in the −Y direction are arranged side by side in the X direction with the first-10 flow path 220 of the first individual communication flow path 201A, interposed therebetween, corresponding to the first pressure chamber row 120A. In other words, the flow path portions 260*a* on the end part sides of the second-10 flow paths 260 in the −Y direction serve as first portions.

Flow path portions 260*b* on the end part sides of the second-10 flow paths 260 in the +Y direction are arranged side by side in the X direction without the first individual communication flow path 201A. The flow path portions 260*b* on the end part sides of the second-10 flow paths 260 in the +Y direction serve as second portions.

In the present embodiment, since the first-10 flow path 220 and the second-10 flow path 260 are provided to be open to the surface of the communication plate 15 in the −Z direction, it is not necessary to provide a flow path that is provided along the Y direction in the middle of the thickness of the communication plate 15 in the Z direction, and the communication plate 15 can be formed of a single substrate. Therefore, it is possible to reduce the number of components by simplifying a structure of the recording head 1 and thus to reduce cost.

In the present embodiment, since the nozzle plate 20 covers the openings of the first common liquid chamber 101 and the second common liquid chamber 102, and the nozzle plate 20 is provided with the compliance portions 494, as the individual flow path 200, flow paths coupling the first common liquid chamber 101 and the second common liquid chamber 102 to the nozzle 21, that is, the first-10 flow path 220 and the second-10 flow path 260 can be formed in the joint interface between the nozzle plate 20 and the communication plate 15. Therefore, it is possible to simplify a configuration of the individual flow path 200 and also to reduce a pressure loss. Since the first-10 flow path 220 and the second-10 flow path 260 that are flow paths making the first common liquid chamber 101 and the second common liquid chamber 102 communicate with the nozzles 21 are provided between the nozzle plate 20 and the communication plate 15, the communication plate 15 is formed of a single substrate without laminating a plurality of substrates. Therefore, a length of a flow path coupling the pressure chamber 12 to the nozzle 21 can be reduced by relatively reducing a thickness of the communication plate 15 in the Z direction. Consequently, flow path resistance of the flow path from the pressure chamber 12 to the nozzle 21 can be reduced, and thus it is possible to prevent a reduction in the weight of an ink droplet discharged from the nozzle 21.

Since it is not necessary to form the communication plate 15 by laminating a plurality of substrates, and the compliance substrate 49 is not required to be provided separately from the nozzle plate 20 unlike in Embodiment 1, it is possible to reduce cost by reducing the number of components.

Figure 19:
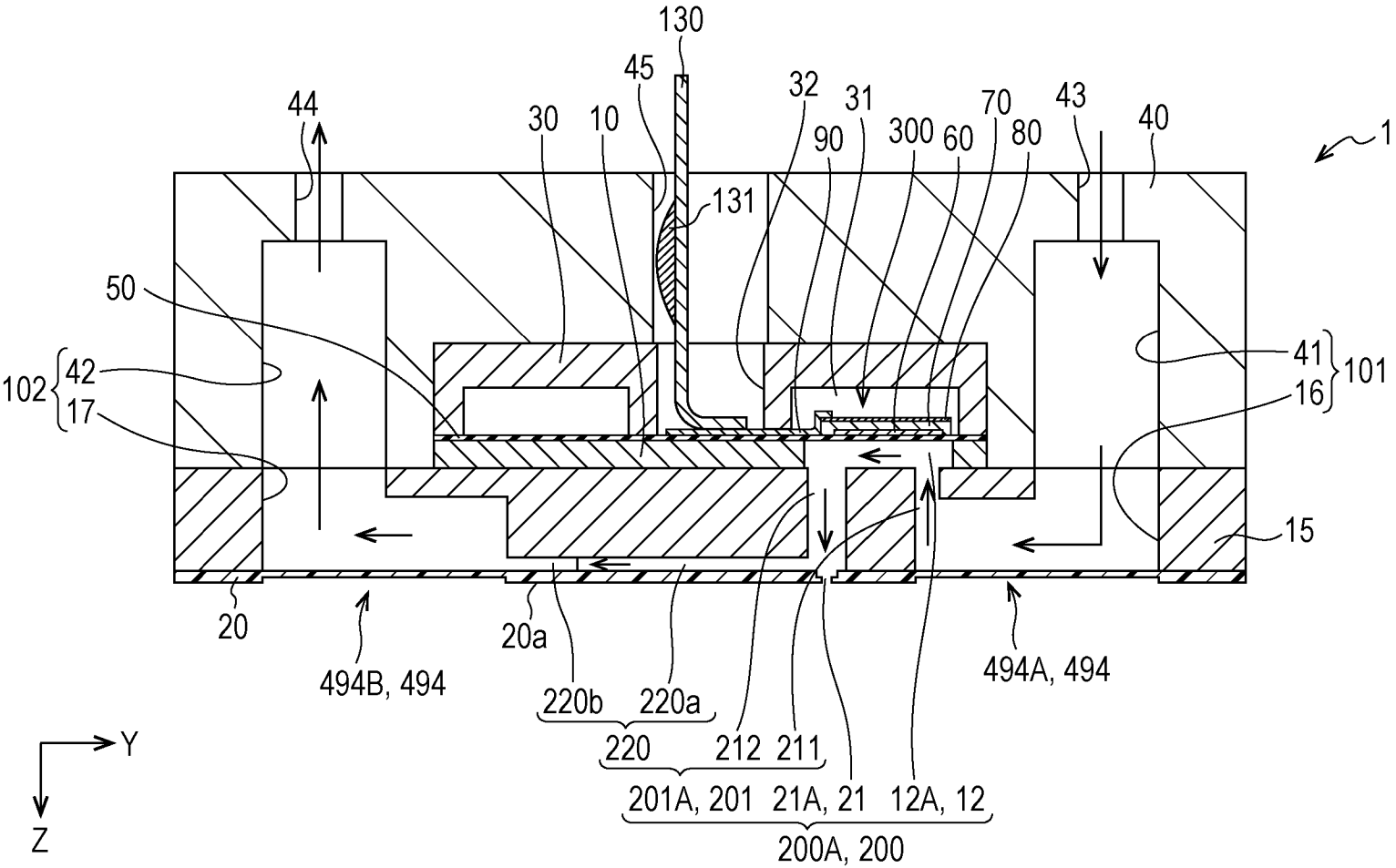
FIG. 19 is a sectional view illustrating a modification example of the recording head according to Embodiment 4.
Figure 20:
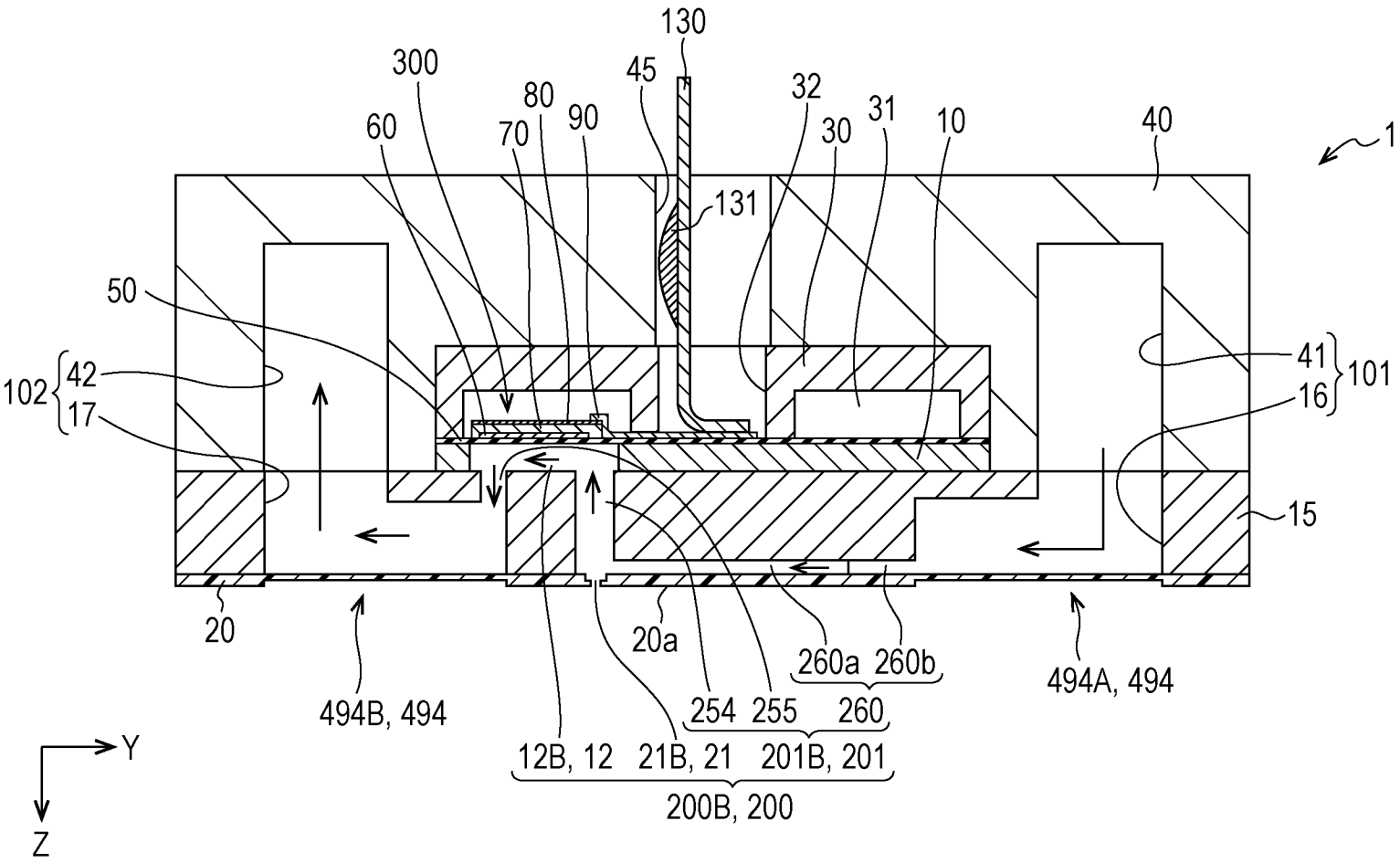
FIG. 20 is a sectional view illustrating the modification example of the recording head according to Embodiment 4.

In the above example, the nozzle plate 20 is made of a resin material such as polyimide, but is not particularly limited thereto. Here, a modification example of the nozzle plate will be described with reference to FIGS. 19 and 20. FIG. 19 is a sectional view illustrating a modification example of the recording head according to Embodiment 4, and is a sectional view taken along the line A-A in FIG. 1. FIG. 20 is a sectional view illustrating the modification example of the recording head according to Embodiment 4, and is a sectional view taken along the line B-B in FIG. 1.

As illustrated in FIGS. 19 and 20, the nozzle plate 20 is made of a metal material such as stainless steel having higher rigidity than that of a resin film, portions of the nozzle plate 20 forming the walls of the first common liquid chamber 101 and the second common liquid chamber 102 are thinner than remaining portions, and thus the compliance portions 494 are provided at the nozzle plate 20. In other words, regions respectively corresponding to the first common liquid chamber 101 and the second common liquid chamber 102 of the nozzle plate 20 are thinner than a region in which the nozzle 21 is formed. Consequently, the first compliance portion 494A having lower rigidity than that of the region in which the nozzle 21 is formed is formed at the portion of the nozzle plate 20 corresponding to the first common liquid chamber 101, and the second compliance portion 494B having lower rigidity than that of the region in which the nozzle 21 is formed is formed at the portion of the nozzle plate 20 corresponding to second common liquid chamber 102. As mentioned above, even though the nozzle plate 20 is made of relatively high rigidity, the portions closing the first common liquid chamber 101 and the second common liquid chamber 102 are thinned to be easily deformed, and the compliance portions 494 can be easily formed at parts of the walls of the first common liquid chamber 101 and the second common liquid chamber 102.

Figure 21:
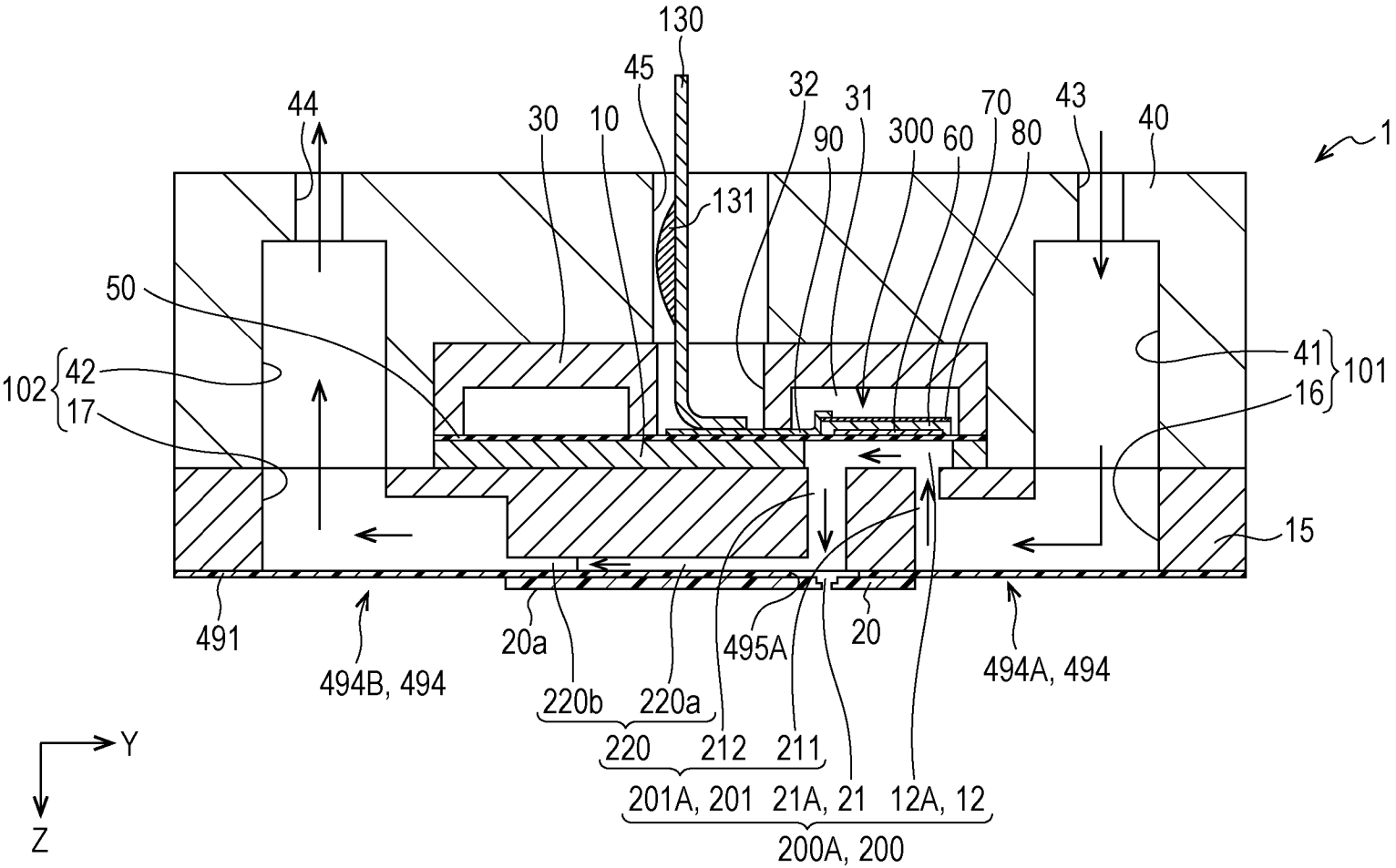
FIG. 21 is a sectional view illustrating a modification example of the recording head according to Embodiment 4.
Figure 22:
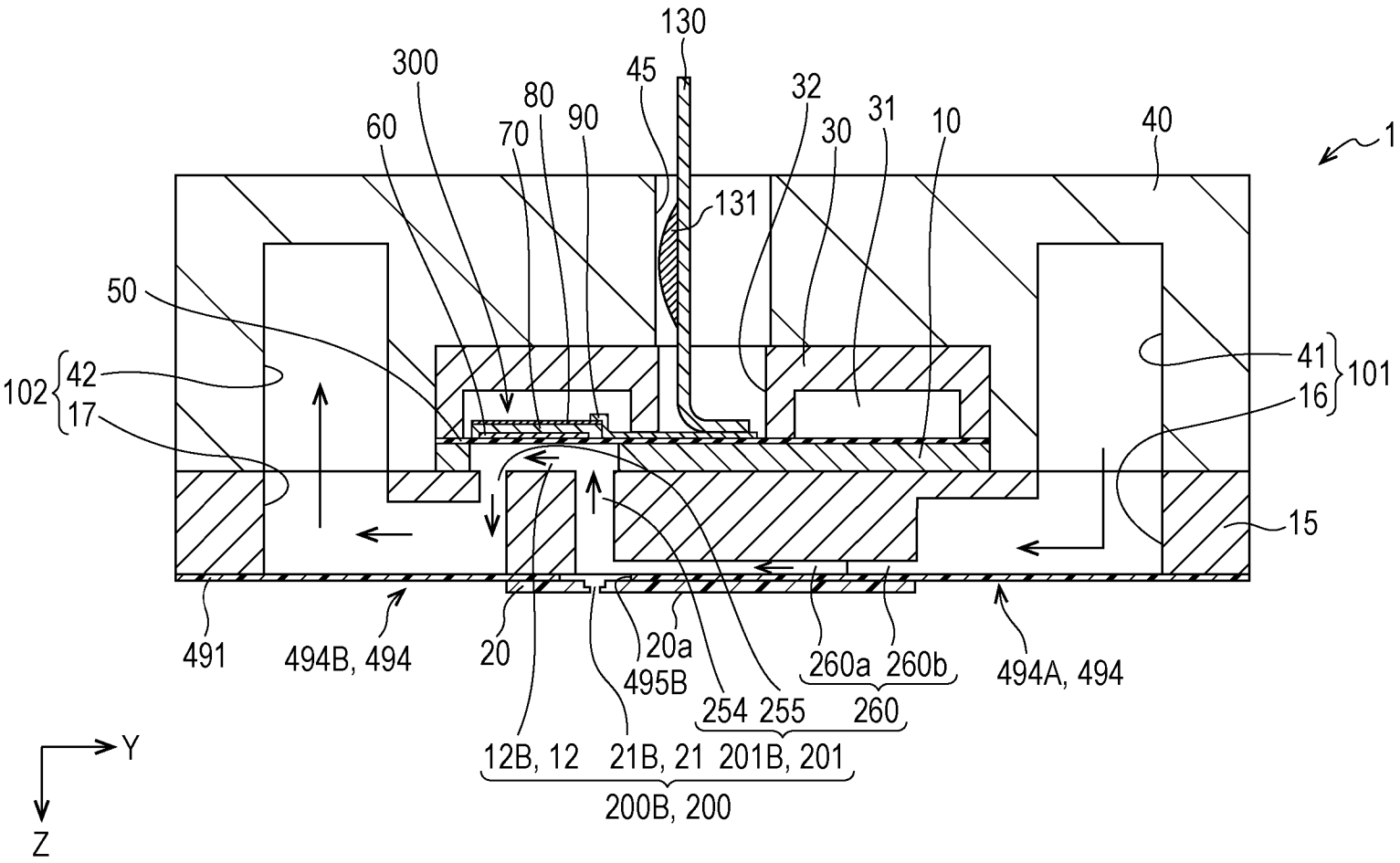
FIG. 22 is a sectional view illustrating the modification example of the recording head according to Embodiment 4.

The sealing film 491 may be provided between the communication plate 15 and the nozzle plate 20. Such an example will be described with reference to FIGS. 21 and 22. FIG. 21 is a sectional view illustrating a modification example of the recording head according to Embodiment 4, and is a sectional view taken along the line A-A in FIG. 1. FIG. 22 is a sectional view illustrating the modification example of the recording head according to Embodiment 4, and is a sectional view taken along the line B-B in FIG. 1.

As illustrated in FIGS. 21 and 22, the nozzle plate 20 is provided to have a size not covering the openings of the surfaces of the first common liquid chamber 101 and the second common liquid chamber 102 in the Z direction, the surfaces in the Z direction to which the first common liquid chamber 101 and the second common liquid chamber 102 are open, that is, the surfaces toward the nozzle plate 20 in the Z direction are sealed with the sealing film 491. In other words, the sealing film 491 and the nozzle plate 20 are laminated in this order on the surface of the communication plate 15 in the Z direction. Since the nozzle plate 20 is provided to have the size not covering the openings of the surfaces of the first common liquid chamber 101 and the second common liquid chamber 102 in the Z direction, the openings of the surfaces of the first common liquid chamber 101 and the second common liquid chamber 102 in the Z direction are the compliance portions 494, that is, the first compliance portion 494A and the second compliance portion 494B sealed with only the sealing film 491. As illustrated in FIG. 21, a first opening 495A larger than the first nozzle 21A is provided in the portion making the first nozzle 21A and the first-2 flow path 212 communicate with each other, and does not hinder a flow of ink directed from the first-2 flow path 212 toward the first nozzle 21A. As long as the first opening 495A is provided to have an opening area larger than that of the first nozzle 21A, the first opening 495A may be larger than the first-2 flow path 212, and may be smaller than the first-2 flow path 212. Similarly, as illustrated in FIG. 22, a second opening 495B larger than the second nozzle 21B is provided in the portion making the second nozzle 21B and the second-4 flow path 254 communicate with each other, and does not hinder a flow of ink directed from the second-4 flow path 254 toward the second nozzle 21B. As long as the second opening 495B is provided to have an opening area larger than that of the second nozzle 21B, the second opening 495B may be larger than the second-4 flow path 254, and may be smaller than the second-4 flow path 254.

Even in this configuration, the individual flow path 200, that is, the first-10 flow path 220 and the second-10 flow path 260 can be formed between the sealing film 491 and the communication plate 15, and thus a structure of the individual flow path 200 can be simplified, it is not necessary to manufacture the communication plate 15 by laminating a plurality of substrates, and the communication plate 15 can be manufactured by using a single substrate. An area of the nozzle plate 20 can be reduced, and thus it is possible to reduce cost.

Embodiment 5

Figure 23:
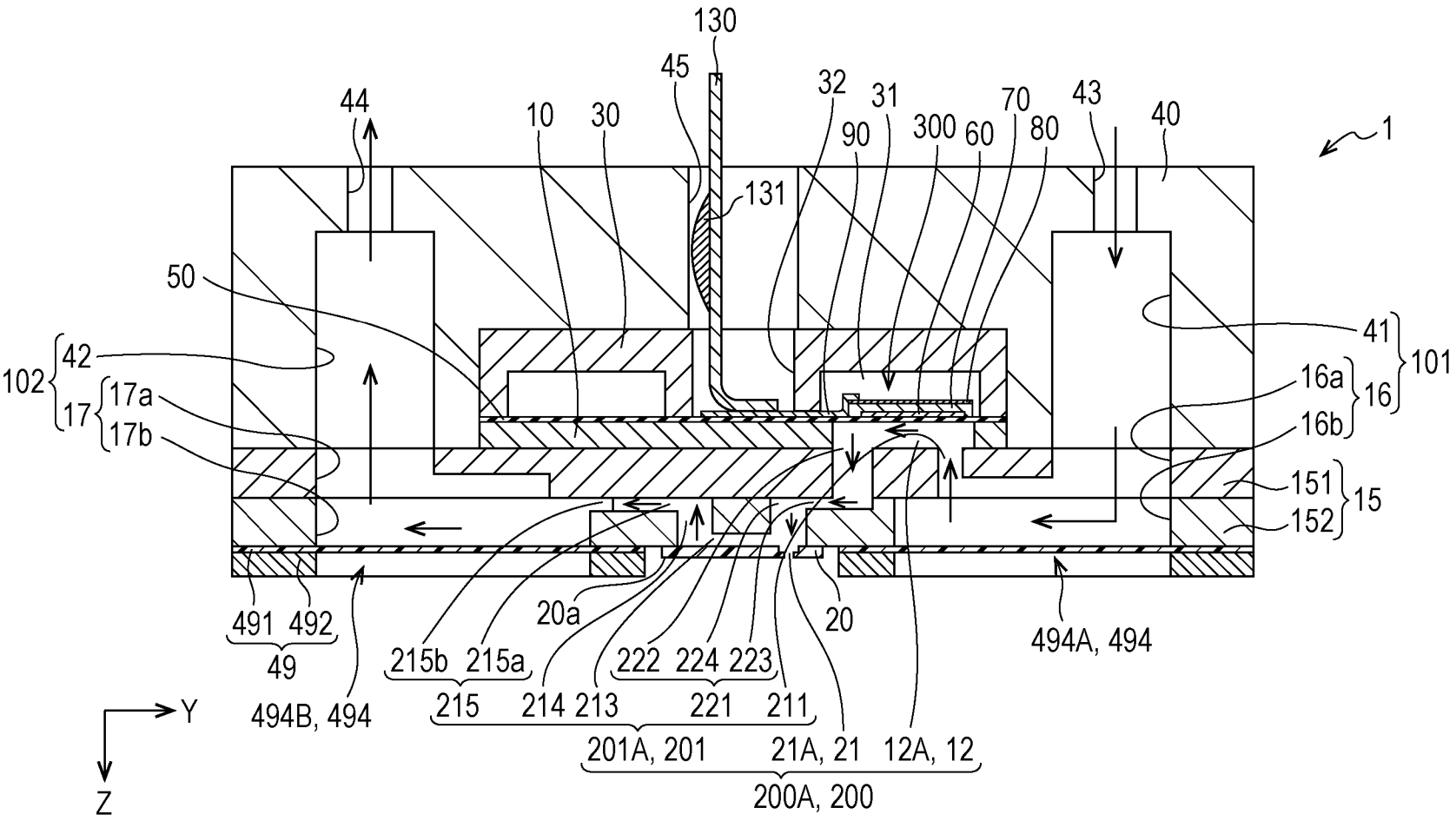
FIG. 23 is a sectional view illustrating a recording head according to Embodiment 5.
Figure 24:
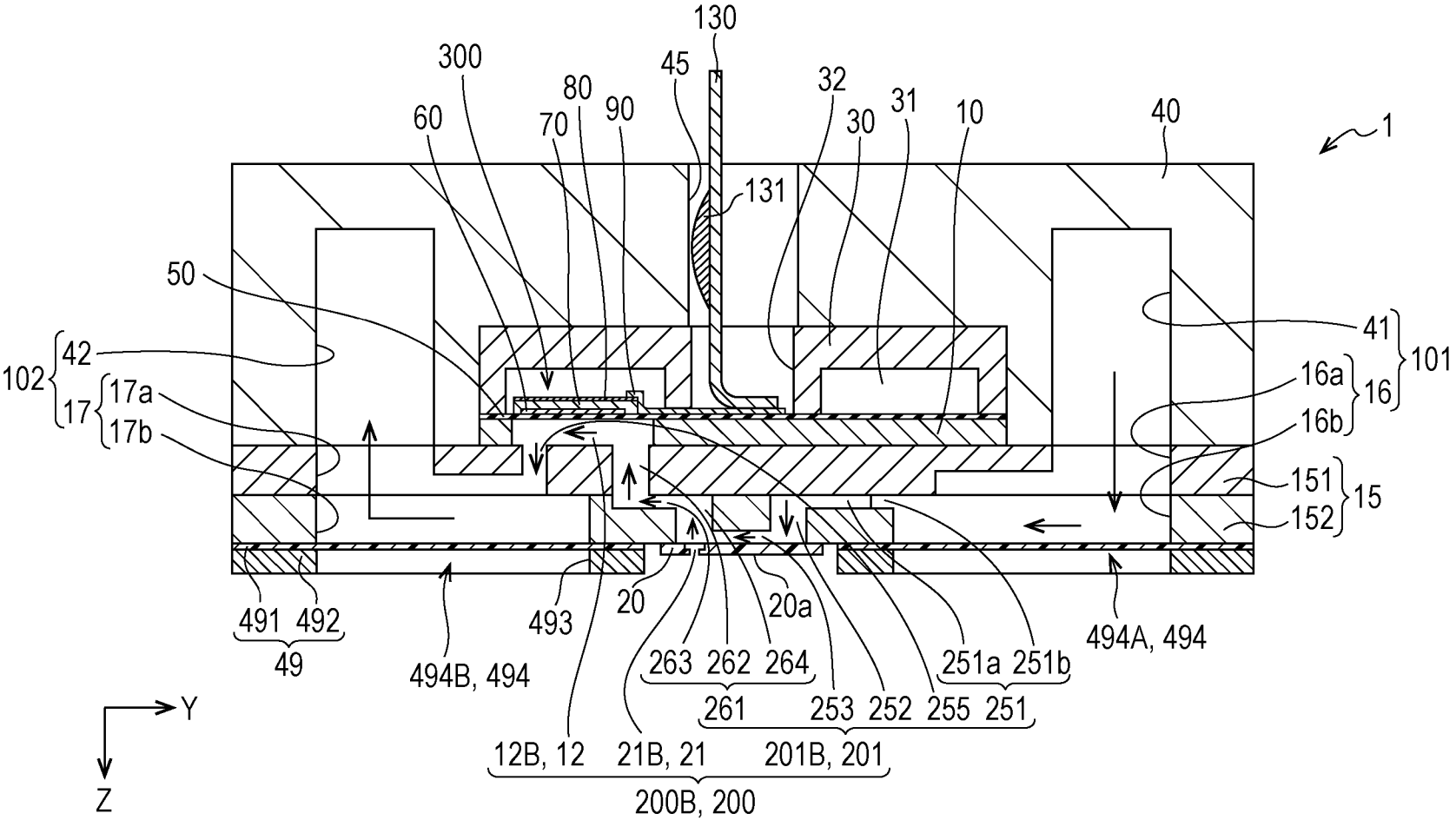
FIG. 24 is a sectional view illustrating the recording head according to Embodiment 5.

FIG. 23 is a sectional view taken along the A-A in FIG. 1, illustrating an ink jet recording head that is an example of a liquid ejecting head according to Embodiment 5 of the present disclosure. FIG. 24 is a sectional view taken along the line B-B in FIG. 1, illustrating the ink jet recording head according to Embodiment 5. The same member as in the embodiments is given the same reference numeral, and repeated description will be omitted.

As illustrated in FIGS. 23 and 24, the flow path formation substrate 10, the communication plate 15, the nozzle plate 20, the compliance substrate 49, and the case member 40 forming a flow path substrate are provided with a plurality of individual flow paths 200 each provided for the first common liquid chamber 101, the second common liquid chamber 102, and the nozzle 21.

The first communication portion 16 forming the first common liquid chamber 101 has a first narrow section 16*a* provided in the −Z direction and a first wide section 16*b* provided in the Z direction.

The first narrow section 16*a* is provided at the end part of the first communication plate 151 in the +Z direction to be open to the surface of the first communication plate 151 in the +Z direction, and the first wide section 16*b* is provided in the second communication plate 152.

The first narrow section 16*a* and the first wide section 16*b* are provided to have the same width in the X direction, and the first wide section 16*b* is formed to be wider than the first narrow section 16*a* in the Y direction. The first wide section 16*b* is provided to be wider than the first narrow section 16*a* in the −Y direction. In other words, the end part of the first wide section 16*b* in the +Y direction is provided at the same position as the first narrow section 16*a*, and the end part of the first wide section 16*b* in the −Y direction is disposed further outward in the −Y direction than the first narrow section 16*a*.

The second communication portion 17 forming the second common liquid chamber 102 has a second narrow section 17*a* provided in the −Z direction and a second wide section 17*b* provided in the Z direction.

The second narrow section 17*a* is provided at the end part of the first communication plate 151 in the +Z direction to be open to the surface of the first communication plate 151 in the +Z direction, and the second wide section 17*b* is provided in the second communication plate 152.

The second narrow section 17*a* and the second wide section 17*b* are provided to have the same width in the X direction, and the second wide section 17*b* is formed to be wider than the second narrow section 17*a* in the Y direction. The second wide section 17*b* is provided to be wider than the second narrow section 17*a* in the +Y direction. In other words, the end part of the second wide section 17*b* in the −Y direction is provided at the same position as the second narrow section 17*a*, and the end part of the second wide section 17*b* in the +Y direction is disposed further outward in the +Y direction than the second narrow section 17*a*.

The openings of the surfaces of the first common liquid chamber 101 and the second common liquid chamber 102 in the Z direction are covered with the compliance substrate 49. An opening area of the first wide section 16*b* of the first common liquid chamber 101 covered with the compliance substrate 49 is larger than an opening area of the first narrow section 16*a*. Therefore, it is possible to increase an area of the first compliance portion 494A by providing the first compliance portion 494A for a relatively large opening area of the first wide section 16*b* compared with a case where the first compliance portion 494A is provided for an opening area of the first narrow section 16*a*.

Similarly, an opening area of the second wide section 17*b* of the second common liquid chamber 102 covered with the compliance substrate 49 is larger than an opening area of the second narrow section 17*a*. Therefore, it is possible to increase an area of the second compliance portion 494B by providing the second compliance portion 494B for a relatively large opening area of the second wide section 17*b* compared with a case where the second compliance portion 494B is provided for an opening area of the second narrow section 17*a*.

As mentioned above, it is possible to improve reactivity of deformation of the compliance portions 494 corresponding to pressure changes of ink in the first common liquid chamber 101 and the second common liquid chamber 102 by relatively increasing areas of the compliance portions 494 covering the first common liquid chamber 101 and the second common liquid chamber 102, and thus a discharge cycle of an ink droplet can be shortened such that high speed printing can be realized.

The flow path formation substrate 10, the communication plate 15, the nozzle plate 20, and the compliance substrate 49 forming a flow path substrate are provided with a plurality of individual flow paths 200 each provided for the first common liquid chamber 101, the second common liquid chamber 102, and the nozzle 21.

In the present embodiment, the individual flow path has the first individual flow path 200A communicating with the first nozzle 21A and the second individual flow path 200B communicating with the second nozzle 21B.

The individual flow path 200 includes the first individual flow path 200A having the first nozzle 21A, the first pressure chamber 12A, and the first individual communication flow path 201A as illustrated in FIG. 23, and the second individual flow path 200B having the second nozzle 21B, the second pressure chamber 12B, and the second individual communication flow path 201B as illustrated in FIG. 24.

As illustrated in FIG. 23, the first individual communication flow path 201A has a first-1 flow path 211, a first-11 flow path 221, a first-3 flow path 213, a first-4 flow path 214, and a first-5 flow path 215.

The first-1 flow path 211, the first-3 flow path 213, the first-4 flow path 214, and the first-5 flow path 215 of the present embodiment are the same as those of the embodiments, and thus repeated description will be omitted.

The first-11 flow path 221 is formed such that an opening thereof in the +Z direction is located further in the −Y direction than an opening thereof in the −Z direction.

Here, the first-11 flow path 221 being formed such that the opening thereof in the +Z direction is located further in the −Y direction than the opening thereof in the −Z direction indicates that the opening of the first-11 flow path 221 in the +Z direction is disposed at a position deviated further in the −Y direction than the opening of the first-11 flow path 221 in the −Z direction when viewed in the Z direction. When viewed in the Z direction, the opening of the first-11 flow path 221 in the +Z direction and the opening of the first-11 flow path 221 in the −Z direction may partially overlap each other, but this excludes that one of the opening of the first-11 flow path 221 in the +Z direction and the opening of the first-11 flow path 221 in the −Z direction completely overlaps the other.

Specifically, the first-11 flow path 221 includes a first-12 flow path 222, a first-13 flow path 223, and a first-14 flow path 224.

The first-12 flow path 222 is provided to penetrate through the first communication plate 151 in the Z direction such that one end thereof in the −Z direction communicates with the end part of the first pressure chamber 12A in the −Y direction.

The first-13 flow path 223 communicates with the other end of the first-12 flow path 222 in the +Z direction, and extends along the Y direction between the first communication plate 151 and the second communication plate 152. In the present embodiment, the first-13 flow path 223 is formed by providing a recess in the surface of the second communication plate 152 in the −Z direction and covering an opening of the recess of the second communication plate 152 with the first communication plate 151. Of course, the first-13 flow path 223 is not particularly limited thereto, and may be formed by providing a recess in the first communication plate 151, and may be formed by providing recesses in both of the first communication plate 151 and the second communication plate 152.

The first-14 flow path 224 is provided to penetrate through the second communication plate 152 in the Z direction to communicate with the end part of the first-13 flow path 223 in the −Y direction.

As mentioned above, since the first-13 flow path 223 extending along the Y direction in the middle of the first-11 flow path 221 is provided, the first-14 flow path 224 can be moved to a separate position in the −Y direction with respect to the first-12 flow path 222. The first-14 flow path 224 is moved in the −Y direction, and thus the first wide section 16*b* of the first common liquid chamber 101 can be made wider in the −Y direction than the first narrow section 16*a*. When the opening of the surface of the first common liquid chamber 101 in the Z direction is increased in the +Y direction in order to increase an area of the first compliance portion 494A, the communication plate 15 becomes large-sized in the Y direction. In the present embodiment, since the opening of the first-11 flow path 221 in the +Z direction is disposed further in the −Y direction than the opening thereof in the −Z direction, the opening of the first common liquid chamber 101 in the +Z direction can be widened in the −Y direction. Therefore, the communication plate 15 can be suppressed from becoming large-sized in the Y direction, and an area of the first compliance portion 494A can be increased.

The first-4 flow path 214 of the present embodiment is disposed to be moved to the +Y direction by the second wide section 17*b* provided in the second common liquid chamber 102. Thus, the first-4 flow path 214 of the present embodiment is disposed at a position not overlapping a partition wall that is a region between the adjacent second pressure chambers 12B of the second pressure chamber row 120B when viewed in the Z direction.

In other words, in the present embodiment, the first individual communication flow path 201A has the first-5 flow path 215 as a portion that overlaps the region between the adjacent second pressure chambers 12B of the second pressure chamber row 120B when viewed in the Z direction and does not overlap the second pressure chamber row 120B when viewed in the X direction.

The first-13 flow paths 223 and the first-14 flow paths 224 of the first-11 flow paths 221 are arranged side by side in the X direction with the second-1 flow paths 251 and the second-2 flow paths 252 of the second individual communication flow paths 201B, respectively interposed therebetween, corresponding to the second pressure chamber row 120B which will be described later in detail. In other words, the first-13 flow paths 223 and the first-14 flow paths 224 serve as first portions.

The first-12 flow paths 222 of the first-11 flow paths 221 are arranged side by side in the X direction without the second individual communication flow path 201B which will be described later in detail interposed therebetween. In other words, the first-12 flow paths 222 serve as second portions.

Flow path portions 215*a* on the end part sides of the first-5 flow paths 215 in the +Y direction serve as first portions arranged side by side in the X direction with a second-13 flow path 263 of the second individual communication flow path 201B interposed therebetween.

Flow path portions 215*b* on the end part sides of the first-5 flow paths 215 in the −Y direction serve as second portions arranged side by side in the X direction without the second individual communication flow path 201B interposed therebetween.

In other words, the first individual communication flow path 201A has the first-1 flow paths 211, the first-13 flow paths 223, the first-14 flow paths 224, the first-3 flow paths 213, the first-4 flow paths 214, and the flow path portion 215*a* on the end part side of the first-5 flow path 215 in the +Y direction as the first portions.

The first individual communication flow path 201A has the flow path portion 215*b* on the end part side of the first-5 flow path 215 in the −Y direction and the first-12 flow path 222 as the second portions.

As illustrated in FIG. 24, the second individual communication flow path 201B has a second-1 flow path 251, a second-2 flow path 252, a second-3 flow path 253, a second-11 flow path 261, and a second-5 flow path 255.

The second-1 flow path 251, the second-2 flow path 252, the second-3 flow path 253, and the second-5 flow path 255 of the present embodiment are the same as those of the embodiments, and thus repeated description will be omitted.

The second-11 flow path 261 is formed such that an opening thereof in the +Z direction is located further in the +Y direction than an opening thereof in the −Z direction.

Here, the second-11 flow path 261 being formed such that the opening thereof in the +Z direction is located further in the +Y direction than the opening thereof in the −Z direction indicates that the opening of the second-11 flow path 261 in the +Z direction is disposed at a position deviated further in the +Y direction than the opening of the second-11 flow path 261 in the −Z direction when viewed in the Z direction. When viewed in the Z direction, the opening of the second-11 flow path 261 in the +Z direction and the opening of the second-11 flow path 261 in the −Z direction may partially overlap each other, but this excludes that one of the opening of the second-11 flow path 261 in the +Z direction and the opening of the second-11 flow path 261 in the −Z direction completely overlaps the other.

Specifically, the second-11 flow path 261 includes a second-12 flow path 262, a second-13 flow path 263, and a second-14 flow path 264.

The second-12 flow path 262 is provided to penetrate through the first communication plate 151 in the Z direction such that one end thereof in the −Z direction communicates with the end part of the second pressure chamber 12B in the +Y direction.

The second-13 flow path 263 communicates with the other end of the second-12 flow path 262 in the +Z direction, and extends along the Y direction between the first communication plate 151 and the second communication plate 152. In the present embodiment, the second-13 flow path 263 is formed by providing a recess in the surface of the second communication plate 152 in the −Z direction and covering an opening of the recess of the second communication plate 152 with the first communication plate 151. Of course, the second-13 flow path 263 is not particularly limited thereto, and may be formed by providing a recess in the first communication plate 151, and may be formed by providing recesses in both of the first communication plate 151 and the second communication plate 152.

The second-14 flow path 264 is provided to penetrate through the second communication plate 152 in the Z direction to communicate with the end part of the second-13 flow path 263 in the +Y direction.

As mentioned above, since the second-13 flow path 263 extending along the Y direction in the middle of the second-11 flow path 261 is provided, the second-14 flow path 264 can be moved to a separate position in the +Y direction with respect to the second-12 flow path 262. The second-14 flow path 264 is moved in the +Y direction, and thus the second wide section 17*b* of the second common liquid chamber 102 can be made wider in the +Y direction than the second narrow section 17*a*. When the opening of the surface of the second common liquid chamber 102 in the +Z direction is increased in the −Y direction in order to increase an area of the second compliance portion 494B, the communication plate 15 becomes large-sized in the Y direction. In the present embodiment, since the opening of the second-11 flow path 261 in the Z direction is disposed further in the +Y direction than the opening thereof in the −Z direction, the opening of the second common liquid chamber 102 in the +Z direction can be widened in the +Y direction. Therefore, the communication plate 15 can be suppressed from becoming large-sized in the Y direction, and an area of the second compliance portion 494B can be increased.

The second-2 flow path 252 of the present embodiment is disposed to be moved to the −Y direction by the first wide section 16*b* provided in the first common liquid chamber 101. Thus, the second-2 flow path 252 of the present embodiment is disposed at a position not overlapping a partition wall that is a region between the adjacent first pressure chamber 12A of the first pressure chamber row 120A when viewed in the Z direction.

In other words, in the present embodiment, the second individual communication flow path 201B has the second-1 flow path 251 as a portion that overlaps the region between the adjacent first pressure chamber 12A of the first pressure chamber row 120A when viewed in the Z direction and does not overlap the first pressure chamber row 120A when viewed in the X direction.

The second-13 flow paths 263 and the second-14 flow paths 264 are arranged side by side in the X direction with the first-5 flow path 215 and the first-4 flow paths 214 of the first individual communication flow path 201A, respectively interposed therebetween, corresponding to the first pressure chamber row 120A. In other words, the second-13 flow paths 263 and the second-14 flow paths 264 serve as the first portions.

The second-12 flow paths 262 of the second-11 flow paths 261 are arranged side by side in the X direction without the first individual communication flow paths 201A. In other words, the second-12 flow paths 262 serve as the second portions.

Flow path portions 251*a* on the end part sides of the second-11 flow path 251 in the −Y direction serve as first portions arranged side by side in the X direction with the first-13 flow paths 223 of the first individual communication flow path 201A interposed therebetween.

Flow path portions 251*b* on the end part sides of the second-11 flow path 251 in the +Y direction serve as second portions arranged side by side in the X direction without the first individual communication flow path 201A interposed therebetween.

In other words, the second individual communication flow path 201B has the flow path portion 251*a* on the end part side of the second-1 flow path 251 in the −Y direction, the second-2 flow path 252, the second-3 flow path 253, the second-14 flow path 264, and the second-13 flow path 263 as the first portions.

The second individual communication flow path 201B has the flow path portion 251*b* on the end part side of the second-1 flow path 251 in the +Y direction and the second-5 flow path 255 as the second portions.

In the present embodiment, in the first individual communication flow path 201A, a local flow path extending in the Z direction has the first portion and the second portion. In other words, as described above, in the first individual communication flow path 201A, the first-14 flow path 224 extending in the Z direction serves as the first portion, and the first-12 flow path 222 extending in the Z direction serves as the second portion. Thus, in the present embodiment, the first-14 flow path 224 and the first-12 flow path 222 correspond to such local flow paths.

In the present embodiment, in same manner for the second individual communication flow path 201B, a local flow path extending in the Z direction has the first portion and the second portion. In other words, in the second individual communication flow path 201B, the second-14 flow path 264 extending in the Z direction serves as the first portion, and the second-12 flow path 262 extending in the Z direction serves as the second portion.

In the present embodiment, in the first individual communication flow path 201A, a local flow path coupling the first pressure chamber 12A to the first nozzle 21A has at least the second portion. In other words, in the present embodiment, the first-11 flow path 221 is a local flow path coupling the first pressure chamber 12A to the first nozzle 21A, and the first-12 flow paths 222 of the first-11 flow paths 221 serve as the second portions arranged side by side in the X direction without the second individual communication flow path 201B interposed therebetween.

In the present embodiment, in the same manner for the second individual communication flow path 201B, a local flow path coupling the second pressure chamber 12B to the second nozzle 21B has at least the second portion. In other words, in the second individual communication flow path 201B, the second-11 flow path 261 is a local flow path coupling the second pressure chamber 12B to the second nozzle 21B, and the second-12 flow paths 262 of the second-11 flow paths 261 serve as the second portions arranged side by side in the X direction without the first individual communication flow path 201A interposed therebetween.

In the present embodiment, as illustrated in FIG. 23, a step difference is provided in the first common liquid chamber 101 by the first narrow section 16*a* and the first wide section 16*b*, and thus an air bubble tends to stay at the step difference. However, in the present embodiment, as illustrated in FIG. 24, the second-1 flow path 251 of the second individual flow path 200B is open to the step difference portion, and thus an air bubble staying at the step difference is discharged to the second common liquid chamber 102 via the second individual flow path 200B. Therefore, it is possible to prevent an air bubble from staying in the first common liquid chamber 101, and thus to suppress defective supply of ink to the pressure chamber 12 due to growing of the air bubble in the first common liquid chamber 101 or defective discharge of an ink droplet due to flowing of ink into the pressure chamber 12 at an unexpected timing.

Although a step difference is also provided in the second common liquid chamber 102 by the second narrow section 17*a* and the second wide section 17*b*, an air bubble at the step difference is moved toward the outlet 44 due to flowing of ink in the second common liquid chamber 102, and thus it is possible to prevent the air bubble from growing in the second common liquid chamber 102 or from flowing into the pressure chamber 12.

As mentioned above, since the first-14 flow path 224 and the second-14 flow path 264 that are communication paths making the pressure chambers 12 and the nozzles 21 communicate with each other are disposed to be close to each other in the Y direction, it is possible to widen the first common liquid chamber 101 and the second common liquid chamber 102 so as to increase areas of the surfaces thereof in the Z direction without increasing a size of the communication plate 15 in the Y direction, and the compliance portions 494 can be formed to have a large area. Thus, a pressure change of ink in the individual flow path 200 can be absorbed by the compliance portions 494 of the first common liquid chamber 101 and the second common liquid chamber 102. Therefore, it is possible to reduce variations in discharge characteristics of ink droplets and thus to stabilize discharge of an ink droplet.

Figure 25:
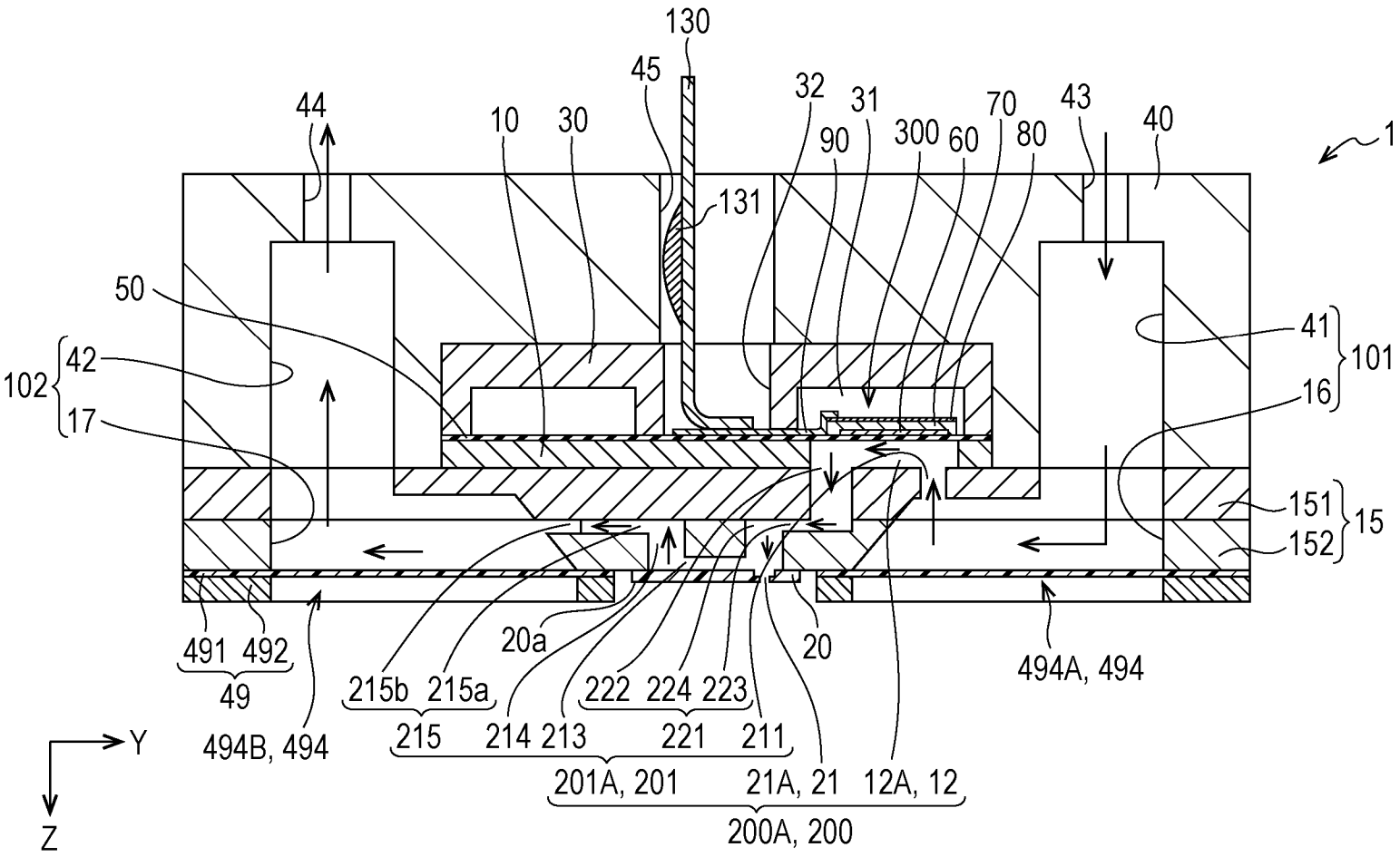
FIG. 25 is a sectional view illustrating a modification example of the recording head according to Embodiment 5.
Figure 26:
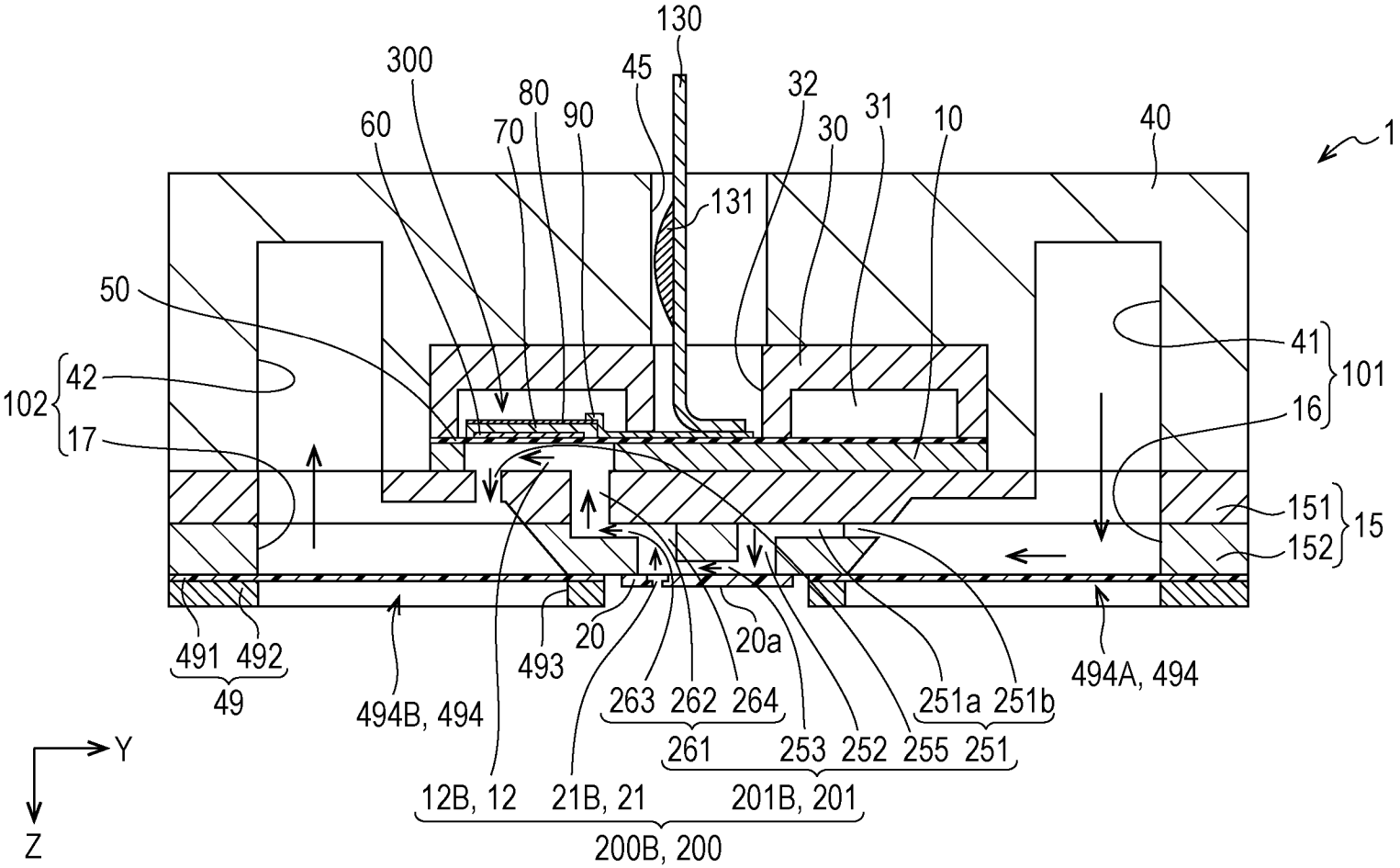
FIG. 26 is a sectional view illustrating the modification example of the recording head according to Embodiment 5.

In the present embodiment, the first communication portion 16 of the first common liquid chamber 101 has the first narrow section 16*a* and the first wide section 16*b*, and thus an opening area on the nozzle 21 side of the first common liquid chamber 101 is larger than an opening area on the flow path formation substrate 10 side, but there is no particular limitation thereto. Here, a modification example of the first common liquid chamber 101 and the second common liquid chamber 102 will be described with reference to FIGS. 25 and 26. FIG. 25 is a sectional view illustrating a modification example of the recording head according to Embodiment 5, and is a sectional view taken along the line A-A in FIG. 1. FIG. 26 is a sectional view illustrating the modification example of the recording head according to Embodiment 5, and is a sectional view taken along the line B-B in FIG. 1.

As illustrated in FIGS. 25 and 26, the side surface of the first communication portion 16 of the first common liquid chamber 101 in the −Y direction is provided to be inclined such that the end part thereof in the +Z direction is located further in the −Y direction than the end part thereof in the −Z direction.

Similarly, the side surface of the second communication portion 17 of the second common liquid chamber 102 in the +Y direction is provided to be inclined such that the end part thereof in the +Z direction is located further in the +Y direction than the end part thereof in the −Z direction.

Even in this configuration, as described above, opening areas of the openings of the surfaces of the first common liquid chamber 101 and the second common liquid chamber 102 in the Z direction can be increased, and thus the compliance portions 494 can be formed to have a relatively large area. The side surface of the first common liquid chamber 101 is inclined instead of being provided with a step difference, and thus it is possible to prevent an air bubble from staying at the step difference. Of course, such an inclined side surface may be applied to only the side surfaces of the first wide section 16*b* and the second wide section 17*b* illustrated in FIGS. 23 and 24.

Figure 27:
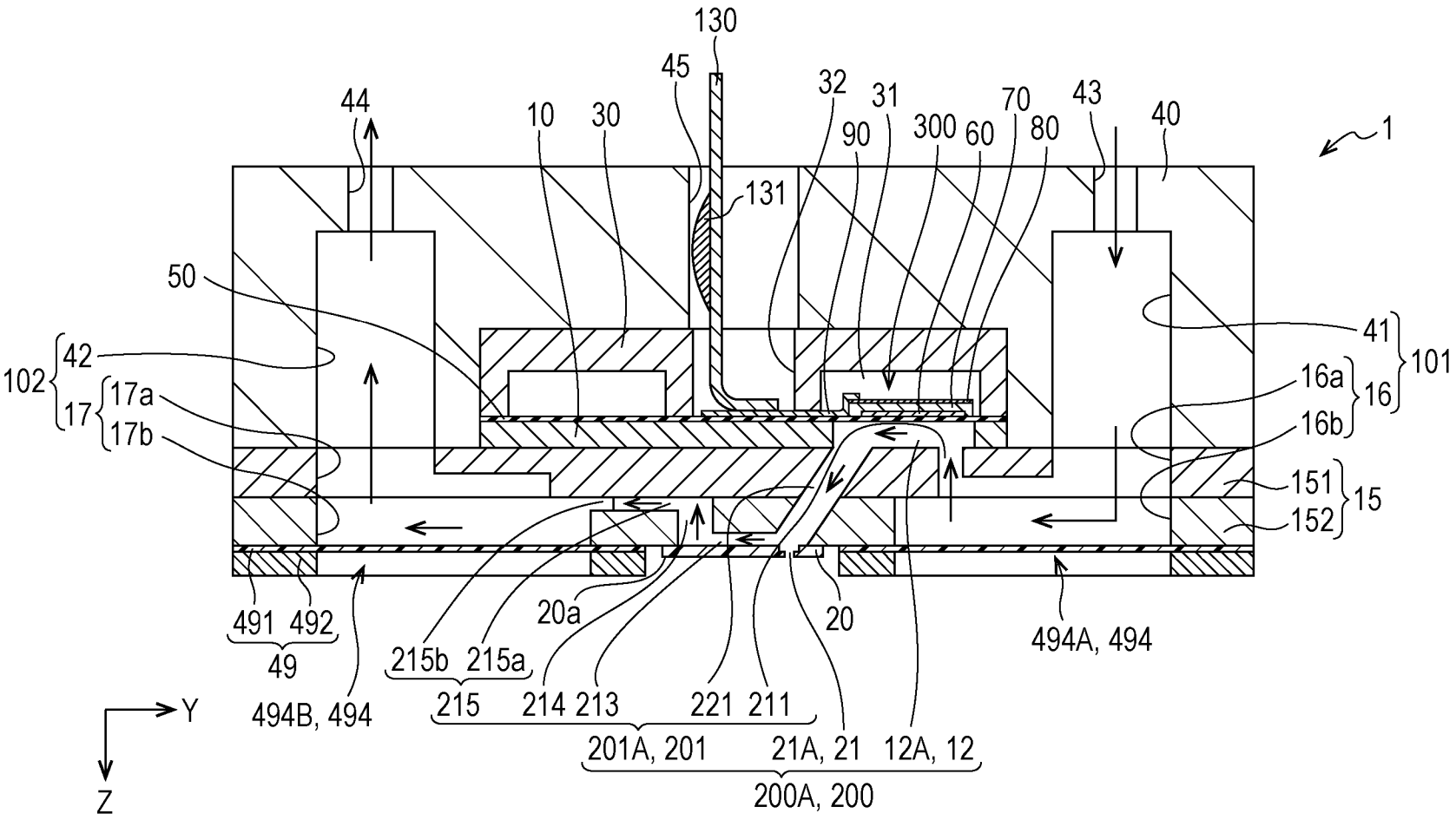
FIG. 27 is a sectional view illustrating a modification example of the recording head according to Embodiment 5.
Figure 28:
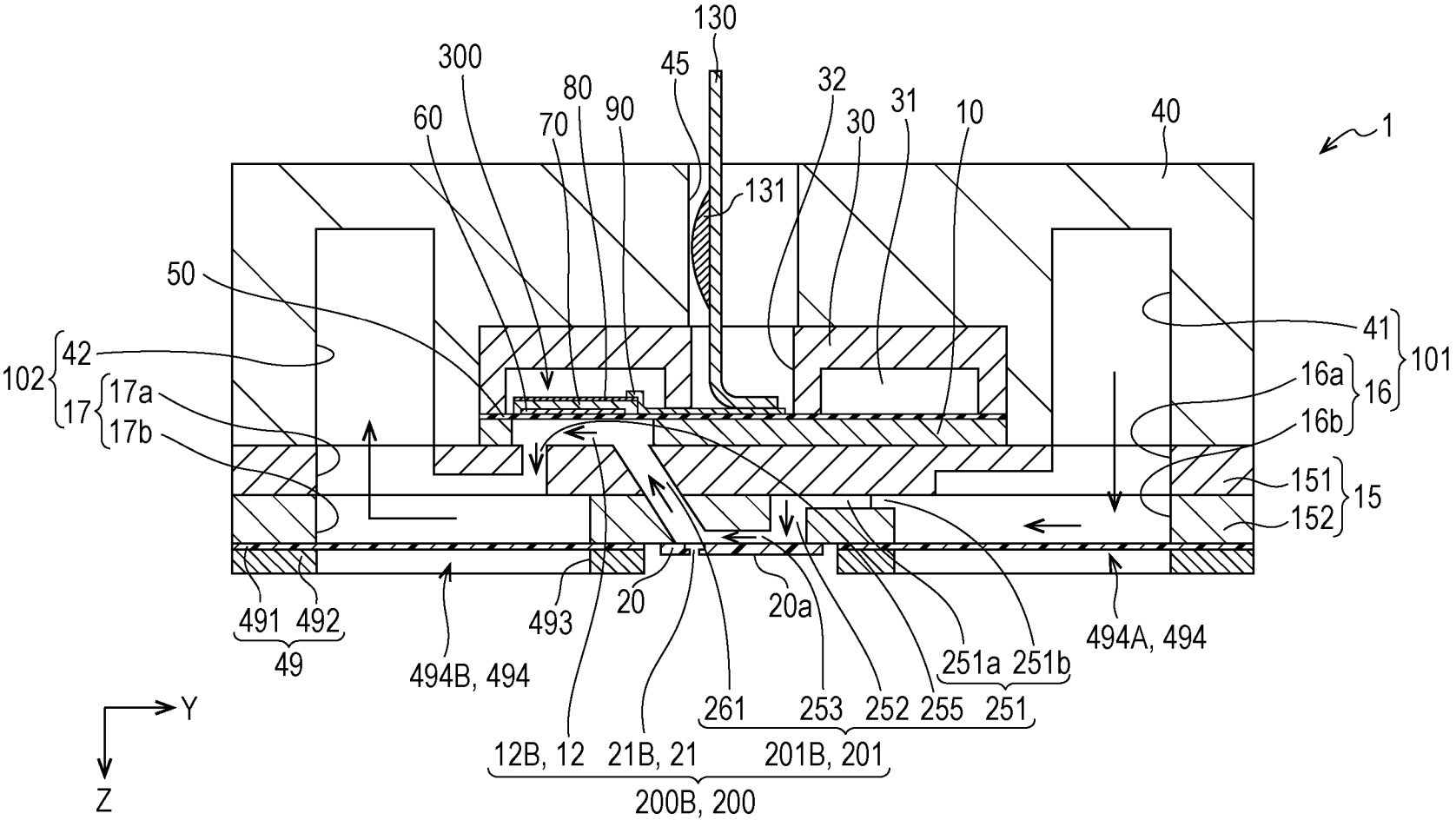
FIG. 28 is a sectional view illustrating the modification example of the recording head according to Embodiment 5.

In the present embodiment, the first-13 flow path 223 and the second-13 flow path 263 provided along the Y direction are respectively provided in the middles of the first-11 flow path 221 and the second-11 flow path 261, and thus the openings of the surfaces of the first-11 flow path 221 and the second-11 flow path 261 in the Z direction are moved further toward positions close to the nozzles 21 in the Y direction than the openings of the surfaces thereof in the −Z direction, but there is no particular limitation thereto. Hereinafter, a description will be made of a modification example of the first-11 flow path 221 and the second-11 flow path 261 with reference to FIGS. 27 and 28. FIG. 27 is a sectional view illustrating a modification example of the recording head according to Embodiment 5, and is a sectional view taken along the line A-A in FIG. 1. FIG. 28 is a sectional view illustrating the modification example of the recording head according to Embodiment 5, and is a sectional view taken along the line B-B in FIG. 1.

As illustrated in FIG. 27, the first-11 flow path 221 is provided to be inclined with respect to the Z direction. Specifically, the first-11 flow path 221 is provided to be inclined such that the end part thereof in the +Z direction communicating with the first nozzle 21A is located further in the −Y direction than the end part thereof in the −Z direction communicating with the first pressure chamber 12A. Consequently, the opening of the surface of the first common liquid chamber 101 in the +Z direction can be widened in the −Y direction, and thus the first compliance portion 494A can be formed to have a relatively large area.

As illustrated in FIG. 28, the second-11 flow path 261 is provided to be inclined with respect to the Z direction.

Specifically, the second-11 flow path 261 is provided to be inclined such that the end part thereof in the +Z direction communicating with the second nozzle 21B is located further in the +Y direction than the end part thereof in the −Z direction communicating with the second pressure chamber 12B. Consequently, the opening of the surface of the second common liquid chamber 102 in the Z direction can be widened in the +Y direction, and thus the second compliance portion 494B can be formed to have a relatively large area.

The first-11 flow path 221 and the second-11 flow path 261 that are inclined, illustrated in FIGS. 27 and 28 may be combined with the inclined wall surfaces of the first wide section 16*b* and the second wide section 17*b* illustrated in FIGS. 25 and 26.

In the present embodiment, a description has been made of the configuration in which the first nozzle 21A and the second nozzle 21B are provided at positions shifted relative to each other in the Y direction when viewed in the X direction, and thus the two rows such as the first nozzle row 22A and the second nozzle row 22B are arranged side by side in the Y direction, that is, the nozzles 21 are disposed in a zigzag form in the X direction, but there is no particular limitation thereto. In the same as in FIG. 9 of Embodiment 1, the first nozzle 21A and the second nozzle 21B may be provided at positions overlapping each other when viewed in the X direction such that a plurality of nozzles 21 are disposed linearly along the X direction. In a case of the configuration, there is no particular limitation thereto, but the first nozzle 21A may be provided at a position communicating with the middle of the first-3 flow path 213, and the second nozzle 21B may be provided at a position communicating with the middle of the second-3 flow path 253.

Embodiment 6

Figure 29:
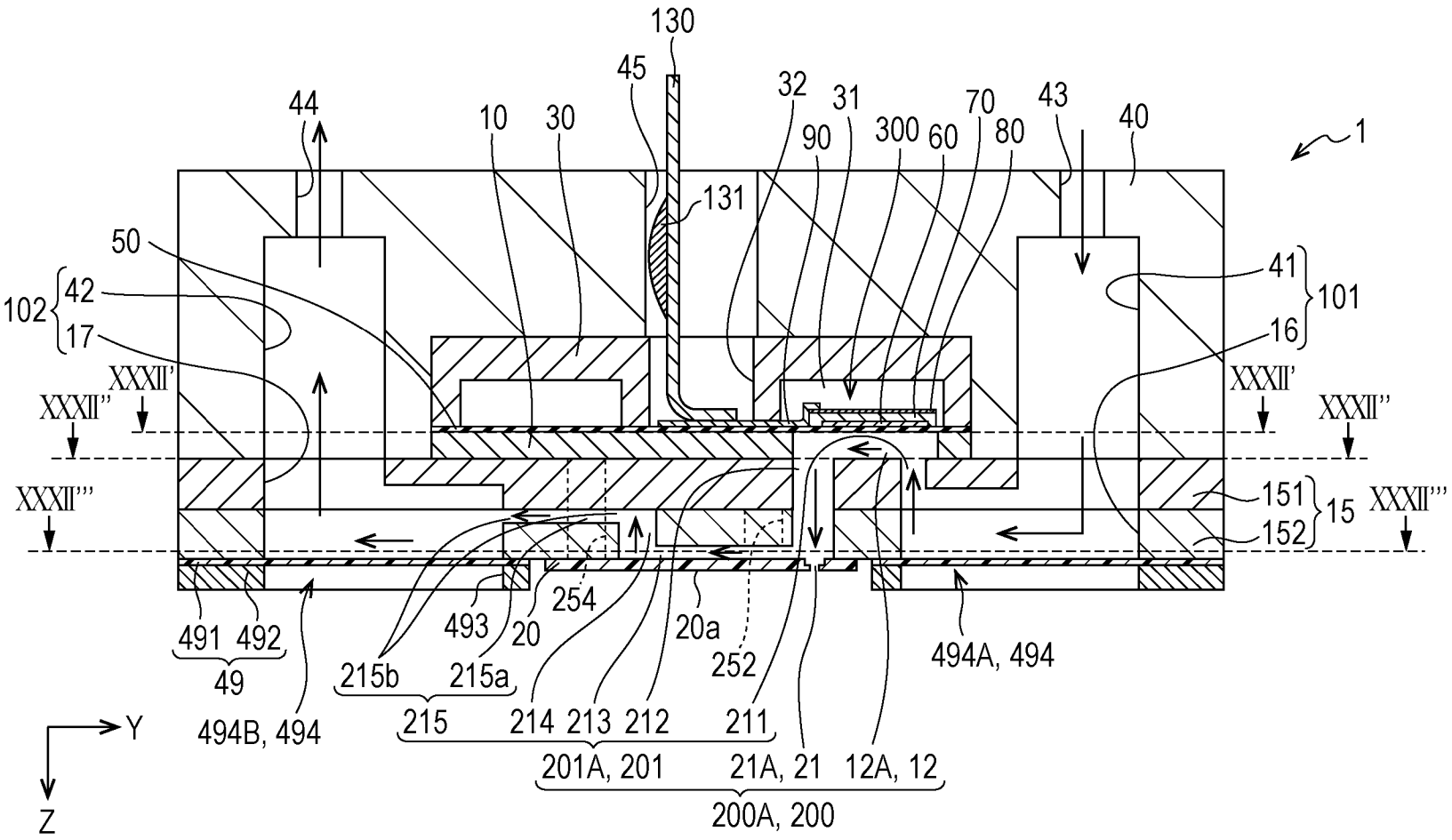
FIG. 29 is a sectional view illustrating a recording head according to Embodiment 6.
Figure 30:
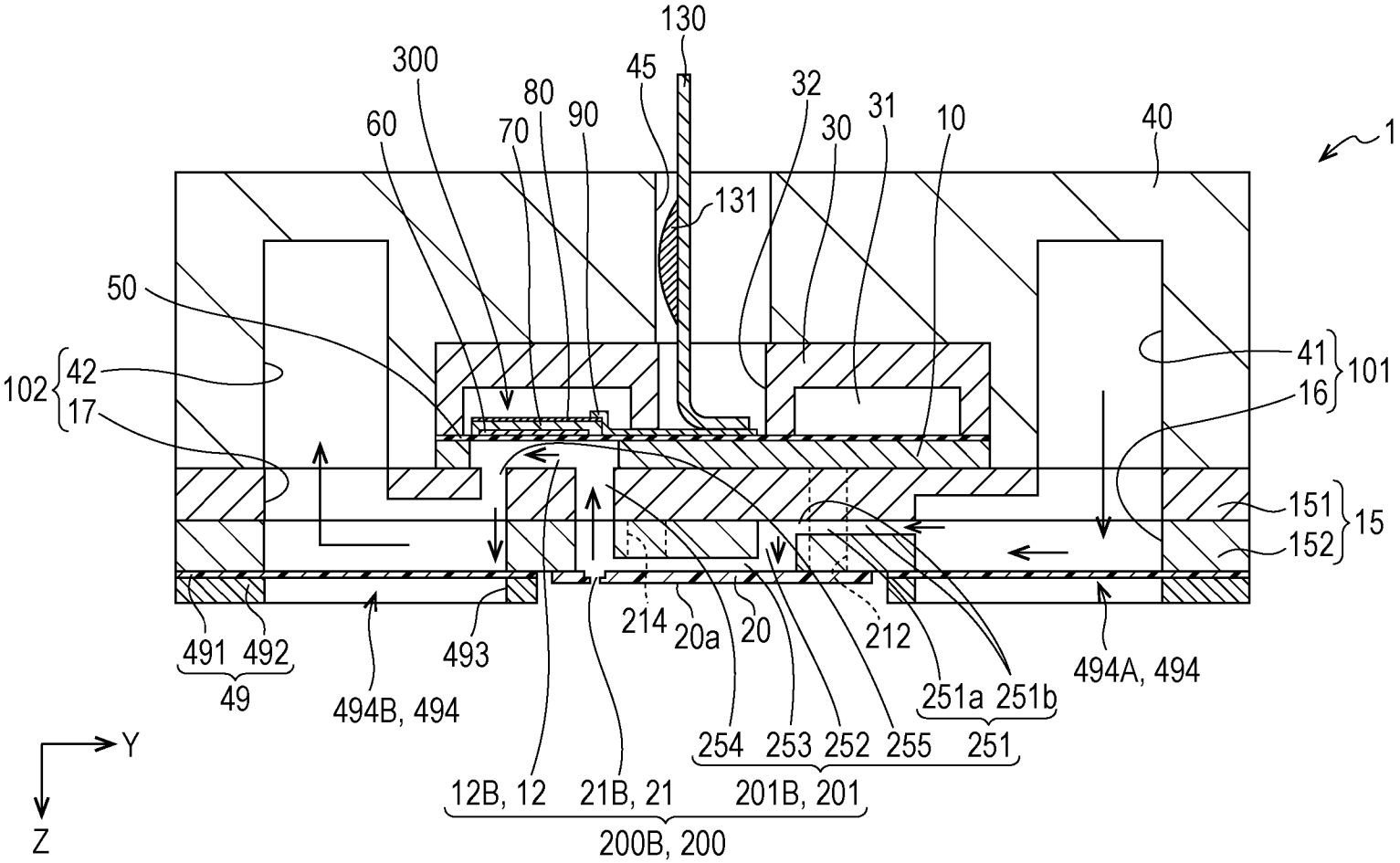
FIG. 30 is a sectional view illustrating the recording head according to Embodiment 6.
Figure 31:
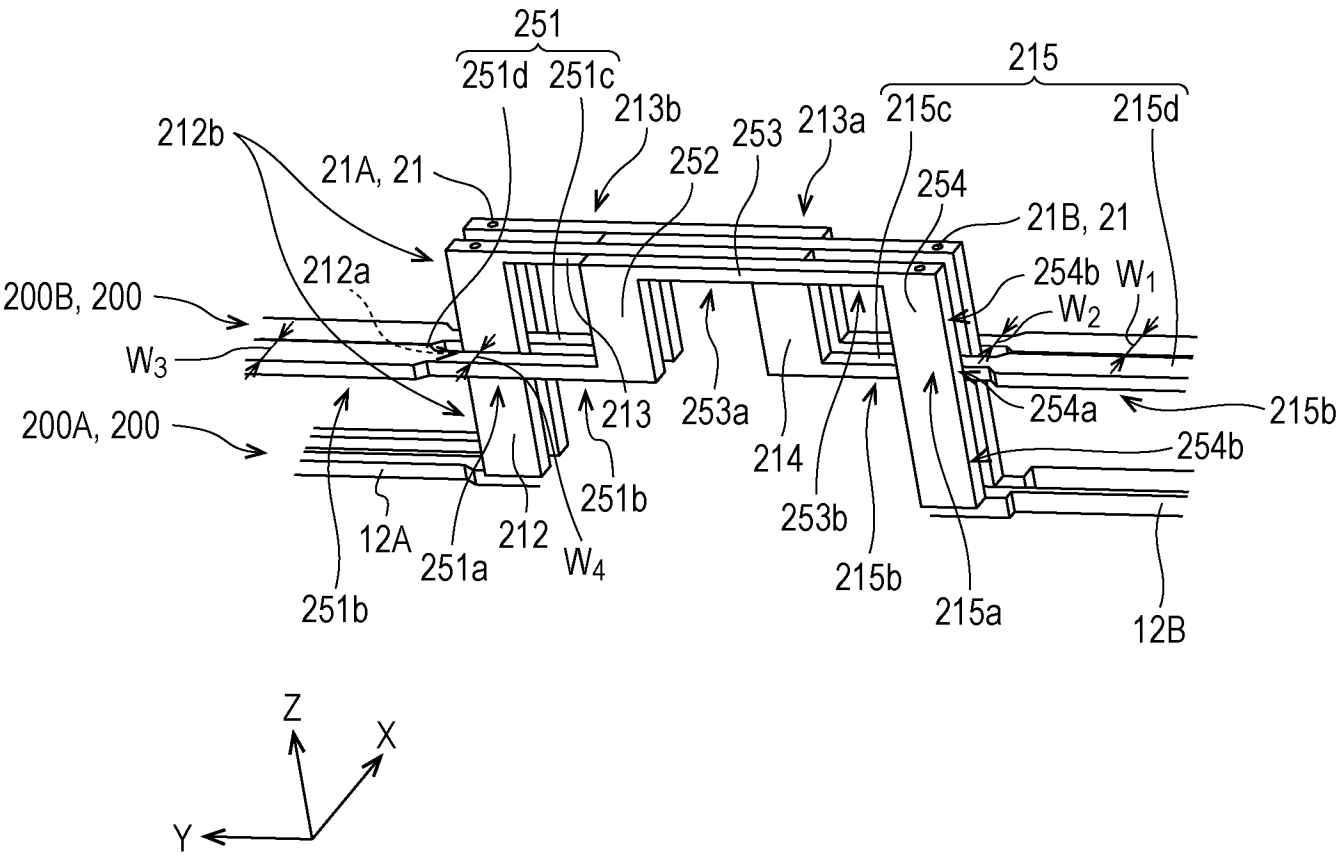
FIG. 31 is a perspective view illustrating main portions of a flow path according to Embodiment 6.
Figure 32:
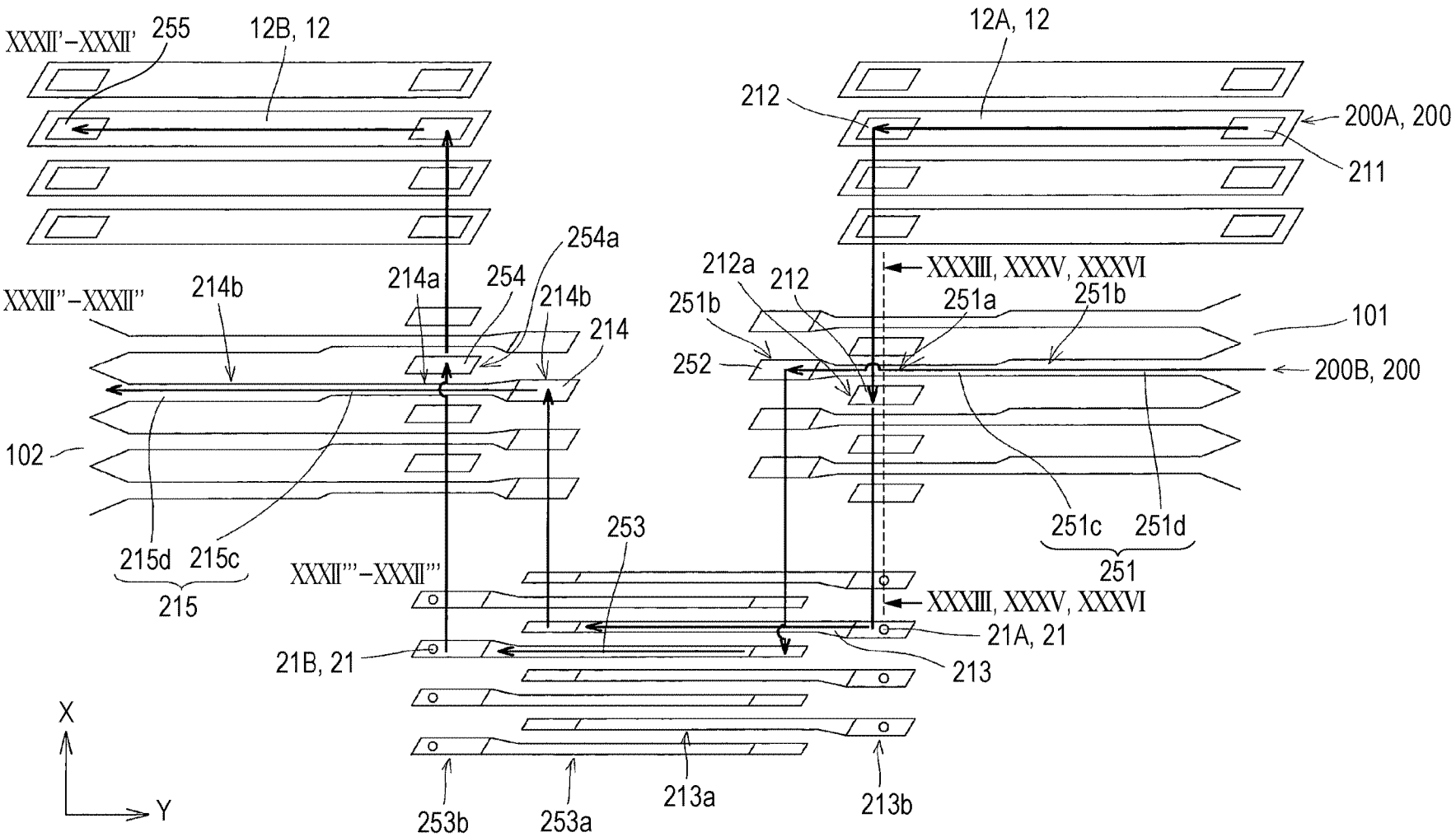
FIG. 32 is a sectional view illustrating the recording head according to Embodiment 6.
Figure 33:
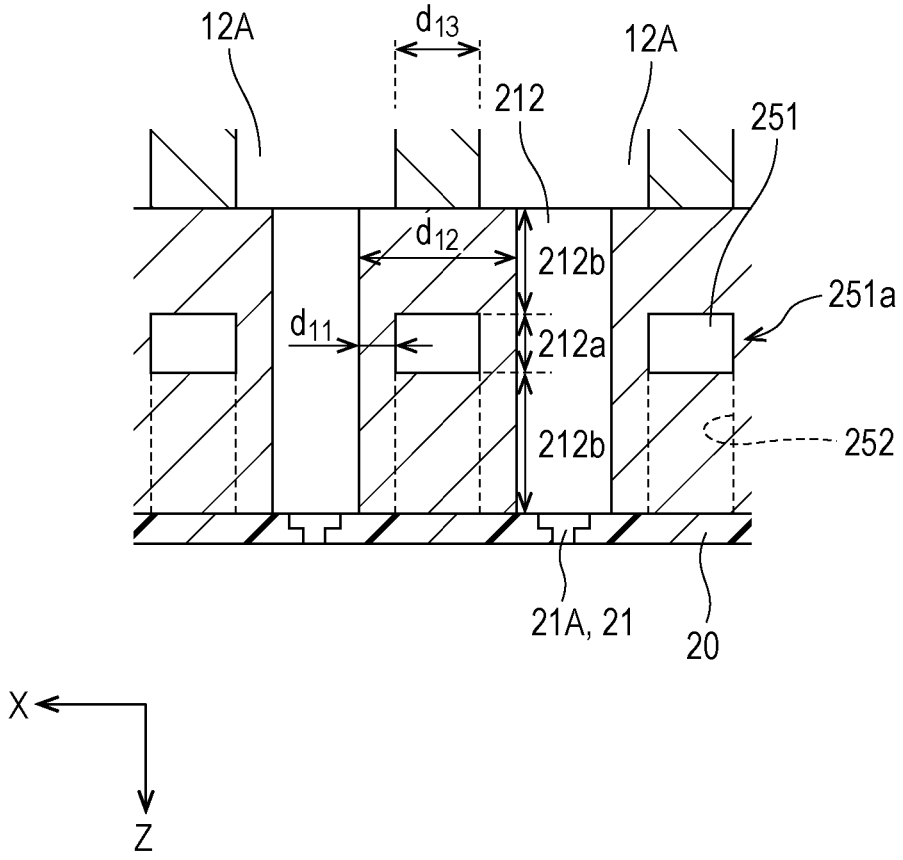
FIG. 33 is a sectional view illustrating the recording head according to Embodiment 6.

FIG. 29 is a sectional view illustrating an ink jet recording head that is an example of a liquid ejecting head according to Embodiment 6 of the present disclosure, and is a sectional view taken along the line A-A in FIG. 1. FIG. 30 is a sectional view illustrating the ink jet recording head according to Embodiment 6, and is a sectional view taken along the line B-B in FIG. 1. FIG. 31 is a perspective view in which a flow path is viewed from the −Z direction. FIG. 32 is a sectional view illustrating the recording head according to Embodiment 6, the sectional view including a sectional view taken along the line XXXII'-XXXII' in FIG. 29, a sectional view taken along the line XXXII"-XXXII" in FIG. 29, and a sectional view taken along the line XXXII'"-XXXII'" in FIG. 29. FIG. 33 is a sectional view illustrating a main portion of the recording head according to Embodiment 6, and is a sectional view taken along the line XXXIII-XXXIII in FIG. 32. The same member as in the embodiments is given the same reference numeral, and repeated description will be omitted.

As illustrated in FIGS. 29 and 30, the flow path formation substrate 10, the communication plate 15, the nozzle plate 20, the compliance substrate 49, and the case member 40 forming a flow path substrate are provided with a plurality of individual flow paths 200 each provided for the first common liquid chamber 101, the second common liquid chamber 102, and the nozzle 21.

The individual flow path 200 includes the first individual flow path 200A having the first nozzle 21A, the first pressure chamber 12A, and the first individual communication flow path 201A as illustrated in FIG. 29, and the second individual flow path 200B having the second nozzle 21B, the second pressure chamber 12B, and the second individual communication flow path 201B as illustrated in FIG. 30.

As illustrated in FIG. 29, the first individual communication flow path 201A includes a first-1 flow path 211, a first-2 flow path 212, a first-3 flow path 213, a first-4 flow path 214, and a first-5 flow path 215.

As illustrated in FIG. 30, the second individual communication flow path 201B includes a second-1 flow path 251, a second-2 flow path 252, a second-3 flow path 253, a second-4 flow path 254, and a second-5 flow path 255.

The flow paths provided along the Z direction of the first individual communication flow path 201A and the second individual communication flow path 201B are disposed not to overlap each other when viewed in the X direction.

Specifically, the first-4 flow path 214 of the first individual communication flow path 201A is disposed at a position deviated in the +Y direction relative to the second-4 flow path 254, so as not to overlap the second-4 flow path 254 of the second individual communication flow path 201B when viewed in the X direction. As mentioned above, the first-4 flow path 214 and the second-4 flow path 254 are disposed at different positions in the Y direction, and are thus disposed in a so-called zigzag form along the X direction.

Thus, the first-4 flow path 214 of the present embodiment is disposed at a position not overlapping a region between the adjacent second pressure chambers 12B of the second pressure chamber row 120B when viewed in the Z direction. In other words, in the recording head 1 of the present embodiment, the first individual communication flow path 201A has the first-5 flow path 215 that is a portion overlapping the region between the second pressure chambers 12B of the second pressure chamber row 120B when viewed in the Z direction, the portion not overlapping the second pressure chamber row 120B when viewed in the X direction. The end part of the first-5 flow path 215 in the +Y direction extends to the outside of the region between the second pressure chambers 12B. Therefore, the first individual communication flow path 201A has a portion that overlaps the region between the second pressure chambers 12B of the second pressure chamber row 120B when viewed in the Z direction and does not overlap the second pressure chamber row 120B when viewed in the X direction, at the end part of the first-5 flow path 215 in the −Y direction.

As mentioned above, the first individual communication flow path 201A has a part of the first-5 flow path 215 that is a portion that overlaps the region between the adjacent second pressure chambers 12B of the second pressure chamber row 120B when viewed in the Z direction and does not overlap the second pressure chamber row 120B when viewed in the X direction.

As illustrated in FIG. 31, the first-4 flow path 214 is disposed further in the +Y direction than the second-4 flow path 254, and thus the second-4 flow path 254 and the first-5 flow path 215 are disposed to intersect each other when viewed in the X direction. In other words, the first-5 flow paths 215 have flow path portions 215*a* that are first portions arranged side by side in the X direction with the second-4 flow path 254 interposed therebetween, and flow path portions 215*b* that are second portions arranged side by side in the X direction without the second individual communication flow path 201B interposed therebetween. Similarly, the second-4 flow paths 254 have flow path portions 254*a* that are first portions arranged side by side in the X direction with the first-5 flow path 215 interposed therebetween, and flow path portions 254*b* that are second portions arranged side by side in the X direction without the first individual communication flow path 201A interposed therebetween. In other words, the flow path portion 215*a* and the flow path portion 254*a* that are first portions overlap each other when viewed in the X direction.

A second portion of at least one of the first-5 flow path 215 and the second-4 flow path 254 has a portion provided to have a larger width in the X direction than that of each of the first portions overlapping each other when viewed in the X direction. In the present embodiment, the flow path portion 215*b* that is a second portion of the first-5 flow path 215 is provided with a portion having a larger width in the X direction than that of the flow path portion 215*a* that is a first portion. Specifically, the first-5 flow path 215 has a first narrow section 215*c* that is provided in the region on the end part side in the +Y direction including the flow path portion 215*a* as a first portion, and a first wide section 215*d* that is a part of the flow path portion 215*b* as a second portion and has a larger width in the X direction than that of the first narrow section 215*c* on the end part side in the −Y direction. As mentioned above, even though the second portions of the first individual communication flow path 201A arranged side by side in the X direction without the second individual communication flow path 201B interposed therebetween are provided with sections each having a larger width in the X direction than that of the first portion, it is possible to suppress the rigidity of a partition wall partitioning the first portions from each other in the X direction from remarkably deteriorating.

Since the first-5 flow path 215 has the first narrow section 215*c* and the first wide section 215*d*, it is possible to reduce flow path resistance and inertance of the first-5 flow path 215 and thus to prevent the occurrence of supply shortage of ink to the first pressure chamber 12A from the second common liquid chamber 102 and also to continuously discharge ink droplets in a short cycle, compared with a case where the whole of the first-5 flow path 215 is only provided to have the same width as that of the first narrow section 215*c*. Since the flow path resistance and the inertance of the first-5 flow path 215 can be reduced, it is possible to suppress a circulation amount of ink from the first common liquid chamber 101 to the second common liquid chamber 102 from being reduced. Since the first-5 flow path 215 has the first narrow section 215*c*, it is possible to prevent the rigidity of a partition wall partitioning the first portions in which the first-5 flow path 215 overlaps the second-4 flow path 254 from each other when viewed in the X direction from remarkably deteriorating, and thus to suppress a flow path substrate from becoming large-sized.

Similarly, the second-2 flow path 252 of the second individual communication flow path 201B is disposed at a position deviated in the −Y direction relative to the first-2 flow path 212, so as not to overlap the first-2 flow path 212 of the first individual communication flow path 201A when viewed in the X direction. As mentioned above, the first-2 flow path 212 and the second-2 flow path 252 are disposed at different positions in the Y direction, and are thus disposed in a so-called zigzag form along the X direction.

Thus, the second-2 flow path 252 of the present embodiment is disposed at a position not overlapping a region between the adjacent first pressure chamber 12A of the first pressure chamber row 120A when viewed in the Z direction. In other words, in the recording head 1 of the present embodiment, the second individual communication flow path 201B has the second-1 flow path 251 that is a portion overlapping the region between the first pressure chambers 12A of the first pressure chamber row 120A when viewed in the Z direction, the portion not overlapping the first pressure chamber row 120A when viewed in the X direction. The end part of the second-1 flow path 251 in the −Y direction extends to the outside of the region between the first pressure chambers 12A. Therefore, the second individual communication flow path 201B has a portion that overlaps the region between the first pressure chambers 12A of the first pressure chamber row 120A when viewed in the Z direction and does not overlap the first pressure chamber row 120A when viewed in the X direction, at the end part of the second-1 flow path 251 in the −Y direction.

The second-2 flow path 252 is disposed further in the −Y direction than the first-2 flow path 212, and thus the first-2 flow path 212 and the second-1 flow path 251 are disposed to intersect each other when viewed in the X direction. In other words, the first-2 flow paths 212 have flow path portions 212*a* that are first portions arranged side by side in the X direction with the second-1 flow path 251 interposed therebetween, and flow path portions 212*b* that are second portions arranged side by side in the X direction without the second individual communication flow path 201B interposed therebetween. Similarly, the second-1 flow paths 251 have flow path portions 251*a* that are first portions arranged side by side in the X direction with the first-2 flow path 212 interposed therebetween, and flow path portions 251*b* that are second portions arranged side by side in the X direction without the first individual communication flow path 201A interposed therebetween. In other words, the flow path portion 212*a* and the flow path portion 251*a* that are first portions overlap each other when viewed in the X direction.

A second portion of at least one of the first-2 flow path 212 and the second-1 flow path 251 has a portion provided to have a larger width in the X direction than that of each of the first portions overlapping each other when viewed in the X direction. In the present embodiment, the flow path portion 251*b* that is a second portion of the second-1 flow path 251 is provided with a portion having a larger width in the X direction than that of the flow path portion 251*a* that is a first portion. Specifically, the second-1 flow path 251 has a second narrow section 251*c* that is provided in the region on the end part side in the −Y direction including the flow path portion 251*a* as a first portion, and a second wide section 251*d* that is a part of the flow path portion 251*b* as a second portion and has a larger width in the X direction than that of the second narrow section 251*c* on the end part side in the +Y direction. As mentioned above, even though the second portions of the second individual communication flow path 201B arranged side by side in the X direction without the first individual communication flow path 201A interposed therebetween are provided with sections each having a larger width in the X direction than that of the first portion, it is possible to suppress the rigidity of a partition wall partitioning the first portions from each other in the X direction from remarkably deteriorating.

Since the second-1 flow path 251 has the second narrow section 251*c* and the second wide section 251*d*, it is possible to reduce flow path resistance and inertance of the second-1 flow path 251 and thus to prevent the occurrence of supply shortage of ink to the second pressure chamber 12B from the first common liquid chamber 101 and also to continuously discharge ink droplets in a short cycle, compared with a case where the whole of the second-1 flow path 251 is only provided to have the same width as that of the second narrow section 251*c*. Since the flow path resistance and the inertance of the second-1 flow path 251 can be reduced, it is possible to suppress a circulation amount of ink from the first common liquid chamber 101 to the second common liquid chamber 102 from being reduced. Since the second-1 flow path 251 has the second narrow section 251*c*, it is possible to prevent the rigidity of a partition wall partitioning the first portions in which the first-2 flow path 212 overlaps the second-1 flow path 251 from each other when viewed in the X direction from remarkably deteriorating, and thus to suppress a flow path substrate from becoming large-sized.

The first-4 flow path 214 and the second-2 flow path 252 are moved to be close to each other in the Y direction, that is, the first-4 flow path 214 and the second-2 flow path 252 are moved in the +Y direction and the −Y direction, respectively, and thus the first-3 flow path 213 and the second-3 flow path 253 are provided with a first portion and a second portion.

Specifically, the first-3 flow paths 213 have flow path portions 213*a* that are first portions arranged side by side in the X direction with the second-3 flow path 253 interposed therebetween on the end part sides thereof in the −Y direction, and flow path portions 213*b* that are second portions on the end part sides in the +Y direction. The second-3 flow paths 253 have flow path portions 253*a* that are first portions arranged side by side in the X direction with the first-3 flow path 213 interposed therebetween on the end part sides thereof in the +Y direction, and flow path portions 253*b* that are second portions on the end part sides in the −Y direction.

The first-3 flow path 213 and the second-3 flow path 253 are provided to have the same X-direction width over the Y direction, but are not particularly limited thereto. For example, in the same manner as the first-5 flow path 215 and the second-1 flow path 251, a second portion of at least one of the first-3 flow path 213 and the second-3 flow path 253 may have a portion provided to have a larger width in the X direction than that of each of the first portions overlapping each other when viewed in the X direction. As mentioned above, even though each of the second portions of the first individual communication flow path 201A and the second individual communication flow path 201B is provided with a section having a larger width in the X direction than the first portion, it is possible to secure the rigidity of a partition wall partitioning the first portions from each other in the X direction.

In the present embodiment, in the first individual communication flow path 201A, a local flow path extending in the Z direction has the first portion and the second portion. In other words, as described above, in the first individual communication flow path 201A, the first-2 flow path 212 extending in the Z direction has both of the flow path portion 212*a* that is the first portion and the flow path portion 212*b* that is the second portion, and, thus, in the present embodiment, the first-2 flow path 212 corresponds to such a local flow path.

In the present embodiment, in same manner for the second individual communication flow path 201B, a local flow path extending in the Z direction has the first portion and the second portion. In other words, in the second individual communication flow path 201B, the second-4 flow path 254 extending in the Z direction has the flow path portion 254*a* that is the first portion and the flow path portion 254*b* that is the second portion.

In the present embodiment, in the first individual communication flow path 201A, a local flow path coupling the first pressure chamber 12A to the first nozzle 21A has at least the second portion. In other words, in the present embodiment, the first-2 flow path 212 couples the first pressure chamber 12A to the first nozzle 21A, and has the flow path portion 212*b* as the second portion that is not provided between the second individual communication flow paths 201B, and thus the first-2 flow path 212 corresponds to a local flow path.

In the present embodiment, in the same manner for the second individual communication flow path 201B, a local flow path coupling the second pressure chamber 12B to the second nozzle 21B has at least the second portion. In other words, in the second individual communication flow path 201B, the second-4 flow path 254 has the flow path portion 254*b* that is the second portion.

In the present embodiment, in the first individual communication flow path 201A, a local flow path extending in the Y direction from the coupling portion with the first nozzle 21A has at least the first portion. In other words, in the present embodiment, the first-3 flow path 213 extending in the Y direction from the first-2 flow path 212 that is a coupling portion with the first nozzle 21A has the flow path portion 213*a* that is the first portion and the flow path portion 213*b* that is the second portion.

Similarly, in the present embodiment, in the second individual communication flow path 201B, a local flow path extending in the Y direction from the coupling portion with the second nozzle 21B has at least the first portion. In other words, in the present embodiment, the second-3 flow path 253 extending in the Y direction from the second-4 flow path 254 that is a coupling portion with the second nozzle 21B has the flow path portion 253*a* that is the first portion and the flow path portion 253*b* that is the second portion.

In the present embodiment, a volume of the second portion of the first individual communication flow path 201A is larger than a volume of the first portion. Similarly, in the present embodiment, a volume of the second portion of the second individual communication flow path 201B is larger than a volume of the first portion.

In the first individual communication flow path 201A, the maximum width of the second portion in the X direction is larger than the maximum width of the first portion in the X direction. As described above, in the present embodiment, the first portions of the first individual communication flow path 201A are the flow path portion 212*a* of the first-2 flow path 212, the flow path portion 213*a* of the first-3 flow path 213, and the flow path portion 215*a* of the first-5 flow path 215, and the second portions are the first-1 flow path 211, the flow path portion 212*b* of the first-2 flow path 212, the flow path portion 213*b* of the first-3 flow path 213, the first-4 flow path 214, and the flow path portion 215*b* of the first-5 flow path 215.

Thus, the maximum width in the X direction of the first-1 flow path 211, the flow path portion 212*b* of the first-2 flow path 212, the flow path portion 213*b* of the first-3 flow path 213, the first-4 flow path 214, and the flow path portion 215*b* of the first-5 flow path 215 that are the second portions is larger than the maximum width in the X direction of the flow path portion 213*a* of the first-3 flow path 213 and the flow path portion 215*a* of the first-5 flow path 215 that are the first portions. In other words, the maximum width in the X direction is the largest width in a case where a width in the X direction changes on the way in each of the first portion and the second portion.

In the present embodiment, as illustrated in FIG. 31, the maximum width of the second portion in the X direction is a width $W_1$ of the first wide section 215*d* of the flow path portion 215*b* that is the second portion of the first-5 flow path 215. Therefore, the width of the first wide section 215*d* in the X direction is larger than a width $W_2$ of the first portion of the first individual communication flow path 201A, for example, the flow path portion 215*a* that is the first portion of the first-5 flow path 215.

In the second individual communication flow path 201B, the maximum width of the second portion in the X direction is larger than the maximum width of the first portion in the X direction. In other words, a width $W_3$ of the second wide section 251*d* in the X direction is larger than a width of a flow path except the second wide section 251*d* of the second individual communication flow path 201B, for example, a width $W_4$ of the flow path portion 251*a* in the X direction.

In the present embodiment, the maximum thickness of a partition wall partitioning the adjacent first individual communication flow paths 201A of the second portions from each other is larger than the maximum thickness of a partition wall partitioning the first individual communication flow path 201A of the first portion from the second individual communication flow path 201B that is an individual communication flow path corresponding to the second pressure chamber row 120B. For example, as illustrated in FIG. 32, a thickness $d_{12}$ of a partition wall partitioning the adjacent first individual communication flow paths 201A of the second portions from each other, that is, a partition wall partitioning the flow path portions 212*b* of the first-2 flow paths 212 from each other in the X direction is larger than a thickness $d_{11}$ of a partition wall partitioning the flow path portion 212*a* that is the first portion of the first-2 flow path 212 of the first individual communication flow path 201A from the second-1 flow path 251 of the second individual communication flow path 201B in the X direction.

In the present embodiment, although not particularly illustrated, the maximum thickness of a partition wall partitioning the adjacent first individual communication flow paths 201A of the second portions from each other is larger than the maximum thickness of a partition wall partitioning the second individual communication flow path 201B of the first portion from the first individual communication flow path 201A that is an individual communication flow path corresponding to the first pressure chamber row 120A.

In the present embodiment, a partition wall partitioning the adjacent second individual communication flow paths 201B of the second portions from each other is thicker than a partition wall partitioning the adjacent first pressure chambers 12A of the first pressure chamber row 120A from each other. In other words, as illustrated in FIG. 33, the thickness $d_{12}$ of the partition wall partitioning the adjacent first individual communication flow paths 201A of the second portions from each other in the X direction, that is, the partition wall partitioning the flow path portions 212*b* of the first-2 flow paths 212 from each other is larger than a thickness $d_{13}$ of a partition wall partitioning the first pressure chambers 12A from each other in the X direction.

In the present embodiment, although not particularly illustrated, a partition wall partitioning the adjacent first individual communication flow paths 201A of the second portions from each other is thicker than a partition wall partitioning the adjacent second pressure chambers 12B of the second pressure chamber row 120B.

In the present embodiment, a description has been made of the configuration in which the first nozzle 21A and the second nozzle 21B are provided at different positions in the Y direction, and thus the two rows such as the first nozzle row 22A in which the first nozzles 21A are arranged side by side in the X direction and the second nozzle row 22B in which the second nozzles 21B are arranged side by side in the X direction are arranged side by side in the Y direction, that is, the nozzles 21 are disposed in a zigzag form in the X direction, but there is no particular limitation thereto. In the same as in FIG. 9 of Embodiment 1, the first nozzles 21A and the second nozzles 21B may be provided at the same position in the Y direction such that a plurality of nozzles 21 are disposed linearly along the X direction.

In the present embodiment, the first-4 flow path 214 is disposed further in the +Y direction than the second-4 flow path 254, and there is no particular limitation thereto, and the first-4 flow path 214 may be disposed further in the −Y direction than the second-4 flow path 254. In this case, the second-4 flow path 254 and the first-5 flow path 215 do not intersect each other when viewed in the X direction, but a flow path length of the first-3 flow path 213 is increased, and thus there is concern that flow path resistance may increase. In the present embodiment, the first-4 flow path 214 is disposed further in the +Y direction than the second-4 flow path 254, and thus it is possible to reduce flow path resistance by reducing a flow path length of the first-3 flow path 213.

Similarly, the second-2 flow path 252 is disposed further in the −Y direction than the first-2 flow path 212, and there is no particular limitation thereto, and second-2 flow path 252 may be disposed further in the +Y direction than the first-2 flow path 212. In this case, the first-2 flow path 212 and the second-1 flow path 251 do not intersect each other when viewed in the X direction, but a flow path length of the second-3 flow path 253 is increased, and thus there is concern that flow path resistance may increase. In the present embodiment, the second-2 flow path 252 is disposed further in the −Y direction than the first-2 flow path 212, and thus it is possible to reduce flow path resistance by reducing a flow path length of the second-3 flow path 253.

Figure 34:
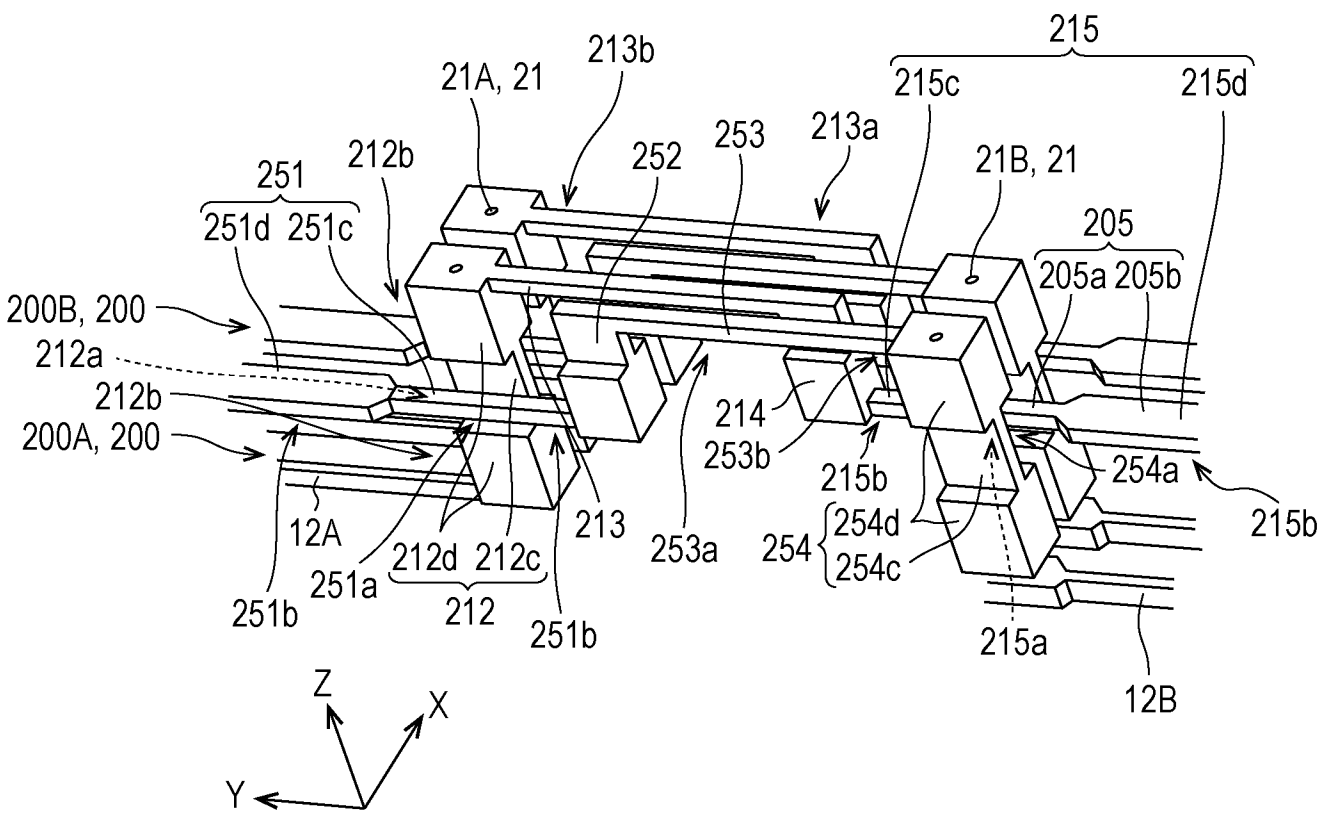
FIG. 34 is a perspective view illustrating main portions related to a modification example of the flow path according to Embodiment 6.
Figure 35:
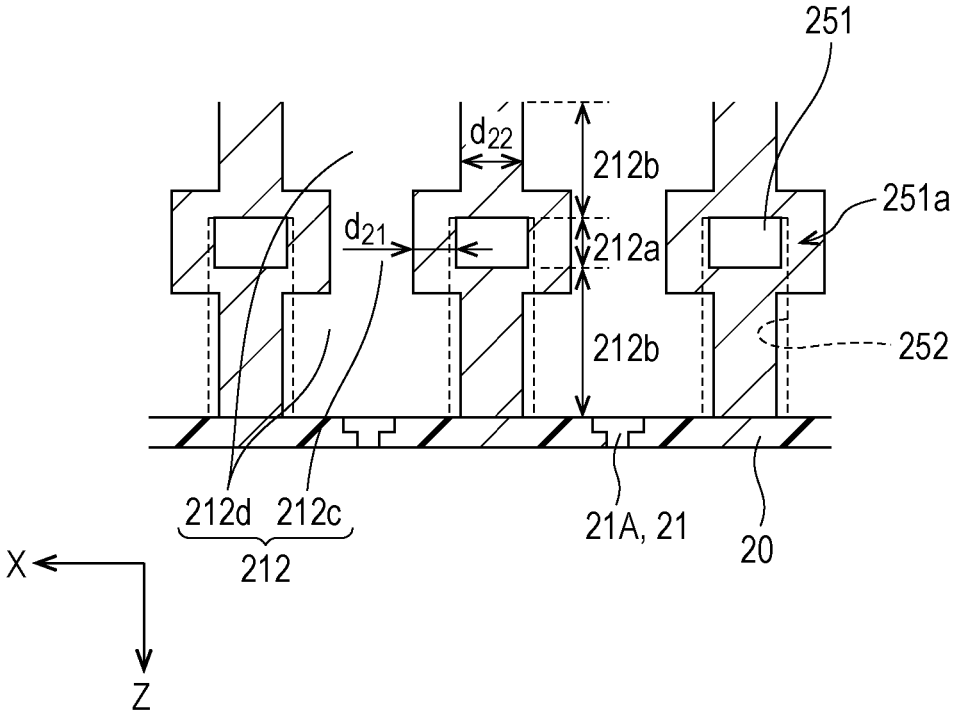
FIG. 35 is a sectional view illustrating a modification example of the recording head according to Embodiment 6.

In the above example, the flow path portion 215*b* of the first-5 flow path 215 that is the second portion of the first individual communication flow path 201A is provided with the first wide section 215*d*, but is not particularly limited thereto, and other second portions may be provided with a section having a larger width in the X direction than that of the first portion. Similarly, the flow path portion 251*b* of the second-1 flow path 251 that is the second portion of the second individual communication flow path 201B is provided with the second wide section 251*d*, but is not particularly limited thereto, and other second portions may be provided with a section having a larger width in the X direction than that of the first portion. Here, such an example is illustrated in FIGS. 34 and 35. FIG. 34 is a perspective view from the Z direction, illustrating a modification example of the flow paths of the recording head according to Embodiment 6. FIG. 35 is a main portion sectional view illustrating the modification example of the recording head according to the present embodiment, and is a sectional view taken along the line XXXV-XXXV in FIG. 32.

As illustrated in FIGS. 34 and 35, the first-2 flow path 212 of the first individual communication flow path 201A has a third narrow section 212*c* provided at the central portion in the Z direction including the flow path portion 215*a* that is the first portion, and a third wide section 212*d* that is a part of the flow path portion 212*b* as the second portion, has a larger width in the X direction than that of the third narrow section 212*c*, and is provided at each of the end part thereof in the Z direction and the end part thereof in the −Z direction.

As mentioned above, since the first-2 flow path 212 has the third wide section 212*d*, it is possible to reduce flow path resistance and inertance, compared with a case where the whole of the first-2 flow path 212 is only provided to have the same width as that of the third narrow section 212*c*. Therefore, it is possible to improve a discharge characteristic of an ink droplet, for example, to increase the weight of the ink droplet, even though the first nozzles 21A are disposed at high density. Since the flow path resistance and the inertance of the first-2 flow path 212 can be reduced, it is possible to suppress a circulation amount of ink from the first common liquid chamber 101 to the second common liquid chamber 102 from being reduced.

As illustrated in FIG. 34, the second-4 flow path 254 of the second individual communication flow path 201B has a fourth narrow section 254*c* provided at the central portion in the Z direction including the flow path portion 254*a* that is the first portion, and a fourth wide section 254*d* that is a part of the flow path portion 254*b* as the second portion, has a larger width in the X direction than that of the fourth narrow section 254*c*, and is provided at each of the end part thereof in the Z direction and the end part thereof in the −Z direction.

As mentioned above, since the second-4 flow path 254 has the fourth wide section 254*d*, it is possible to reduce flow path resistance and inertance of the second-4 flow path 254, compared with a case where the whole of the second-4 flow path 254 is only provided to have the same width as that of the fourth narrow section 254*c*. Therefore, it is possible to improve a discharge characteristic of an ink droplet, for example, to increase the weight of the ink droplet, even though the second nozzle 21B are disposed at high density. Since the flow path resistance and the inertance of the second-4 flow path 254 can be reduced, it is possible to suppress a circulation amount of ink from the first common liquid chamber 101 to the second common liquid chamber 102 from being reduced.

As illustrated in FIG. 35, even when the first-2 flow path 212 of the first individual communication flow path 201A has the third wide section 212*d*, the maximum thickness $d_{22}$ of a partition wall partitioning the adjacent first individual communication flow paths 201A of the second portions from each other, that is, a partition wall partitioning the third wide sections 212*d* of the flow path portions 212*b* that are the second portions of the first-2 flow paths 212 from each other is larger than the maximum thickness $d_{21}$ of a partition wall between the flow path portion 212*a* that is the first portion of the first-2 flow path 212 of the first individual communication flow path 201A, that is, the third narrow section 212*c* and the second-1 flow path 251 of the second individual communication flow path 201B.

As mentioned above, since the thickness $d_{22}$ of the partition wall partitioning the adjacent first individual communication flow paths 201A of the second portions is larger than the thickness $d_{21}$ of the partition wall partitioning the first individual communication flow path 201A and the second individual communication flow path 201B of the first portions from each other, it is possible to improve the rigidity of the partition wall of the second portion and thus to prevent the occurrence of crosstalk due to deterioration in the rigidity of the partition wall.

Although not particularly illustrated, in the same manner for the second individual communication flow path 201B, even when the second-4 flow path 254 of the second individual communication flow path 201B has the fourth wide section 254*d*, the maximum thickness of a partition wall partitioning the adjacent first individual communication flow paths 201A of the second portions from each other, that is, a partition wall partitioning the fourth wide sections 254*d* of the flow path portions 254*b* that are the second portions of the second-4 flow paths 254 from each other is larger than the maximum thickness of a partition wall partitioning the flow path portion 254*a* that is the first portion of the second-4 flow path 254 of the second individual communication flow path 201B, that is, the fourth narrow section 254*c* and the first-5 flow path 215 of the first individual communication flow path 201A.

Figure 36:
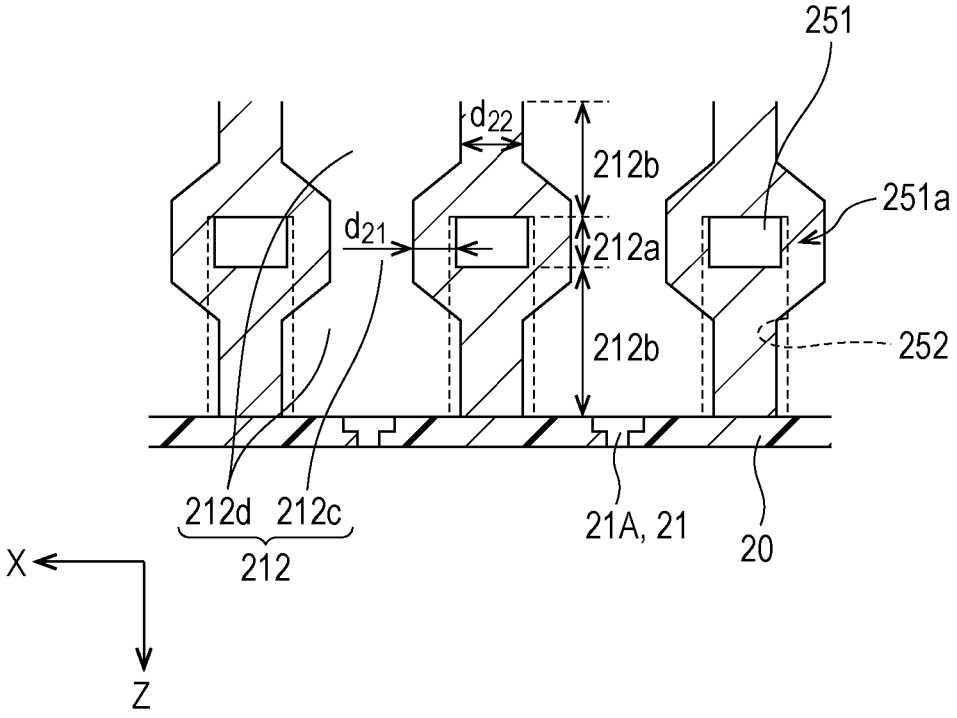
FIG. 36 is a sectional view illustrating the modification example of the recording head according to Embodiment 6.

As illustrated in FIG. 35, a step difference surface parallel to the nozzle surface 20*a* is provided between the third narrow section 212*c* and the third wide section 212*d* of the first-2 flow path 212, but is not particularly limited thereto. For example, as illustrated in FIG. 36, a width in the X direction may be gradually changed at a coupling portion between the third narrow section 212*c* and the third wide section 212*d*. In other words, the step difference surface between the third narrow section 212*c* and the third wide section 212*d* is provided to be inclined in the Y direction. In other words, a width in the X direction is gradually decreased in the +Z direction from the third wide section 212*d* toward the third narrow section 212*c*, and a width in the X direction is gradually increased in the +Z direction from the third narrow section 212*c* toward the third wide section 212*d*.

As mentioned above, since, in the first-2 flow path 212, a width in the X direction of the coupling portion between the third narrow section 212*c* and the third wide section 212*d* is gradually changed, even when an air bubble is contained in ink passing through the first-2 flow path 212, the air bubble is hardly captured by the step difference, and thus air bubble discharging property can be improved. In addition, it is possible to prevent defects such as defective discharge of an ink droplet due to staying of the air bubble.

Other Embodiments

As mentioned above, each embodiment of the present disclosure has been described, but a fundamental configuration of the present disclosure is not limited to the above configuration.

In the same manner as in Embodiment 1, in Embodiments 3 to 6, a volume of the second portion of the first individual communication flow path 201A is preferably larger than a volume of the first portion. This is also the same for the second individual communication flow path 201B.

In the same manner as in Embodiment 6, in Embodiments 1 to 5, in the first individual communication flow path 201A, the maximum width of the second portion in the X direction is larger than the maximum width of the first portion in the X direction. This is also the same for the second individual communication flow path 201B.

In the same manner as in Embodiments 1 and 6, in Embodiments 2 to 5, the maximum thickness of a partition wall partitioning the adjacent first individual communication flow paths 201A of the second portions is preferably larger than the maximum thickness of a partition wall partitioning the first individual communication flow path 201A of the first portion from the second individual communication flow path 201B that is an individual communication flow path corresponding to the second pressure chamber row 120B. This is also the same for the second individual communication flow path 201B.

In the same manner as in Embodiments 1 and 6, in the Embodiments 2 to 5, a partition wall partitioning the adjacent first individual communication flow paths 201A of the second portions is preferably thicker than a partition wall partitioning the adjacent first pressure chambers 12A of the first pressure chamber row 120A. This is also the same for the second individual communication flow path 201B.

In the same manner as in Embodiment 1, in Embodiments 2 to 6, in a circulation flow directed from the first common liquid chamber 101 toward the second common liquid chamber 102, the upstream flow path on the first common liquid chamber 101 side of the nozzle 21 in the individual flow path 200 and the downstream flow path on the second common liquid chamber 102 side of the nozzle 21 are preferably provided to have the same flow path resistance. In the present embodiment, the first individual flow path 200A and the second individual flow path 200B preferably have shapes reverse to each other in a circulation flow directed from the first common liquid chamber 101 toward the second common liquid chamber 102.

In the same manner as in Embodiment 1, in Embodiments 2 to 6, an ink pressure difference is preferably within ±2%, that is, −2% or higher and +2% or lower with the atmospheric pressure in the nozzle 21 as a reference during non-discharge in which an ink droplet is not discharged from the nozzle 21 in a state in which a circulation flow of ink directed from the first common liquid chamber 101 toward the second common liquid chamber 102 is generated in the individual flow path 200.

In the same manner as in Embodiment 1, in Embodiments 2 to 6, the flow path resistances of the first upstream flow path and the first downstream flow path and/or the flow path resistances of the second upstream flow path and the second downstream flow path may be different from each other, and a pressure difference of ink in the nozzles 21 may be deviated from ±2%, that is, may be lower than −2% or higher than +2%. In this case, different drive pulses may be supplied to the piezoelectric actuators 300 respectively corresponding to the first pressure chamber row 120A and the second pressure chamber row 120B.

In each of the embodiments, a description has been made of a configuration in which the single first common liquid chamber 101 and the single second common liquid chamber 102 are provided in a single flow path substrate, but there is no particular limitation thereto, and two or more sets of the first common liquid chamber 101 and the second common liquid chamber 102 may be provided. The first common liquid chambers 101 and the second common liquid chambers 102 may be disposed in a matrix form.

In each of the embodiments, a description has been made of a configuration in which the single nozzle 21 and the single pressure chamber 12 are provided in each individual flow path 200, but the number of the nozzles 21 and the pressure chambers 12 is not particularly limited, and a plurality of two or more nozzles 21 may be provided in the single pressure chamber 12, and two or more pressure chambers 12 may be provided for the single nozzle 21. However, ink droplets are simultaneously discharged in one discharge cycle from the nozzles 21 provided in the single individual flow path 200. In other words, even though a plurality of nozzles 21 are provided in the single individual flow path 200, discharge in which ink droplets are simultaneously discharged from the plurality of nozzles 21 or non-discharge in which ink droplets are not simultaneously discharged may be performed. In other words, in a configuration in which a plurality of nozzles 21 are provided in the single individual flow path 200, discharge or non-discharge of ink droplets from the plurality of nozzles 21 may be simultaneously performed.

In each of the embodiments, the flow path substrate includes the flow path formation substrate 10, the communication plate 15, the nozzle plate 20, the compliance substrate 49, and the case member 40, but is not particularly limited. The flow path substrate may be formed of a single substrate, and may be formed by laminating a plurality of two or more substrates. For example, the flow path substrate may include the flow path formation substrate 10 and the nozzle plate 20, and may not include the communication plate 15, the compliance substrate 49, and the case member 40. The single pressure chamber 12 may be formed by a plurality of flow path formation substrates 10, and the pressure chamber 12, the first common liquid chamber 101, and the second common liquid chamber 102 may be formed in the flow path formation substrate 10.

In each of the embodiments, the thin-film piezoelectric actuator 300 has been described as an energy generation element causing a pressure change in the pressure chamber 12, but is not particularly limited. For example, a thick-film piezoelectric actuator formed according to a method of attaching green sheets together, or a vertical vibration type piezoelectric actuator in which a piezoelectric material and an electrode forming material are alternately laminated and are expanded and contracted in an axial direction may be used. As an energy generation element, there may be the use of an actuator in which a heating element is disposed in a pressure chamber, and an ink droplet is discharged from a nozzle by using bubbles generated due to heating of the heating element, or a so-called electrostatic actuator in which static electricity is generated between a vibration plate and an electrode, the vibration plate is deformed by electrostatic force, and an ink droplet is discharged from a nozzle opening.

Figure 37:
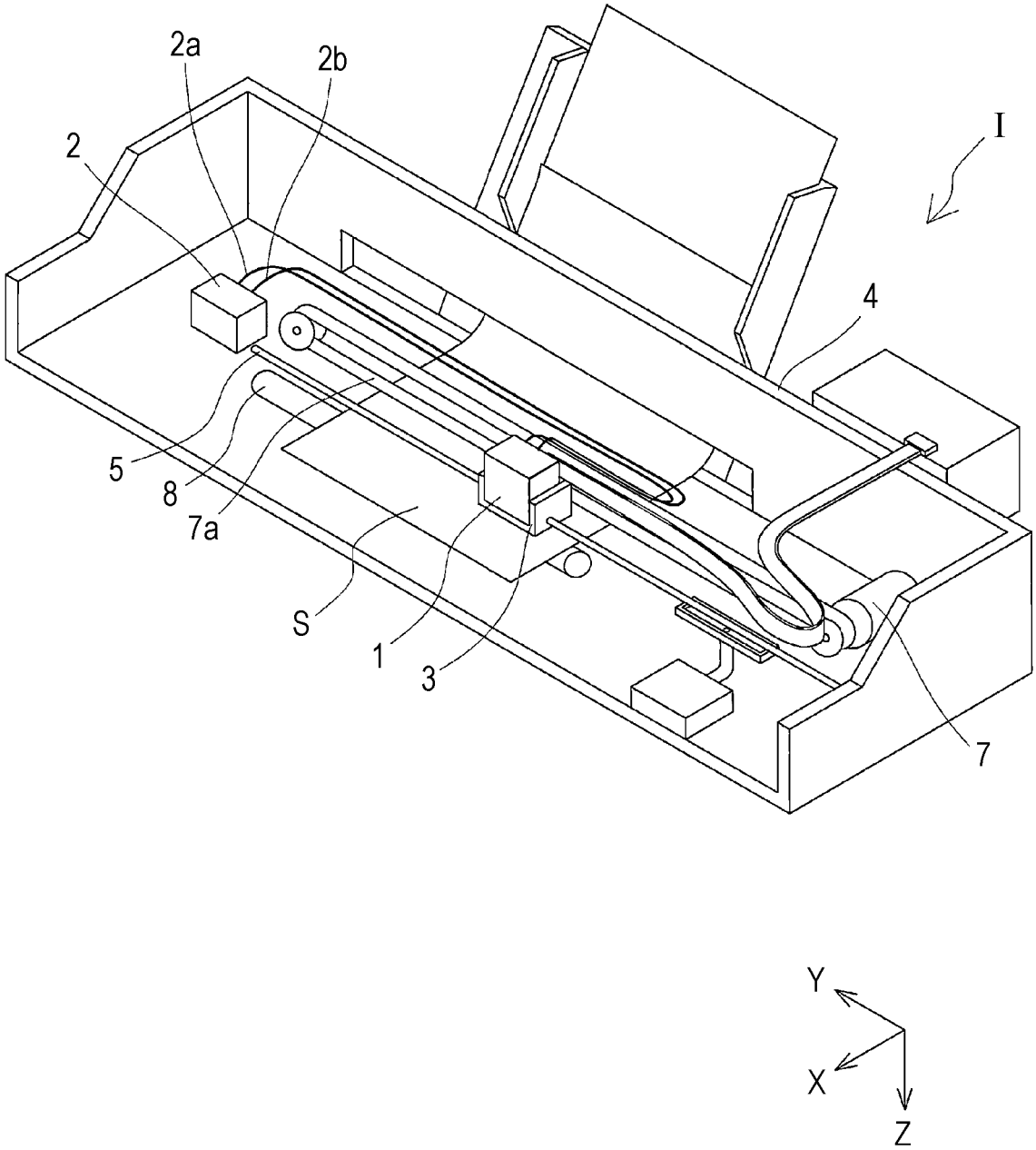
FIG. 37 is a diagram schematically illustrating a configuration of a recording apparatus according to one embodiment.

Here, a description has been made of an example of an ink jet recording apparatus that is an example of a liquid ejecting apparatus of the present embodiment with reference to FIG. 37. FIG. 37 is a diagram illustrating a schematic configuration of the ink jet recording apparatus according to one embodiment of the present disclosure.

As illustrated in FIG. 37, in an ink jet recording apparatus I that is an example of a liquid ejecting apparatus, a plurality of recording heads 1 are mounted on a carriage 3. The carriage 3 mounted with the recording heads 1 is provided to be movable along a shaft direction at a carriage shaft 5 attached to an apparatus main body 4. In the present embodiment, a movement direction of the carriage 3 is the Y direction.

A tank 2 that is storage means for storing ink as a liquid is provided in the apparatus main body 4. The tank 2 is coupled to the recording head 1 via a supply tube 2*a* such as a tube, and the ink from the tank 2 is supplied to the recording head 1 via the supply tube 2*a*. The recording head 1 and the tank 2 are coupled to each other via a discharge tube 2*b* such as a tube, and ink discharged from the recording head 1 is returned to the tank 2 via the discharge tube 2*b*, that is, circulation occurs. A plurality of tanks 2 may be provided.

Drive force from a drive motor 7 is transferred to the carriage 3 via a plurality of gears (not illustrated) and a timing belt 7*a*, and the carriage 3 mounted with the recording heads 1 is moved along the carriage shaft 5. On the other hand, the apparatus main body 4 is provided with a transport roller 8 as transport means, and the recording sheet S that is an ejection medium such as paper is transported by the transport roller 8. The transport means for transporting the recording sheet S is not limited to the transport roller 8, and may be a belt or a drum. In the present embodiment, a transport direction of the recording sheet S is the X direction.

In the ink jet recording apparatus I, a configuration in which the recording heads 1 are mounted on the carriage 3 and are moved in a main scanning direction has been exemplified, but there is no particular limitation thereto. For example, the present disclosure may be applied to a so-called line type recording apparatus in which the recording heads 1 are fixed, and the recording sheet S such as paper is moved in a sub-scanning direction such that printing is performed.

In each of the embodiments, an ink jet recording apparatus as an example of a liquid ejecting head and an ink jet recording apparatus as an example of a liquid ejecting apparatus have been described, but the present disclosure widely targets liquid ejecting heads and liquid ejecting apparatuses, and may also be applied to liquid ejecting heads or liquid ejecting apparatus ejecting liquids other than ink. Other liquid ejecting heads may be, for example, various recording heads used for image recording apparatuses such as printers, color material ejecting heads used to manufacture color filters of liquid crystal displays or the like, electrode material ejecting heads used to form electrodes of an organic EL displays or field emission displays (FEDs), and biological organic matter ejecting heads used to manufacture bio chips, and the present disclosure may be applied to liquid ejecting apparatuses including the liquid ejecting heads.

What is claimed is:

1. A liquid ejecting head comprising:

a plurality of nozzles that discharge a liquid in a first axis direction;

first and second common liquid chambers that communicate in common with the plurality of nozzles; and an individual flow path that is provided for each of the nozzles, couples the first common liquid chamber to the second common liquid chamber, and communicates with the nozzle between the first common liquid chamber and the second common liquid chamber, wherein each individual flow path includes a pressure chamber provided with an energy generation element, and an individual communication flow path coupling the pressure chamber to the first and second common liquid chambers, a plurality of the pressure chambers are arranged side by side in a second axis direction orthogonal to the first axis direction to form first and second pressure chamber rows, and the first pressure chamber row and the second pressure chamber row are disposed to be shifted relative to each other in a third axis direction orthogonal to the first axis direction and the second axis direction when viewed in the second axis direction, and the individual communication flow path corresponding to the first pressure chamber row has a portion overlapping a region between the adjacent pressure chambers of the second pressure chamber row when viewed in the first axis direction, the portion not overlapping the second pressure chamber row when viewed in the second axis direction.

2. The liquid ejecting head according to claim 1, wherein the individual communication flow paths corresponding to the first pressure chamber row have first portions arranged side by side in the second axis direction with the individual communication flow path, interposed therebetween, corresponding to the second pressure chamber row, and second portions arranged side by side in the second axis direction without the individual communication flow path, interposed therebetween, corresponding to the second pressure chamber row.

3. The liquid ejecting head according to claim 2, wherein in the individual communication flow path, a local flow path extending in the first axis direction has the first portion and the second portion.

4. The liquid ejecting head according to claim 2, wherein in the individual communication flow path, a local flow path coupling the pressure chamber to the nozzle has at least the second portion.

5. The liquid ejecting head according to claim 2, wherein in the individual communication flow path, a local flow path extending in the third axis direction from a coupling portion with the nozzle has at least the first portion.

6. The liquid ejecting head according to claim 2, wherein in the individual communication flow path, a volume of the second portion is larger than a volume of the first portion.

7. The liquid ejecting head according to claim 2, wherein in the individual communication flow path, a maximum width of the second portion in the second axis direction is larger than a maximum width of the first portion in the second axis direction.

8. The liquid ejecting head according to claim 2, wherein a maximum thickness of a partition wall partitioning the adjacent individual communication flow paths of the second portions from each other is larger than a maximum thickness of a partition wall partitioning the individual communication flow path of the first portion from the individual communication flow path corresponding to the second pressure chamber row.

9. The liquid ejecting head according to claim 2, wherein a partition wall partitioning the adjacent individual communication flow paths of the second portions from each other is thicker than a partition wall partitioning the adjacent pressure chambers of the first pressure chamber row from each other.

10. The liquid ejecting head according to claim 1, wherein the individual communication flow path corresponding to the second pressure chamber row has a portion disposed to overlap a region between the adjacent pressure chambers of the first pressure chamber row when viewed in the first axis direction, the portion disposed not to overlap the first pressure chamber row when viewed in the second axis direction.

11. The liquid ejecting head according to claim 1, wherein in a liquid flow of the individual communication flow path directed from the first common liquid chamber toward the second common liquid chamber, the nozzle corresponding to the first pressure chamber row is provided downstream of the pressure chamber, and the nozzle corresponding to the second pressure chamber row is provided upstream of the pressure chamber.

12. The liquid ejecting head according to claim 1, wherein the nozzles corresponding to the first and second pressure chamber rows are arranged side by side along the second axis direction to form nozzle rows, and a nozzle row corresponding to the first pressure chamber row and a nozzle row corresponding to the second pressure chamber row are disposed to be shifted in the third axis direction when viewed in the second axis direction.

13. The liquid ejecting head according to claim 12, wherein a shift distance between the nozzle rows is shorter than a shift distance between the pressure chamber rows.

14. The liquid ejecting head according to claim 1, wherein flow path resistance of the individual flow path from the first common liquid chamber to the nozzle is substantially the same as flow path resistance of the individual flow path from the second common liquid chamber to the nozzle.

15. The liquid ejecting head according to claim 1, wherein flow path resistance of the individual flow path from the first common liquid chamber to the nozzle is substantially the same between the individual flow path corresponding to the first pressure chamber row and the individual flow path corresponding to the second pressure chamber row.

16. A liquid ejecting system comprising:

the liquid ejecting head according to claim 1; and a circulation system that supplies a liquid to one of the first and second common liquid chambers, recovers the liquid from the other common liquid chamber, and causes a circulation flow in the individual flow path.

17. The liquid ejecting system according to claim 16, wherein a pressure difference in the nozzles when the liquid is not discharged from the nozzles is within ±2% in a state in which the circulation flow is caused in the individual flow path.

18. The liquid ejecting system according to claim 16, further comprising:

a controller that supplies a drive pulse to the energy generation element, wherein the controller supplies different drive pulses to energy generation elements respectively corresponding to the first and second pressure chamber rows.

* * * * *